US007144688B2

(12) United States Patent
Nakagawa et al.

(10) Patent No.: US 7,144,688 B2
(45) **Date of Patent: *Dec. 5, 2006**

(54) PHOTOTHERMOGRAPHIC MATERIAL AND IMAGE FORMING METHOD

(75) Inventors: Hajime Nakagawa, Kanagawa (JP); Takayasu Yasuda, Kanagawa (JP)

(73) Assignee: Fuji Photo Film Co., Ltd., Kangawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/849,515

(22) Filed: May 20, 2004

(65) Prior Publication Data

US 2004/0234910 A1 Nov. 25, 2004

(30) Foreign Application Priority Data

May 22, 2003 (JP) ..... 2003-144757

(51) Int. Cl.
*G03C 5/16* (2006.01)
*G03C 1/498* (2006.01)

(52) U.S. Cl. ..... 430/350; 430/523; 430/531; 430/619; 430/631

(58) Field of Classification Search ..... 430/523, 430/619, 531, 350, 631, 640
See application file for complete search history.

(56) References Cited

U.S. PATENT DOCUMENTS

| | | | | |
|---|---|---|---|---|
| 3,623,877 | A | 11/1971 | Langley et al. | |
| 4,152,160 | A | 5/1979 | Ikienoue et al. | |
| 4,332,889 | A | 6/1982 | Siga et al. | |
| 5,415,986 | A | 5/1995 | Fujita et al. | |
| 6,132,949 | A | 10/2000 | Fujita et al. | |
| 6,228,571 | B1 | 5/2001 | Hatakeyama | |
| 6,316,172 | B1 | 11/2001 | Hashimoto | |
| 6,329,127 | B1 * | 12/2001 | Ito et al. | 430/350 |
| 6,458,505 | B1 * | 10/2002 | Ito | 430/264 |
| 6,468,720 | B1 | 10/2002 | Hirabayashi et al. | |
| 6,468,725 | B1 | 10/2002 | Takamuki | |
| 6,485,898 | B1 | 11/2002 | Yoshioka et al. | |
| 2001/0029000 | A1 | 10/2001 | Yoshioka et al. | |
| 2001/0038981 | A1 | 11/2001 | Arimoto et al. | |
| 2004/0033449 | A1 * | 2/2004 | Inoue | 430/523 |
| 2004/0185389 | A1 | 9/2004 | Yoshioka et al. | |
| 2004/0229173 | A1 * | 11/2004 | Oyamada | 430/502 |

FOREIGN PATENT DOCUMENTS

| | | |
|---|---|---|
| EP | 1096 310 | 5/2001 |
| JP | A 11-352625 | 12/1999 |
| JP | A 11-352626 | 12/1999 |
| JP | A 2000-171935 | 6/2000 |
| JP | A 2002-162713 | 6/2002 |

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material having an image forming layer including at least a photosensitive silver halide, a non-photosensitive organic silver salt, a reducing agent and a binder, on one surface of a support, and having at least one back layer and a back surface protective layer, on the other surface of the support, wherein a binder of the back surface protective layer contains a water-soluble polymer and a latex polymer having a glass transition temperature of −30° C. to 40° C.; and an image forming method using the same.

The photothermographic material and the image forming method of the invention provide excellent coating property and excellent transportability during thermal development in a thermal developing apparatus.

14 Claims, 1 Drawing Sheet

PHOTOTHERMOGRAPHIC MATERIAL AND IMAGE FORMING METHOD

CROSS-REFERENCE TO RELATED APPLICATION

This application claims priority under 35 USC 119 from Japanese Patent Application No. 2003-144757 issue May 22, 2003, the disclosure of which is incorporated by reference herein.

BACKGROUND OF THE INVENTION

1. Field of the Invention

The present invention relates to a photothermographic material and a method of forming an image using the photothermographic material. More particularly, the invention relates to a photothermographic material and an image forming method which provide excellent coating property and transportability during thermal development in a thermal developing apparatus.

2. Description of the Related Art

In recent years, it has been strongly desired in the field of films for medical imaging to reduce the amount of used processing liquid waste in consideration of environmental protection and space saving. For this reason, technology regarding photothermographic materials as films for medical imaging and for photographic applications, which are capable of efficient exposure with a laser image setter or a laser imager and capable of forming a clear black-toned image with high resolution and high sharpness is desired. Such photothermographic materials can eliminate use of liquid processing chemicals and can provide users with a thermal development system which is simpler and does not contaminate the environment.

Although similar requirements also exist in the field of general image forming materials, an image for medical imaging requires a particularly high image quality excellent in sharpness and granularity because a delicate image representation is necessitated. Also an image of blue-black tone is preferred in consideration of easy diagnosis. Currently various hard copy systems utilizing pigments or dyes, such as ink jet printers and electrophotographic systems, are available as general image forming systems, but they are not satisfactory as output systems for medical images.

On the other hand, thermal image forming systems utilizing organic silver salts are described, for example, in United States Patent U.S. Pat. Nos. 3,152,904 and 3,457,075, as well as in "Thermally Processed Silver Systems", written by D. H. Klosterboer, appearing in "Imaging Processes and Materials", Neblette, 8th edition, edited by J. Sturge, V. Warlworth, and A. Shepp, Chapter 9, pages 279 to 291, 1989. More specifically, a photothermographic material generally comprises an image forming layer in which a catalytically active amount of photocatalyst (for example, a silver halide), a reducing agent, a reducible silver salt (for example, an organic silver salt) and, if necessary, a toner for controlling the tone of a developed silver image are dispersed in a matrix of a binder. The photothermographic material, when heated at high temperature (for example, 80° C. or higher) after image exposure, forms a black-toned silver image by an oxidation/reduction reaction between the silver halide or the reducible silver salt (functioning as an oxidizer) and the reducing agent. The oxidation/reduction reaction is promoted by a catalytic effect of a latent image formed by exposure on silver halide. As a result the black silver image is formed in an exposed area (see, for example, U.S. Pat. No. 2,910,377 and Japanese Patent Application Publication (JP-B) No. 43-4924). Further, Fuji Medical Dry Imager FM-DP L is an example of a practical medical image forming system using a photothermographic material that has been marketed.

In production of a thermographic system using an organic silver salt, two methods are known. In one method, a solvent coating is adopted, and in the other method a coating liquid containing polymer fine particles as a main binder in an aqueous dispersion is applied and dried. In the latter method, since no necessity arises for a process of solvent recovery or the like, a production facility is simple and the method is advantageous for mass production.

In these methods, the coating property is a very important factor in the production process. A simultaneous multi-layer coating process can be applied for the aqueous dispersion system, and therefore efficient production can be attained. Improvement of the coating property is eagerly desired in order to allow more efficient production.

As described above, high quality is demanded for the formed silver image. In addition to the demand for high quality images, good physical characteristics of the materials are also eagerly demanded. This is because a material that achieves high quality images cannot be practically used if the material is scratched during conveying or cutting. Especially for medical diagnosis, meticulous care is required because the scratched material may lead to a mistake in diagnosis. In recent years, with a demand for rapid processing of a photothermographic material, the material is required to be conveyed by driving rollers at a high speed and to be conveyed while bending along a sharp curve needed for making a developing apparatus compact. Therefore, improvement in the physical characteristics of the material surface is increasingly desired.

In particular, a photothermographic material has a distinct difference from a photosensitive material used for a liquid development process in that a photothermographic material contains all chemicals necessary for development. Furthermore, after the development process, all used chemicals remain within the processed material. Accordingly, any additives to improve the physical characteristics of the material surface affect the other components included. Therefore, improvement of the surface properties by additives alone is very difficult, and intense consideration is required in regards to an influence of additives on all components included in the photothermographic materials.

SUMMARY OF THE INVENTION

An object of the present invention is to provide a photothermographic material and an image forming method, which are excellent in coating property and transportability in a thermal developing apparatus.

1) A first aspect of the present invention is to provide a photothermographic material comprising an image forming layer containing at least a photosensitive silver halide, a non-photosensitive organic silver salt, a reducing agent and a binder, on one surface of a support, and comprising at least one back layer and a back surface protective layer, on the other surface of the support, wherein a binder of the back surface protective layer comprises a water-soluble polymer and a latex polymer having a glass transition temperature of −30° C. to 40° C.

2) A second aspect of the present invention is to provide an image forming method for a photothermograhic material using a thermal developing apparatus, wherein the thermal developing apparatus comprises a thermal developing portion having a driving roller and a plate heater, and the photothermographic material according to the first aspect is thermally developed by contacting a surface of the photothermographic material at a side at which the image forming layer is disposed with the driving roller, and by contacting a surface of the photothermographic material at a side at which the back layer is disposed with the plate heater.

DETAILED DESCRIPTION OF THE INVENTION

Figure 1:
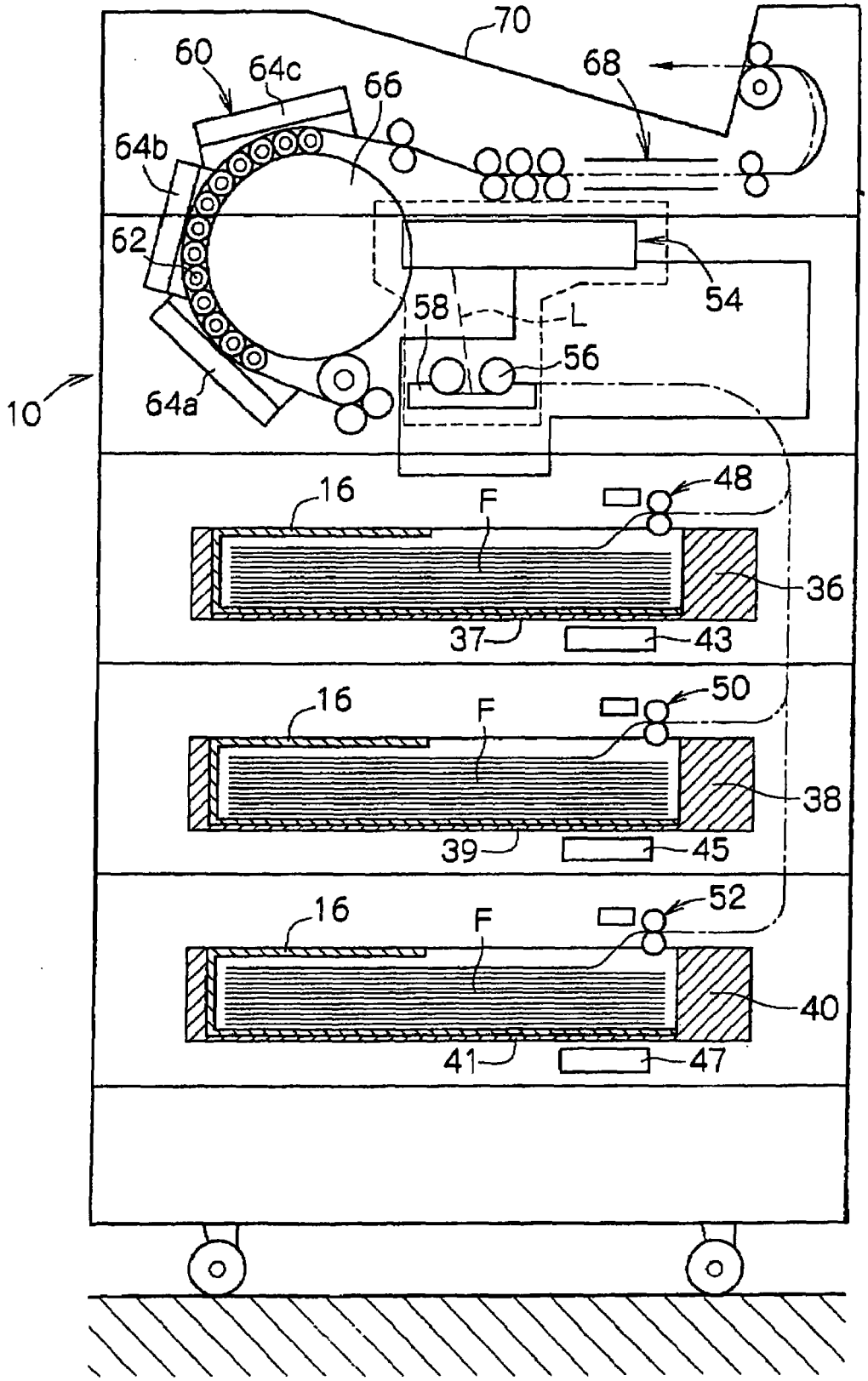
FIG. 1 is a schematic constitutional view of a thermal developing apparatus mounted with a laser recording device according to the present invention.

In order to attain improvement of the coating property and transportability, which is an object of the present invention, the inventors selected the most suitable additives for the back surface protective layer. This is because the back surface protective layer itself is a portion which contacts directly with the apparatus during transportation and other processing of the material.

As a result of intense investigations, the inventors have found out that the above-mentioned object is successfully attained by using a water-soluble polymer and a latex polymer having a glass transition temperature of −30° C. to 40° C. for a binder of the outermost layer of the back layer side.

The inventors have found out that a coefficient of dynamic friction of the material surface significantly increases at high temperature as the glass transition temperature of latex polymer of the back surface protective layer becomes higher. Further, it has also been proven that, at low temperature, the coefficient of dynamic friction does not depend on the glass transition temperature of the latex polymer used. This phenomenon cannot be observed if the measurement of the coefficient of dynamic friction is carried out at room temperature. That is to say, the inventors have found out that the transport deficiencies occurring during thermal development depend on the glass transition temperature of the latex polymer used in the back surface protective layer. In particular, improvement of the transportability of the processed material during heating is very important, because image unevenness is mainly due to the transport deficiencies of the material during thermal development.

Based on the above new information, the inventors attained the task of improving the transportability by lowering the glass transition temperature of the latex polymer for the binder of the back surface protective layer.

On the other hand, the transparency of the photothermographic material would prove to be inferior if the glass transition temperature of the latex polymer is too low.

The invention has been achieved by determining the most suitable glass transition temperature of the latex polymer in the binder of the back surface protective layer to be from −30° C. to 40° C. in view of all the above mentioned factors.

Within this range, the glass transition temperature is more preferably in a range of −30° C. to 24° C. in consideration of the coating property in the production of the material.

The aforementioned most suitable range of the glass transition temperature of the latex polymer may be applied to the case of combined use with a water-soluble polymer. The use of the water-soluble polymer in combination with the latex polymer may afford an advantage of easier performance of coating.

The photothermographic material and the image forming method according to the invention will be described in detail below.

1. Photothermographic Material

The photothermographic material in the present invention has an image forming layer comprising at least a photosensitive silver halide, a non-photosensitive organic silver salt, a reducing agent and a binder, on one surface of a support, and has at least one back layer and a back surface protective layer, on the other surface of the support.

1-1. Back Surface Protective Layer

There is no particular restriction on the back surface protective layer besides that the binder comprises a water-soluble polymer and a latex polymer having a glass transition temperature of −30° C. to 40° C. The back surface protective layer may be constructed by two or more layers. In the case of constituting the back surface protective layer from two or more layers, the binder of the outermost back surface protective layer farther from the support may include a water-soluble polymer and a latex polymer having a glass transition temperature of −30° C. to 40° C.

(Latex Polymer)

In the invention, preferred embodiment of the latex polymers used in the back surface protective layer includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer.

Particularly, it is preferred that the above-mentioned latex polymer is at least one polymer selected from acrylic polymers, poly(styrenes), acrylic-styrene copolymers, styrene-butadiene copolymers, poly(vinyl chlorides), poly(vinylidene chlorides), and poly(urethanes).

The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are not preferred either, because the filming properties result poor. Further, acrylic polymer latexes are particularly preferred for use.

In the photothermographic material according to the present invention, the polymer latex used for the binder may have a dispersion state where a water-insoluble hydrophobic polymer is dispersed as fine particles in a water-soluble dispersion medium. With respect to the dispersion state, the polymer may be emulsified in the dispersion medium, emulsion-polymerized or micelle dispersed or the polymer may have a partially hydrophilic structure in the polymer molecule so that the molecular chain itself is dispersed in the molecule.

It is useful that the polymer has partially a hydrophilic structure, for stabilizing the dispersion state of polymer latex. For example, polymers having an anionic, a cationic, and a non-ionic structure are preferred. Among them, the copolymerization with acrylic acids, methacrylic acids and the like is preferred to afford the polymer having anionic structure.

Because the presence of a surfactant in an emulsion polymerization process can stabilize the obtained dispersion state, the addition of a surfactant is preferred. Moreover, besides the addition of the surfactant in the emulsion polymerization, it is preferred to add a surfactant to the coating solution of the back surface protective layer, which may be effective on stabilizing the latex used. Particularly in the present invention, as the surfactants used for the aforementioned purpose, anionic surfactants are more preferably used in respect of keeping the transparency of the photothermographic material.

As such polymer latexes, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Ouyou (Application of synthetic latex)" (Takaaki Sugimura, Yasuo Kataoka, Soichi Suzuki, and Keiji Kasahara, Eds., published by Kobunshi Kankoukai (1993)), "Gosei Latex no Kagaku (Chemistry of synthetic latex)" (Soichi Muroi, published by Kobunshi Kankoukai (1970)),JP-A No. 64-538, and the like.

The average particle size of the dispersed particles preferably is in the range from 1 nm to 50,000 nm, and more preferably 5 nm to 1,000 nm. There is no particular limitation concerning particle size distribution of the dispersed particles, and may be widely distributed or may exhibit a monodisperse particle size distribution.

In particular, concerning the latex polymer used for the binder of the back surface protective layer according to the present invention, the glass transition temperature (Tg) is from −30° C. to 40° C. It is preferably from −30° C. to 24° C., and more preferably from −25° C. to 20° C.

Lowering Tg of the latex polymer as possible is preferred to improve transportability of the material. The practical upper limit for Tg is 40° C. In the case where Tg is higher than 40° C., an uniform coating is very difficult and coating with the coating solution being heated at high temperature is required.

On the other hand, in the case where Tg is lower than −30° C., the transparency of the photothermographic material becomes low and it is not preferable.

In the specification, Tg was calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder maybe of two or more kinds of polymers, if necessary. And, the polymers having Tg outside the range may be used in combination. In a case where two types or more of polymers differing in Tg may be blended for use, it is preferred that the weight-average Tg is in the range mentioned above.

The I/O value of the above-mentioned latex polymer according to the present invention is preferably in the range from 0.1 to 1.0, more preferably from 0.3 to 0.95, and still more preferably from 0.5 to 0.9. The I/O value herein is a value of an inorganic value divided by an organic value based on an organic conception diagram. The value can be calculated by a method described in "Yuuki Gainen Zu —Kiso To Ouyou— (Organic Concept Diagram—Fundamentals and Applications—)", written by Yoshio Kohda, published by Sankyo Shuppan (1984).

Here, the organic concept diagram is to indicate the entire organic compounds at each position on the orthogonal coordinate whose axes indicate, respectively, the organic axis and the inorganic axis, where the characteristics of the compounds are categorized into an organic value representing a covalent bond tendency and an inorganic value representing an ionic bond tendency. The inorganic value based on this diagram is determined with respect to inorganic property or the magnitude of affecting force to the boiling point by various substituents on a basis of hydroxyl group, and is a value in which an affecting force per hydroxyl group is defined taken as 100 in numerical, since it is about 100° C. if a distance between the boiling point curve of a straight chain alcohol and the boiling point curve of a straight chain paraffin is taken around a carbon atom number of five. In a meantime, the organic value is determined based on that the number of carbon atoms representing the methylene group where each methylene group in the molecule is treated as a unit can measure the magnitude of the number of the organic value. The organic value is set with a standard in which a single piece number of the carbon atom number as the basis is determined as 20 from the average boiling point increase of 20° C. caused by one carbon atom addition to the straight chain compound having around 5 to 10 carbon atoms. The inorganic value and the organic value are set to correspond one to one on the graph. The I/O value is calculated from those values.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents a glass transition temperature.

P-1; latex of -MMA(55) -EA(42) -MAA(3) - (Tg: 39° C., I/O value: 0.636)

P-2; latex of -MMA(47) -EA(50) -MAA(3) - (Tg: 29° C., I/O value: 0.636)

P-3; latex of -MMA(17) -EA(80) -MAA(3) - (Tg: −4° C., I/O value: 0.636)

P-4; latex of -EA(97) -MAA(3) - (Tg: −20° C., I/O value: 0.636)

P-5; latex of -EA(97) -AA(3) - (Tg: −21° C., I/O value: 0.648)

P-6; latex of -EA(90) -AA(10) - (Tg: −15° C., I/O value: 0.761)

P-7; latex of -MMA(50) -2EHA(35) -St(10) -AA(5) - (Tg: 34° C., I/O value: 0.461)

P-8; latex of -MMA(30) -2EHA(55) -St(10) -AA(5) - (Tg: 3° C., I/O value: 0.398)

P-9; latex of -MMA(10) -2EHA(75) -St(10) -AA(5) - (Tg: −23° C., I/O value: 0.339)

P-10; latex of -MMA(60) -BA(36) -AA(4) - (Tg: 29° C., I/O value: 0.581)

P-11; latex of -MMA(40) -BA(56) -AA(4) - (Tg: −2° C., I/O value: 0.545)

P-12; latex of -MMA(25) -BA(71) -AA(4) - (Tg: −22° C., I/O value: 0.519)

P-13; latex of -St(60) -BA(35) -AA(5) - (Tg: −29° C., I/O value: 0.250)

P-14; latex of -St(40) -BA(55) -AA(5) - (Tg: −2° C., I/O value: 0.319)

P-15; latex of -St(25) -BA(70) -AA(5) - (Tg: −21° C., I/O value: 0.377)

P-16; latex of -MMA(58) -ST(8) -BA(32) -AA(2) - (Tg: 34° C., I/O value: 0.515)

P-17; latex of -MMA(50) -St(8) -BA(35) -HEMA(5) - AA(2) - (Tg: 27° C., I/O value: 0.542)

P-18; latex of -MMA(42) -St(8) -BA(43) -HEMA(5) - AA(2) - (Tg: 14° C., I/O value: 0.528)

P-19; latex of -MMA(24) -St(8) -BA(61) -HEMA(5) - AA(2) - (Tg: −21° C., I/O value: 0.498)

P-20; latex of -MMA(48) -St(8) -BA(27) -HEMA(15) - AA(2) - (Tg: 39° C., I/O value: 0.619)

P-21; latex of -EA(96) -AA(4) - (Tg: −21° C., I/O value: 0.664)

P-22; latex of -EA(46) -MA(50) -AA(4) - (Tg: −4° C., I/O value: 0.739)

P-23; latex of -EA(80) -HEMA(16) -AA(4) - (Tg: −9° C., I/O value: 0.775)

P-24; latex of -EA(86) -HEMA(10) -AA(4) - (Tg: −13° C., I/O value: 0.733)

P-25; latex of -St(45) -Bu(52) -MAA(3) - (Tg: −26° C., I/O value: 0.990)

P-26; latex of -St(55) -Bu(42) -MAA(3) - (Tg: −9° C., I/O value: 0.105)

P-27; latex of -St(60) -Bu(37) -MAA(3) - (Tg: 1° C., I/O value: 0.109)

P-28; latex of -St(68) -Bu(29) -MAA(3) - (Tg: 17° C., I/O value: 0.114)

P-29; latex of -St(75) -Bu(22) -MAA(3) - (Tg: 34° C., I/O value: 0.119)

In the structures above, the abbreviations represent monomers as follows: MMA: methyl methacrylate, EA: ethyl acrylate, MA: methyl acrylate, MAA: methacrylic acid, 2EHA: 2-ethylhexyl acrylate, HEMA: hydroxyethyl methacrylate, St: styrene, Bu: butadiene, AA: acrylic acid.

The pH of the latex polymer described above was adjusted to 6 using an aqueous solution of sodium hydroxide after the synthesis. Thereafter the surfactant shown in the following table was added to the latex polymer dispersion.

TABLE 1

| Latex | Surfactant | Addition amount (% by weight based on solid content of latex) |
|---|---|---|
| P-1 | A-11 | 3 |
| P-2 | A-11 | 3 |
| P-3 | A-11 | 3 |
| P-4 | A-11 | 3 |
| P-5 | A-11 | 3 |
| P-6 | A-11 | 3 |
| P-7 | A-1 | 3 |
| P-8 | A-1 | 3 |
| P-9 | A-1 | 3 |
| P-10 | A-1 | 3 |
| P-11 | A-1 | 3 |
| P-12 | A-1 | 3 |
| P-13 | A-11 | 2 |
| P-14 | A-11 | 2 |
| P-15 | A-11 | 2 |
| P-16 | A-7 | 3 |
| P-17 | A-7 | 3 |
| P-18 | A-7 | 3 |
| P-19 | A-7 | 3 |
| P-20 | A-7 | 3 |
| P-21 | A-7 | 3 |
| P-22 | A-7 | 3 |
| P-23 | A-7 | 3 |
| P-24 | A-7 | 3 |
| P-25 | A-12 | 5 |
| P-26 | A-12 | 5 |

TABLE 1-continued

| Latex | Surfactant | Addition amount (% by weight based on solid content of latex) |
|---|---|---|
| P-27 | A-12 | 5 |
| P-28 | A-12 | 5 |
| P-29 | A-12 | 5 |

<Synthesis Example of Polymer Latex P-21>

Into a 2-liter three necked glass flask, 770 g of distilled water deaerated by a nitrogen gas for one hour, 2.38 g of surfactant A-17, 11.38 g of ethyl acrylate, and 0.47 g of acrylic acid were added, thereafter the inner temperature of the flask was elevated to 50° C. After the temperature was steady, a solution obtained by dissolving 0.528 g of sodium hydrogensulfite and 0.790 g of potassium persulfate in 60 g of distilled water was added to the aforesaid mixture, and kept for 30 minutes with stirring under nitrogen atmosphere. A solution obtained by dissolving 0.528 g of sodium hydrogen sulfite and 0.790 g of potassium persulfate in 60 g of distilled water was added thereto, and then a mixed solution of 216.05 g of ethyl acrylate and 9.00 g of acrylic acid was added dropwise for 90 minutes under nitrogen atmosphere. Thereto a solution obtained by dissolving 0.528 g of sodium hydrogen sulfite and 0.790 g of potassium persulfate in 60 g of distilled water was added, and kept for two hours with stirring under nitrogen atmosphere. Thereafter the inner temperature was elevated to 90° C. and the mixture was kept for one hour with stirring under nitrogen atmosphere. After the reaction was finished, the inner temperature was cooled to a room temperature, and 55 mL of 1N aqueous solution of sodium hydroxide was added and kept for 30 minutes with stirring. Thereafter the concentration of the polymer latex obtained was adjusted to 19.0% by weight with the addition of 142 mL of surfactant A-7 (5% by weight methanol/ water (6/4) solution), 0.44 g of benzisothiazoline sodium salt and water. The resulting polymer latex dispersion was filtered through a polypropylene filter with a pore size of 3.0 μm to remove foreign substances such as dusts to obtain 1247 g of the example compound P-21 (solid content 19.0% by weight, particle diameter 95 nm, pH=7.0).

The polymer latexes described above are commercially available, and polymers below are usable.

As examples of acrylic polymers, there can be mentioned Cevian A-4635, 4718, and 4601 (all manufactured by Daicel Chemical Industries, Ltd.), Nipol Lx811, 814, 821, 820, and 857 (P-30: Tg 36° C.) (all manufactured by Nippon Zeon Co., Ltd.), Voncoat R3370 (P-31: Tg 25° C.), 4280 (P-32: Tg 15° C.) (all manufactured by Dainippon Ink and Chemicals, Inc.), and the like.

As examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like.

As examples of poly(urethane), there can be mentioned HYDRAN AP10 (P-33: Tg 37° C.), 20, 30, 101H, Vondic 1320NS, 1610NS (all manufactured by Dainippon Ink and Chemicals, Inc.), and the like.

As examples of rubber, there can be mentioned LACSTAR 7310K, 3307B (P-34: Tg 13° C.), and 4700H (all manufactured by Dainippon Ink and Chemicals, Inc.), Nipol Lx410, 430, 435, 110, 415A, (P-35: Tg 27° C.), and 438C (all manufactured by Nippon Zeon Co., Ltd.), and the like.

As examples of poly(vinyl chloride), there can be mentioned G351 and G576 (all manufactured by Nippon Zeon Co., Ltd.), and the like.

As examples of poly(vinylidene chloride), there can be mentioned L502 and L513 (all manufactured by Asahi Chemical Industry Co., Ltd.), D-5071 (P-36: Tg 36° C.) (manufactured by Dainippon Ink and Chemicals, Inc.) and the like.

As examples of poly(olefin), there can be mentioned Chemipearl S120 and SA100 (all manufactured by Mitsui Petrochemical Industries, Ltd.), Voncoat 2830 (P-37: Tg 38° C.), 2210, and 2960 (all manufactured by Dainippon Ink and Chemicals, Inc.) and the like.

Examples of anionic surfactants which can be used for the back surface protective layer according to the present invention include surfactants such as alkylbenzene sulfonates, salts of sulfosuccinic diester and the like. Specific examples of the surfactant are shown below.

A-1

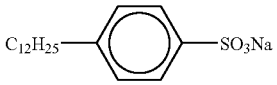

A-2

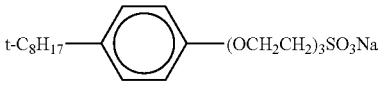

A-3

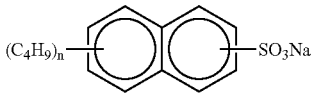

n ≒ 2

A-4

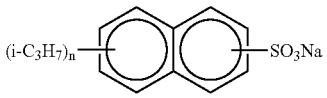

n ≒ 3

A-5

$C_{12}H_{25}OSO_3Na$

A-6

$C_{11}H_{23}CH{=}CHCH_2SO_3Na$ (60%)
$C_{11}H_{23}CH(OH)CH_2CH_2SO_3Na$ (40%) (mixture)

A-7

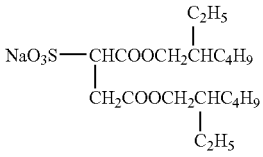

A-8

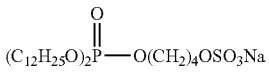

A-9

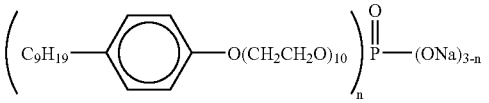

n = 1,2 (mixture)

A-10

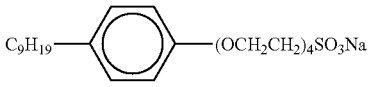

-continued

A-11

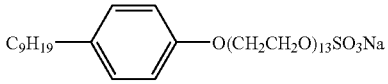

A-12

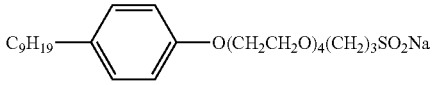

A-13

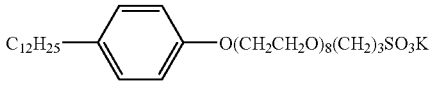

A-14

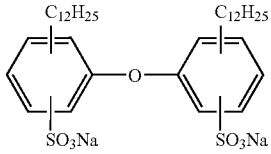

A-15

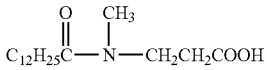

A-16

$C_{12}H_{25}{-}O(CH_2CH_2O)_8{-}SO_3Na$

A-17

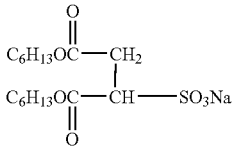

A-18

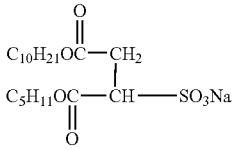

A-19

$C_{12}H_{25}{-}O(CH_2CH_2O)_4{-}(CH_2)_3{-}SO_3K$

A-20

$C_{16}H_{33}{-}O(CH_2CH_2O)_6{-}(CH_2)_4{-}SO_3Na$

A-21

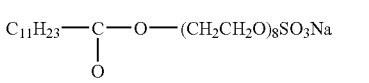

A-22

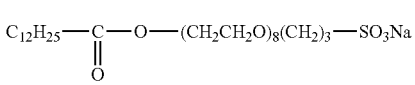

A-23

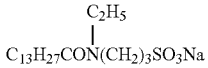

A-24

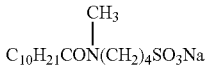

A-25

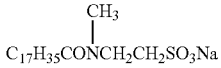

A-26

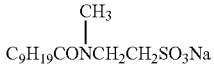

A-27

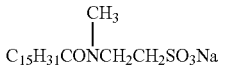

-continued

A-28

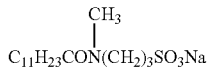

The addition amount of the latex polymer in the present invention is preferably from 5% by weight to 50% by weight with respect to the total amount of binders in the back surface protective layer. In case of less than 5% by weight, advantages according to the present invention cannot be attained. In case of more than 50% by weight, the film strength of the back surface protective layer is lowered, and the anti-scratch property and adhesion between layers is deteriorated. More preferable range is from 10% by weight to 45% by weight, and particularly preferable range is from 15% by weight to 40% by weight.

In addition to the latex polymer mentioned above, the back surface protective layer may include a water-soluble polymer described below. Any other polymer besides the latex polymer and the water-soluble polymer may be contained in the binder.

(Water-Soluble Polymer)

Water-soluble polymers in the invention may be polymers which are derived from animal protein or may be polymers which are not derived from animal protein. In the present invention, the polymers derived from animal protein mean natural or chemically modified water-soluble polymers such as glue, casein, gelatin, egg white and the like.

Water-soluble polymer derived from animal protein preferably is gelatin, in which are acid treated gelatin and alkali treated gelatin (lime extracted gelatin and the like) depending on a synthetic method and any of them can be preferably used. Gelatin having a molecular weight of 10,000 to 1,000,000 is used preferably. Modified gelatin utilizing an amino group or a carboxy group of gelatin (e.g., phthalated gelatin and the like) can be also used.

In the present invention, water-soluble polymer which is not derived from animal protein is natural polymer (polysaccharide series, microorganism series and animal series) except for animal protein such as gelatin and the like, semi-synthetic polymer (cellulose series, starch series and alginic acid series), synthetic polymer (vinyl series and others) and corresponds to synthetic polymer such as polyvinyl alcohol described below and natural or semi-synthetic polymer made by cellulose and the like derived from plant as a raw material. Polyvinyl alcohols and acrylic acid-vinyl alcohol copolymers are preferable.

1) Polyvinyl Alcohols

The water-soluble polymer that is not derived from animal protein in the present invention is preferably polyvinyl alcohols.

As the polyvinyl alcohols (PVA) preferably used in the present invention, there are compounds that have various degree of saponification, degree of polymerization, degree of neutralization, modified compound and copolymer with various monomers as described below.

As fully saponified compound, it can be selected among PVA-105 [polyvinyl alcohol (PVA) content: 94.0% by weight or more, degree of saponification: 98.5±0.5 mol %, content of sodium acetate: 1.5% by weight or less, volatile constituent: 5.0% by weight or less, viscosity (4% by weight at 20° C.): 5.6±0.4 CPS], PVA-110 [PVA content: 94.0% by weight, degree of saponification: 98.5±0.5 mol %, content of sodium acetate: 1.5% by weight, volatile constituent: 5.0% by weight, viscosity (4% by weight at 20° C.): 11.0±0.8 CPS], PVA-117 [PVA content: 94.0% by weight, degree of saponification: 98.5±0.5 mol %, content of sodium acetate: 1.0% by weight, volatile constituent: 5.0% by weight, viscosity (4% by weight at 20° C.): 28.0±3.0 CPS], PVA-117H [PVA content: 93.5% by weight, degree of saponification: 99.6±0.3 mol %, content of sodium acetate: 1.85% by weight, volatile constituent: 5.0% by weight, viscosity (4% by weight at 20° C.): 29.0±0.3 CPS], PVA-120 [PVA content: 94.0% by weight, degree of saponification: 98.5±0.5 mol %, content of sodium acetate: 1.0% by weight, volatile constituent: 5.0% by weight, viscosity (4% by weight at 20° C.): 39.5±4.5 CPS], PVA-124 [PVA content: 94.0% by weight, degree of saponification: 98.5±0.5 mol %, content of sodium acetate: 1.0% by weight, volatile constituent: 5.0% by weight, viscosity (4% by weight at 20° C.): 60.0±6.0 CPS], PVA-124H [PVA content: 93.5% by weight, degree of saponification: 99.6±0.3 mol %, content of sodium acetate: 1.85% by weight, volatile constituent: 5.0% by weight, viscosity (4% by weight at 20° C.): 61.0±6.0 CPS], PVA-CS [PVA content: 94.0% by weight, degree of saponification: 97.5±0.5 mol %, content of sodium acetate: 1.0% by weight, volatile constituent: 5.0% by weight, viscosity (4% by weight at 20° C.): 27.5±3.0 CPS], PVA-CST [PVA content: 94.0% by weight, degree of saponification: 96.0±0.5 mol %, content of sodium acetate: 1.0% by weight, volatile constituent: 5.0% by weight, viscosity (4% by weight at 20° C.): 27.0±3.0 CPS], PVA-HC [PVA content: 90.0% by weight, degree of saponification: 99.85 mol % or more, content of sodium acetate: 2.5% by weight, volatile constituent: 8.5% by weight, viscosity (4% by weight at 20° C.): 25.0±3.5 CPS] (above all trade names, produced by Kuraray Co., Ltd.), and the like.

As partial saponified compound, it can be selected among PVA-203 [PVA content: 94.0% by weight, degree of saponification: 88.0±1.5 mol %, content of sodium acetate: 1.0% by weight, volatile constituent: 5.0% by weight, viscosity (4% by weight at 20° C.): 3.4±0.2 CPS], PVA-204[PVA content: 94.0% by weight, degree of saponification: 88.0±1.5 mol %, content of sodium acetate: 1.0% by weight, volatile constituent: 5.0% by weight, viscosity (4% by weight at 20° C.): 3.9±0.3 CPS], PVA-205 [PVA content: 94.0% by weight, degree of saponification: 88.0±1.5 mol %, content of sodium acetate: 1.0% by weight, volatile substance: 5.0% by weight, viscosity (4% by weight at 20° C.): 5.0±0.4 CPS], PVA-210 [PVA content: 94.0% by weight, degree of saponification: 88.0±1.0 mol %, content of sodium acetate: 1.0% by weight, volatile constituent: 5.0% by weight, viscosity (4% by weight at 20° C.): 9.0±1.0 CPS], PVA-217 [PVA content: 94.0% by weight, degree of saponification: 88.0±1.0 mol %, content of sodium acetate: 1.0% by weight, volatile constituent: 5.0% by weight, viscosity (4% by weight at 20° C.): 22.5±2.0 CPS], PVA-220 [PVA content: 94.0% by weight, degree of saponification: 88.0±1.0 mol %, content of sodium acetate: 1.0% by weight, volatile constituent: 5.0% by weight, viscosity (4% by weight at 20° C.): 30.0±3.0 CPS], PVA-224 [PVA content: 94.0% by weight, degree of saponification: 88.0±1.5 mol %, content of sodium acetate: 1.0% by weight, volatile constituent: 5.0% by weight, viscosity (4% by weight at 20° C.): 44.0±4.0 CPS], PVA-228 [PVA content: 94.0% by weight, degree of saponification: 88.0±1.5 mol %, content of sodium acetate: 1.0% by weight, volatile constituent: 5.0% by weight, viscosity (4% by weight at 20° C.): 65.0±5.0 CPS], PVA-235 [PVA content: 94.0% by weight, degree of saponification: 88.0±1.5 mol %, content of sodium acetate: 1.0% by weight, volatile constituent: 5.0% by weight, viscosity (4% by weight at 20° C.): 95.0±15.0 CPS], PVA-217EE

[PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-217E [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-220E [PVA content: 94.0% by weight, degree of saponification: 88.0±1.0 mol %, content of sodium acetate: 1.0% by weight, volatile constituent: 5.0% by weight, viscosity (4% by weight at 20° C.): 31.0±4.0 CPS], PVA-224E [PVA content: 94.0% by weight, degree of saponification: 88.0±1.0 mol %, content of sodium acetate: 1.0% by weight, volatile constituent: 5.0% by weight, viscosity (4% by weight at 20° C.): 45.0±5.0 CPS], PVA-403 [PVA content: 94.0% by weight, degree of saponification: 80.0±1.5 mol %, content of sodium acetate: 1.0% by weight, volatile constituent: 5.0% by weight, viscosity (4% by weight at 20° C.): 3.1±0.3 CPS], PVA-405 [PVA content: 94.0% by weight, degree of saponification: 81.5±1.5 mol %, content of sodium acetate: 1.0% by weight, volatile constituent: 5.0% by weight, viscosity (4% by weight at 20° C.): 4.8±0.4 CPS], PVA-420 [PVA content: 94.0% by weight, degree of saponification: 79.5±1.5 mol %, content of sodium acetate: 1.0% by weight, volatile constituent: 5.0% by weight], PVA-613 [PVA content: 94.0% by weight, degree of saponification: 93.5±1.0 mol %, content of sodium acetate: 1.0% by weight, volatile constituent: 5.0% by weight, viscosity (4% by weight at 20° C.): 16.5±2.0 CPS], L-8 [PVA content: 96.0% by weight, degree of saponification: 71.0±1.5 mol %, content of sodium acetate: 1.0% by weight (ash), volatile constituent: 3.0% by weight, viscosity (4% by weight at 20° C.): 5.4±0.4 CPS] (above all are trade names, produced by Kuraray Co., Ltd.), and the like.

The above values were measured in the manner described in JISK-6726-1977.

As modified polyvinyl alcohol, it can be selected among cationic modified compound, anionic modified compound, modified compound by —SH compound, modified compound by alkylthio compound and modified compound by silanol. Further the modified polyvinyl alcohol described in "POVAL" (Koichi Nagano et. al., edited by Koubunshi Kankoukai) can be used.

As this modified polyvinyl alcohol (modified PVA), there are C-118, C-318, C-318-2A, C-506 (above all are trade names, produced by Kuraray Co., Ltd.) as C-polymer, HL-12E, HL-1203 (above all are trade name, produced by Kuraray Co., Ltd.) as HL-polymer, HM-03, HM-N-03 (above all are trade marks, produced by Kuraray Co., Ltd.) as HM-polymer, M-115 (trade mark, produced by Kuraray Co., Ltd.) as M-polymer, MP-102, MP-202, MP-203 (above all are trade mark, produced by Kuraray Co., Ltd.) as MP-polymer, MPK-1, MPK-2, MPK-3, MPK-4, MPK-5, MPK-6 (above all are trade marks, produced by Kuraray Co., Ltd.) as MPK-polymer, R-1130, R-2105, R-2130 (above all are trade marks, produced by Kuraray Co., Ltd.) as R-polymer, V-2250 (trade mark, produced by Kuraray Co., Ltd.) as V-polymer and the like.

Viscosity of aqueous solution of polyvinyl alcohol can be controlled or stabilized by addition of small amount of solvent or inorganic salts, which are described in detail in above literature "POVAL" (Koichi Nagano et. al., edited by Koubunshi Kankoukai, pages 144 to 154). The typical example preferably is to imcorporate boric acid to improve the surface quality of coating. The addition amount of boric acid preferably is from 0.01% by weight to 40% by weight with respect to polyvinyl alcohol.

It is also described in above-mentioned "POVAL" that the crystallization degree of polyvinyl alcohol is improved and waterproof property is improved by heat treatment. The binder can be heated at coating-drying process or can be additionally subjected to heat treatment after drying, and therefore, polyvinyl alcohol, which can be improved in waterproof property during those processes, is particularly preferable among water-soluble polymers.

Furthermore, it is preferred that a waterproof improving agent such as those described in above "POVAL" (pages 256 to 261) is added. As examples, there can be mentioned aldehydes, methylol compounds (e.g., N-methylolurea, N-methylolmelamine and the like), active vinyl compounds (divinylsulfones and their derivatives and the like), bis(β-hydroxyethylsulfones), epoxy compounds (epichlorohydrins and their derivatives and the like), polyvalent carboxylic acids (dicarboxylic acids, polyacrylic acid as polycarboxylic acids, methyl vinyl ether/maleic acid copolymers, isobutylene/maleic anhydride copolymers and the like), diisocyanates, and inorganic crosslinking agents (Cu, B, Al, Ti, Zr, Sn, V, Cr and the like).

In the present invention, inorganic crosslinking agents are preferable as a waterproof improving agent. Among these inorganic crosslinking agents, boric acids and their derivative are preferred and boric acid is particularly preferable. Specific examples of boric acid derivatives are shown below.

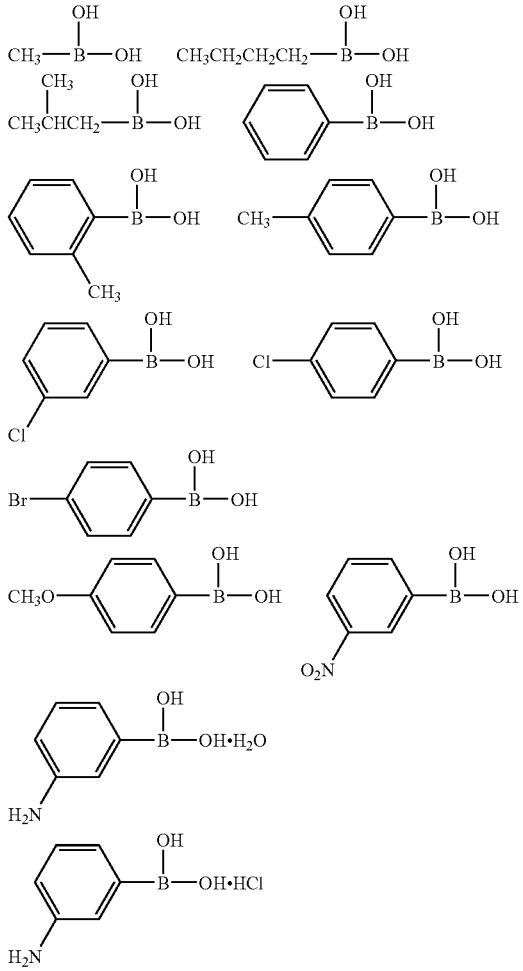

-continued

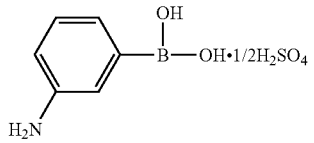

The addition amounts of these waterproof improving agents are preferably in the range from 0.01% by weight to 40% by weight with respect to polyvinyl alcohol.

2) Other Water-Soluble Polymers

Water-soluble polymers which are not derived from animal protein in the present invention besides above-mentioed polyvinyl alcohols are described below.

As typical examples, plant polysaccharides, such as gum arabic, κ-carrageenan, ι-carrageenan, λ-carrageenan, guar gum (Supercol produced by SQUALON Co. and the like), locust bean gum, pectin, tragacanth gum, corn starch (Purity-21 produced by National Starch & Chemical Co. and the like), starch phosphate (National 78-1898 produced by National Starch & Chemical Co. and the like) are included.

Also as polysaccharides derived from microorganism, xanthan gum (Keltrol T produced by KELCO Co. and the like), dextrin (Nadex 360 produced by National Starch & Chemical Co. and the like) and as animal polysaccharides, sodium chondroitin sulfate (Cromoist CS produced by CRODA Co. and the like) and the like are included.

And as cellulose polymer, ethyl cellulose (Cellofas WLD produced by I.C.I. Co. and the like), carboxymethyl cellulose (CMC produced by Daicel Chemical Industries, Ltd. and the like), hydroxyethyl cellulose (HEC produced by Daicel Chemical Industries, Ltd. and the like), hydroxypropyl cellulose (Klucel produced by AQUQLON Co. and the like), methyl cellulose (Viscontran produced by HENKEL Co. and the like), nitrocellulose (Isopropyl Wet produced by HELCLES Co. and the like) and cationized cellulose (Crodacel QM produced by CRODA Co. and the like) are included. As alginic acid series, sodium alginate, (Keltone produced by KELCO Co. and the like), propylene glycol alginate and the like and as other classification, cationized guar gum (Hi-care 1000 produced by ALCOLAC Co. and the like) and sodium hyaluronate (Hyalure produced by Lifecare Biomedial Co. and the like) are included.

As others, agar, furcelleran, guar gum, karaya gum, larch gum, guar seed gum, psylium seed gum, kino's seed gum, tamarind gum, tara gum and the like are included. Among them, highly water-soluble compound is preferable and the compound in which can solution sol-gel conversion can occur within 24 hours at a temperature change in the range of 5° C. to 95° C. is preferably used.

As for synthetic polymers, sodium polyacrylate, polyacrylic acid copolymers, polyacrylamide, polyacrylamide copolymers and the like as acryl series, polyvinyl pyrrolidone, polyvinyl pyrrolidone copolymers and the like as vinyl series and polyethylene glycols, polypropylene glycols, polyvinyl ethers, polyethylene imines, polystyrene sulfonic acid and its copolymers, polyacrylic acid and its copolymer, polyvinyl sulfanic acid and its copolymers, maleic acid copolymers, maleic acid monoester copolymers, acryloylmethylpropane sulfonic acid and its copolymers, and the like are included.

Highly water absorbable polymers described in U.S. Pat. No. 4,960,681, JP-A No. 62-245260 and the like, namely such as homopolymers of vinyl monomer having —COOM or —$SO_3M$ (M represents a hydrogen atom or an alkali metal) or copolymers of their vinyl monomers or other vinyl monomers (e.g., sodium methacrylate, ammonium methacrylate and Sumikagel L-5H produced by SUMITOMO KAGAKU Co.) can be also used.

Among these, Sumikagel L-5H produced by SUMITOMO KAGAKU Co.) is preferably used as the water-soluble polymer.

Water-soluble polymer is preferably included in the binder of the back surface protective layer in an amount of 50% by weight to 95% by weight, more preferably 55% by weight to 90% by weight, and most preferably 60% by weight to 85% by weight.

(Coating Amount of Binder)

Coating amount of these binders preferably is 0.1 g/$m^2$ to 5 g/$m^2$ per one $m^2$ of support, and more preferably 0.5 g/$m^2$ to 3 g/$m^2$.

(Other Components)

In the present invention, the back surface protective layer can include various additives such as a matting agent, a hardener, a fluorocarbon surfactant, an anti-glazing agent, a filter dye, a crosslinking agent and the like.

To control the minimum film-forming temperature, a auxiliary film-forming promoting agent may be added. The film-forming promoting agent is called as a temporally plasticizer and is the compound (usually an organic solvent) which makes a minimum film-forming temperature of polymer latex decrease and for instance, is described in the above "GOUSEI LATEX NO KAGAKU" (Souichi Muroi, published by Koubunshi Kankoukai in 1970). The preferred film-forming promoting agents are following compounds, but the compounds for use of the present invention are not limited the following specific examples.

Z-1: benzyl alcohol

Z-2: 2,2,4-trimethylpentanediol-1,3-monoisobutylate

Z-3: 2-dimethylaminoethanol

Z-4: diethylene glycol

Especially, it is preferred to add a film-forming promoting agent, and the addition amount is preferably 1% by weight to 30% by weight, and more preferably 5% by weight to 20% by weight, with respect to the solid content of polymer latex in the coating solution for a protective layer.

1-2. Back Layer

In the present invention, a back layer is set on the opposite surface side of the image forming layer toward the support. Back layers which can be used in the invention are described in paragraph Nos. 0128 to 0130 of JP-A No. 11-65021.

In the invention, coloring matters having maximum absorption in the wavelength range from 300 nm to 450 nm may be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range from 0.1 mg/$m^2$ to 1 g/$m^2$, preferably to the back layer which is provided on the opposite surface side of the image forming layer toward the support.

Further, in order to control the basic color tone, it is preferred to use a dye having an absorption peak in the wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming surface side, or on the back surface side.

1-3. Antihalation Layer

The photothermographic material of the present invention may comprise an antihalation layer provided to the side farther from the light source with respect to the image forming layer. The antihalation layer may be a back layer described above. Further, it may be a layer provided between the support and the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for decolorization by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in the range from 0.15 to 2, and more preferably from 0.2 to 1. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two types or more of thermal bleaching dyes may be used in combination in a photothermographic material. Similarly, two types or more of base precursors may be used in combination.

In the case of thermal decolorization by the combined use of a bleaching dye and a base precursor, it is advantageous from the viewpoint of thermal decolorization efficiency to further use the substance capable of lowering the melting point by at least 3° C. when mixed with the base precursor (e.g., diphenylsulfone, 4-chlorophenyl(phenyl)sulfone) as disclosed in JP-A No. 11-352626.

1-4. Image Forming Layer

The image forming layer of the invention is constructed on a support by one or more layers. In the case of constituting the layer by a single layer, it comprises an organic silver salt, photosensitive silver halide, a reducing agent, and a binder, which may further comprise additional materials as desired if necessary, such as a toner, a film forming promoting agent, and other auxiliary agents. In the case of constituting the image forming layer from two or more layers, the first image forming layer (in general, a layer placed adjacent to the support) may contain an organic silver salt and a photosensitive silver halide, and some of the other components may be incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the image forming layers as described in U.S. Pat. No. 4,460,681.

The main components of the image forming layer will be described in detail below.

(Organic Silver Salt)

1) Composition

The organic silver salt according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. Among the silver salts of fatty acid, it is preferred to use a silver salt of fatty acid with a silver behenate content of 50 mol % or more, more preferably, 85 mol % or more, and further preferably, 95 mol % or more. And, it is preferred to use a silver salt of fatty acid with a silver erucate content of 2 mol % or less, more preferably, 1 mol % or less, and further preferably, 0.1 mol % or less.

It is preferred that the content of the silver stearate is 1 mol % or less. When the content of the silver stearate is 1 mol % or less, a silver salt of organic acid having low Dmin, high sensitivity and excellent image stability can be obtained. The content of the silver stearate above-mentioned, is preferably 0.5 mol % or less, more preferably, the silver stearate is not substantially contained.

Further, in the case the silver salt of organic acid includes silver arachidinic acid, it is preferred that the content of the silver arachidinic acid is 6 mol % or less in order to obtain a silver salt of organic acid having low Dmin and excellent image stability. The content of the silver arachidinate is more preferably 3 mol % or less.

2) Shape

There is no particular restriction on the shape of the organic silver salt usable in the invention and it may needle-like, bar-like, tabular or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧1.5 and, more preferably, 15≧x (average)≧1.5. By the way, needle-like is expressed as 1≦x (average)<1.5.

In the flaky shaped particle, a can be regarded as a thickness of a tabular particle having a main plate with b and c being as the sides. a in average is preferably 0.01 μm to 0.3 μm and, more preferably, 0.1 μm to 0.23 μm. c/b in average preferably 1 to 9, more preferably, 1 to 6, further preferably, 1 to 4 and, most preferably, 1 to 3.

By controlling the sphere equivalent diameter to be 0.05 μm to 1 μm, it causes less agglomeration in the photothermographic material and image stability is improved. The sphere equivalent diameter is preferably 0.1 μm to 1 μm. In the invention, the sphere equivalent diameter can be measured by a method of photographing a sample directly by using an electron microscope and then image-processing negative images.

In the flaky shaped particle, the sphere equivalent diameter of the particle/a is defined as an aspect ratio. The aspect ratio of the flaky particle is, preferably, 1.1 to 30 and, more preferably, 1.1 to 15 with a viewpoint of causing less agglomeration in the photothermographic material and improving the image stability.

As the particle size distribution of the organic silver salt, mono-dispersion is preferred. In the mono-dispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the mono-dispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the scattering of scattered light to the change of time.

3) Preparing Method

Methods known in the art may be applied to the method for producing the organic silver salt used in the invention, and to the dispersion method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per one mol of the organic acid silver salt in the solution and, further preferably, positive addition of the photosensitive silver salt is not conducted.

In the invention, the photothermographic material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in the range from 1 mol % to 30 mol %, more preferably, in the range from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing are used preferably for controlling the photographic properties.

4) Addition Amount

While an organic silver salt in the invention can be used in a desired amount, an amount of an organic silver salt is preferably in the range from 0.1 g/m$^2$ to 5.0 g/m$^2$, more preferably 0.3 g/m$^2$ to 3.0 g/m$^2$, and further preferably 0.5 g/m$^2$ to 2.0 g/m$^2$, with respect to total coating amount of Ag including silver halide. Particularly, it is preferred that an amount of total silver preferably is 1.8 g/m$^2$ or less, and more preferably from 1.6 g/m$^2$ or less, to improve the image stability. Using the preferable reducing agent of the invention, it is possible to obtain a sufficient image density even with such a low amount of silver.

(Reducing Agent)

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A 0803764 A1 (page 7, line 34 to page 18, line 12).

In the invention, a so-called hindered phenolic reducing agent or a bisphenol agent having a substituent at the ortho-position to the phenolic hydroxyl group is preferred and the compound represented by the following formula (R) is more preferred.

Formula (R)

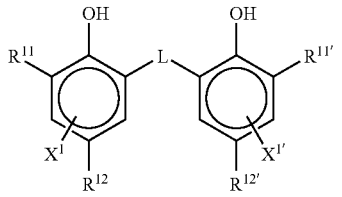

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Each of the substituents is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, $X^1$ and $X^{1'}$ $R^{12}$ and $R^{12'}$ each independently represent a hydrogen atom or a group capable of substituting for a hydorgen atom on a benzene ring. $X^1$ and $X^{1'}$ each independently represent a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent. Specific examples of the non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group. Examples of the substituent for the alkyl group can include, like substituent $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represent, more preferably, tertiary alkyl group having 4 to 12 carbon atoms and, among them, t-butyl group, t-amyl group, 1-methylcyclohexyl group are further preferred, t-butyl group being most preferred.

$R^{12}$ and $R^{12'}$ are, preferably, an alkyl group having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

$X^1$ and $X^{1'}$ are, preferably, a hydrogen atom, a halogen atom, or an alkyl group, and more preferably, a hydrogen atom.

L is preferably a group —$CHR^{13}$—.

$R^{13}$ is, preferably, a hydrogen atom or an alkyl group having 1 to 15 carbon atoms. The alkyl group is preferably methyl group, ethyl group, propyl group, isopropyl group and 2,4,4-trimethylpentyl group. Particularly preferred $R^{13}$ is a hydrogen atom, methyl group, propyl group or isopropyl group.

In a case where $R^{13}$ is a hydrogen atom, $R^{12}$ and $R^{12'}$ each represent, preferably, an alkyl group having 2 to 5 carbon atoms, ethyl group and propyl group being more preferred and ethyl group being most preferred.

In a case where $R^{13}$ is a primary or secondary alkyl group having 1 to 8 carbon atom, $R^{12}$ and $R^{12'}$ each represent preferably methyl group. As the primary or secondary alkyl group of 1 to 8 carbon atoms for $R^{13}$, methyl group, ethyl group, propyl group and isopropyl group are more preferred, and methyl group, ethyl group, and propyl group are further preferred.

In a case where each of $R^{11}$, $R^{11'}$ and $R^{12}$, $R^{12'}$ is methyl group, $R^{13}$ is preferably a secondary alkyl group. In this case, the secondary alkyl group for $R^{13}$ is preferably isopropyl group, isobutyl group and 1-ethylpentyl group, with isopropyl group being more preferred.

The reducing agent described above shows different thermal developing performances or developed-silver tones or the like depending on the combination of $R^{11}$, $R^{11'}$ and $R^{12}$, $R^{12'}$, as well as $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

(R-1)

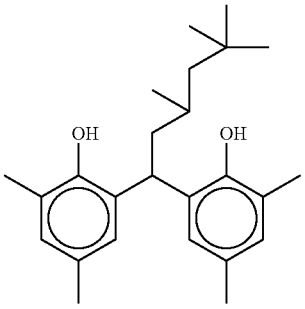

(R-2)

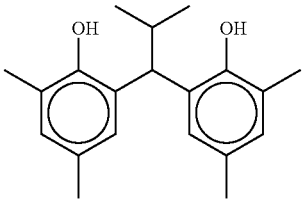

(R-3)

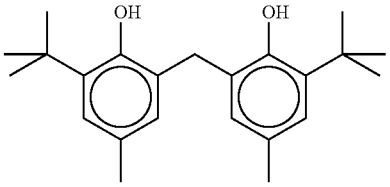

(R-4)

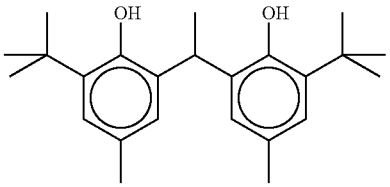

-continued (R-5)

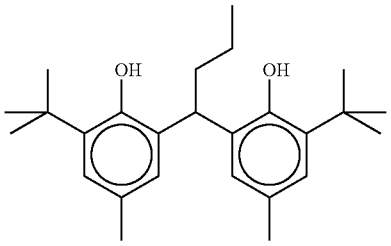

(R-6)

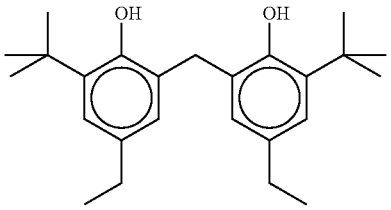

(R-7)

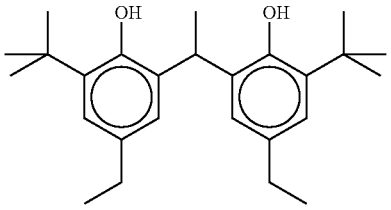

(R-8)

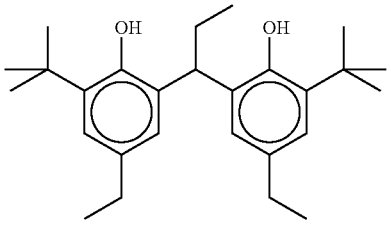

(R-9)

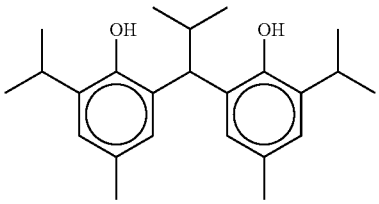

(R-10)

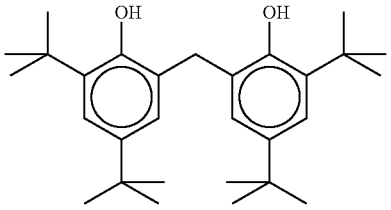

(R-11)

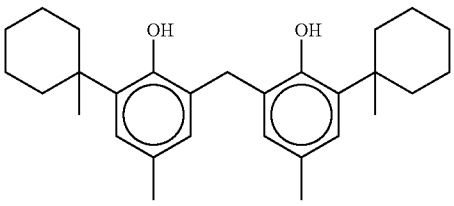

-continued (R-12)

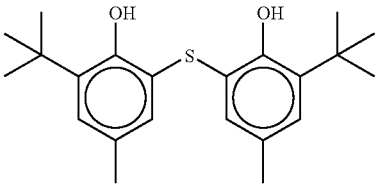

(R-13)

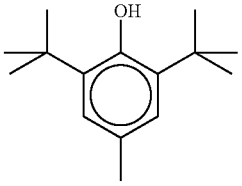

(R-14)

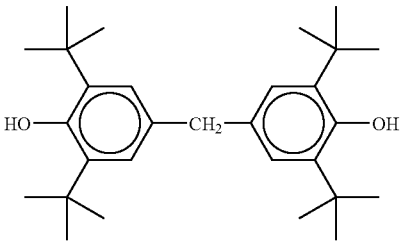

(R-15)

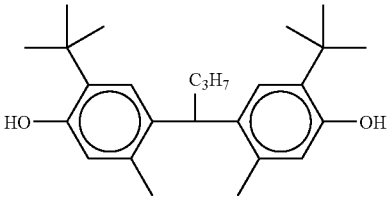

As preferred reducing agents of the invention other than those above, there can be mentioned compounds disclosed in JP-A Nos. 2001-188314, 2001-209145, 2001-350235, and 2002-156727.

In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is, preferably, contained in a range of 5 mol % to 50 mol %, more preferably, 8 mol % to 30 mol % and, further preferably, 10 mol % to 20 mol % per one mol of silver in the image forming layer. The reducing agent of the invention is preferably contained in the image forming layer.

In the invention, the reducing agent may be incorporated into photothermographic material by being added into the coating solution, such as in the form of a solution, an emulsion dispersion, a solid fine particle dispersion, and the like.

As a well known emulsion dispersion method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid fine particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, a preservative (for instance, sodium benzoisothiazolinone salt) is added in the water dispersion.

In the invention, furthermore, the reducing agent is preferably used as a solid particle dispersion, and the reducing agent is added in the form of fine particles having average particle size from 0.01 μm to 10 μm, and more preferably, from 0.05 μm to 5 μm, and further preferably, from 0.1 μm to 2 μm. In the invention, other solid dispersions are preferably used with this particle size range.

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in the range from 0.1 mol % to 20 mol %, preferably, in the range from 0.5 mol % to 10 mol % and, more preferably, in the range from 1 mol % to 5 mol % with respect to the reducing agent. The introduction methods to the photothermographic material can include, the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

$Q_1$-NHNH-$Q_2$ Formula (A-1)

(wherein, $Q_1$ represents an aromatic group or a heterocyclic group coupling at a carbon atom to —NHNH-$Q_2$ and $Q_2$ represents a carbamoyl group, an acyl group, an alkoxycarbonyl group, an aryloxycarbonyl group, a sulfonyl group or a sulfamoyl group).

In formula (A-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl} carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

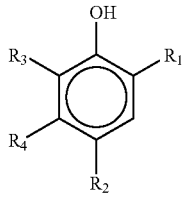

In formula (A-2), $R_1$ represents an alkyl group, an acyl group, an acylamino group, a sulfoneamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$, $R_4$ each represents a group capable of substituting for a hydrpgen atom on a benzene ring which is mentioned as the example of the substituent for formula (A-1). $R_3$ and $R_4$ may bond together to form a condensed ring.

$R_1$ is, preferably, an alkyl group having 1 to 20 carbon atoms (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), an acylamino group (including ureido group or urethane group) being more preferred. $R_2$ is, preferably, a halogen atom (more preferably, chlorine atom, bromine atom), an alkoxy group (for example, methoxy group, butoxy group, n-hexyloxy group, n-decyloxy group, cyclohexyloxy group or benzyloxy group), or an aryloxy group (phenoxy group or naphthoxy group).

$R_3$ preferably is a hydrogen atom, a halogen atom or an alkyl group having 1 to 20 carbon atoms, and most preferably a halogen atom. $R_4$ is preferably a hydrogen atom, alkyl group or an acylamino group, and more preferably an alkyl group or an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in formula (A-2) bond together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, an alkoxy group or an aryloxy group and, particularly, preferably an alkoxy group.

Preferred specific examples for the development accelerator of the invention are to be described below. The invention is not restricted to them.

(A-1)

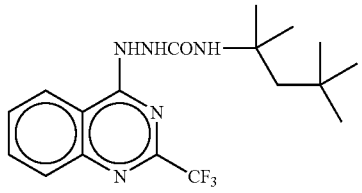

(A-2)

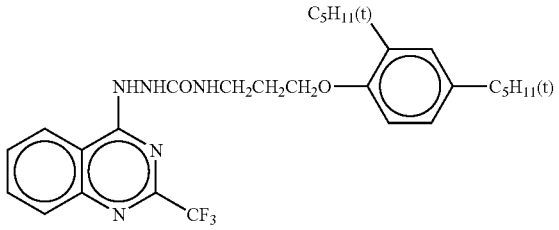

(A-3)

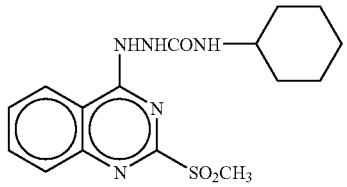

(A-4)

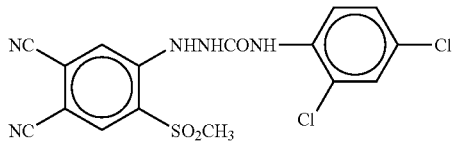

(A-5)

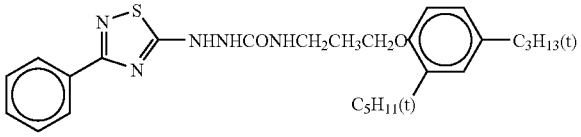

-continued (A-6)

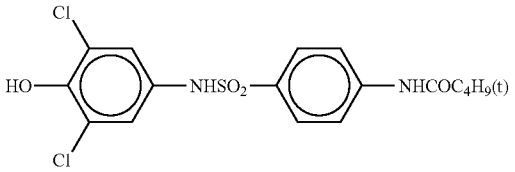

(A-7)

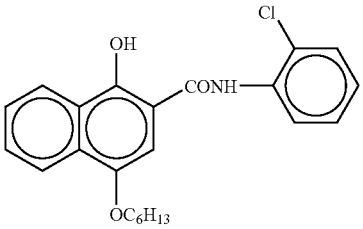

(A-8)

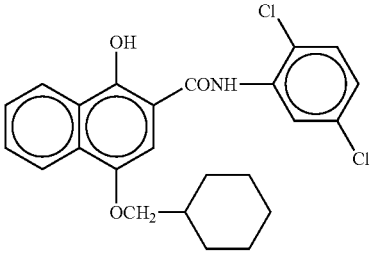

(A-9)

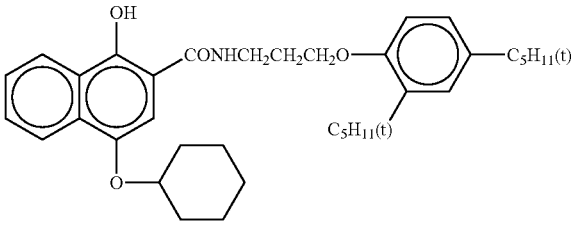

(A-10)

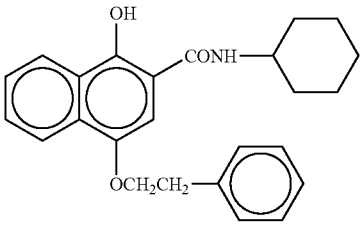

(A-11)

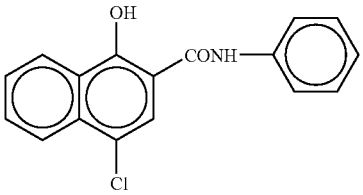

-continued (A-12)

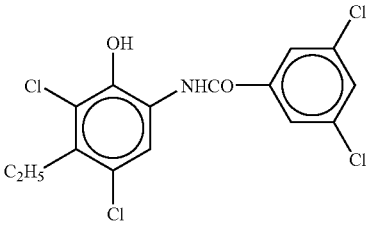

(Hydrogen Bonding Compound)

In the invention, in the case where the reducing agent has an aromatic hydroxyl group (—OH) or an amino group (—NHR, R represents each one of hydrogen atom and alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

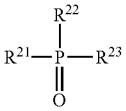

In formula (D), $R^{21}$ to $R^{23}$ each independently represent an alkyl group, an aryl group, an alkoxy group, an aryloxy group, an amino group, or a heterocyclic group, which may be substituted or not substituted.

In the case $R^{21}$ to $R^{23}$ contain a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As aryloxy groups, there can be mentioned phenoxy group, cresyloxy group, isopropylphenoxy group, 4-t-butylphenoxy group, naphthoxy group, biphenyloxy group, and the like.

As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

(D-1)

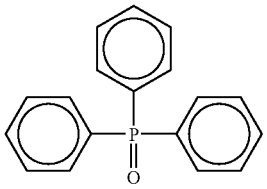

(D-2)

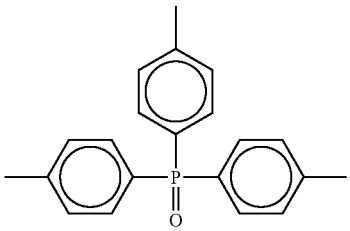

(D-3)

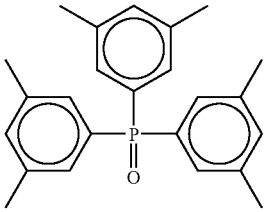

-continued (D-4)

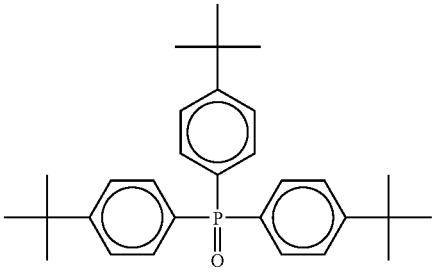

(D-5)

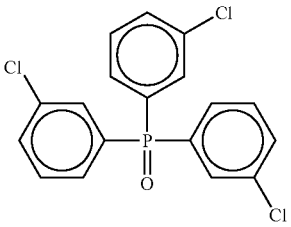

(D-6)

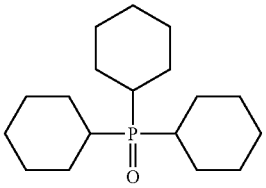

(D-7)

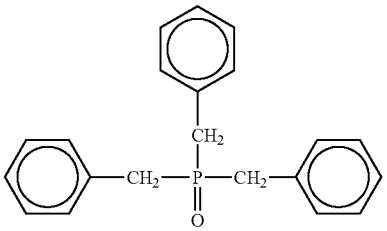

(D-8)

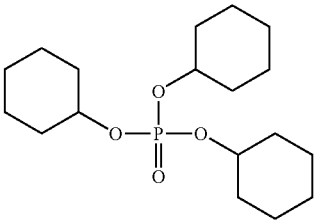

(D-9)

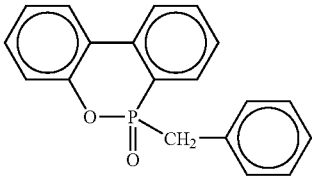

(D-10)

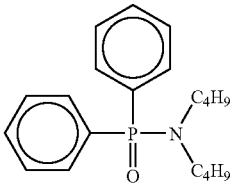

-continued (D-11)

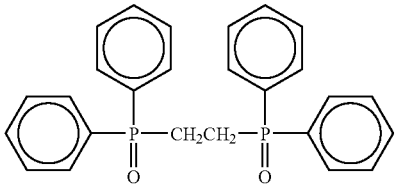

(D-12)

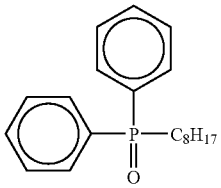

(D-13)

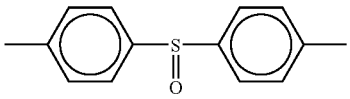

(D-14)

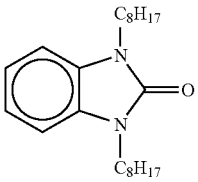

(D-15)

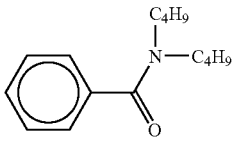

Specific examples of hydrogen bonding compounds other than those enumerated above can be found in those described in EP-A No. 1096310 and in JP-A Nos. 2002-156727 and 2002-318431.

The compound expressed by formula (D) used in the invention can be used in the photothermographic material by being incorporated into the coating solution in the form of solution, emulsion dispersion, or solid fine particle dispersion similar to the case of reducing agent, however, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill and the like.

The compound expressed by formula (D) is preferably used in the range from 1 mol % to 200 mol %, more preferably from 10 mol % to 150 mol %, and further preferably, from 20 mol % to 100 mol %, with respect to the reducing agent.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projection area of the silver halide grain (projection area of a main plane in a case of a tabular grain).

4) Grain Shape

The shape of the silver halide grain can include, for example, cubic, octahedral, tabular, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of [100] face is higher, in which the spectral sensitizing efficiency is higher in a case of adsorption of a spectral sensitizing dye. The ratio is preferably 50% or more, more preferably, 65% or more and, further preferably, 80% or more. The ratio of the Mirror's index [100] face can be determined by the method of utilizing the adsorption dependency of [111] face and [100] face upon adsorption of a sensitizing dye described by T. Tani; in J. Imaging Sci., vol. 29, page 165 (1985).

5) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is in the range from $1\times10^{-9}$ mol to $1\times10^{-3}$ mol per one mol of silver. The heavy metals, metal complexes and the addition method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per one mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion forming step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion forming step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitization method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the addition method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of photosensitivity and fogging, but it is preferably added from $10^{-6}$ mol to 1 mol, and more preferably, from $10^{-4}$ mol to $10^{-1}$ mol per one mol of silver in each case.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitization method, selenium sensitization method or tellurium sensitization method. As the compound used preferably for sulfur sensitization method, selenium sensitization method and tellurium sensitization method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitization method alone or in combination with the chalcogen sensitization described above. As the gold sensitizer, those having an pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per one mol of the silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per one mol of the silver halide. There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound that can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons. The said compound can be used in combination with various chemical sensitizers described above to increase the sensitivity of silver halide.

As the compound that can be one-electron-oxidized to provide a one-electron oxidation product which releases one or more electrons is a compound selected from the following Groups 1 to 5.

(Group 1) a compound that can be one-electron-oxidized to provide a one-electron oxidation product which further releases at least two electrons, due to being subjected to a subsequent bond cleavage reaction;

(Group 2) a compound that has at least two groups adsorptive to the silver halide and can be one-electron-oxidized to provide a one-electron oxidation product which further releases one electron, due to being subjected to a subsequent bond cleavage reaction;

(Group 3) a compound that can be one-electron-oxidized to provide a one-electron oxidation product, which further releases at least one electron after being subjected to a subsequent bond formation;

(Group 4) a compound that can be one-electron-oxidized to provide a one-electron oxidation product which further releases at least one electron after a subsequent intramolecular ring cleavage reaction; and (Group 5) a compound represented by X—Y, in which X represents a reducible group and Y represents a leaving group, and convertable by one-electron-oxidizing the reducible group to a one-electron oxidation product which can be converted into an X radical by eliminating the leaving group in a subsequent X—Y bond cleavage reaction, one electron being released from the X radical.

Each compound of Group 1 and Groups 3 to 5 preferably is a "compound having a sensitizing dye moiety" or a "compound having an adsorptive group to the silver halide". More preferred is a "compound having an adsorptive group to the silver halide". Each compound of Groups 1 to 4 more preferably is a "compound having a heterocyclic group containing nitrogen atoms substituted by two or more mercapto groups".

The compound of Groups 1 to 5 will be described in detail below.

In the compound of Group 1, the term "the bond cleavage reaction" specifically means a cleavage reaction of a bond of carbon—carbon, carbon-silicon, carbon-hydrogen, carbon-boron, carbon-tin or carbon-germanium. Cleavage of a carbon-hydrogen bond may be followed after the cleavage reaction. The compound of Group 1 can be one-electron-oxidized to be converted into the one-electron oxidation product, and thereafter can release further two or more electrons, preferably three or more electrons with the bond cleavage reaction.

The compound of Group 1 is preferably represented by any one of formulae (A), (B), (1), (2) and (3).

Formula (A)

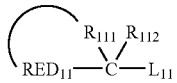

Formula (B)

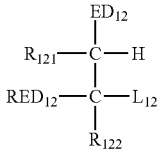

In formula (A), $RED_{11}$ represents a reducible group that can be one-electron-oxidized, and $L_{11}$ represents a leaving group. $R_{112}$ represents a hydrogen atom or a substituent. $R_{111}$ represents a nonmetallic atomic group forming a tetrahydro-, hexahydro- or octahydro-derivative of a 5- or 6-membered aromatic ring including aromatic heterocycles.

In formula (B), $RED_{12}$ represents a reducible group that can be one-electron-oxidized, and $L_{12}$ represents a leaving group. $R_{121}$ and $R_{122}$ each represent a hydrogen atom or a substituent. $ED_{12}$ represents an electron-donating group. In formula (B), $R_{121}$ and $RED_{12}$, $R_{121}$ and $R_{122}$, and $ED_{12}$ and $RED_{12}$ may bond together to form a ring structure, respectively.

In the compound represented by formula (A) or (B), the reducible group of $RED_{11}$ or $RED_{12}$ is one-electron-oxidized, and thereafter the leaving group of $L_{11}$ or $L_{12}$ is spontaneously eliminated in the bond cleavage reaction. Further two or more, preferably three or more electrons can be released with the bond cleavage reaction.

Formula (1)

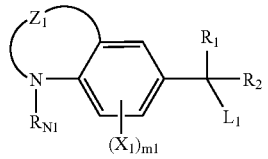

Formula (2)

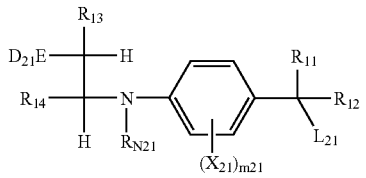

Formula (3)

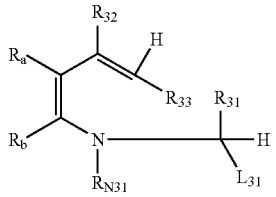

In formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent capable of substituting for a hydrogen atom on a benzene ring; $m_1$ represents an integer from 0 to 3; and $L_1$ represents a leaving group. In formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent capable of substituting for a hydrogen atom on a benzene ring; $m_{21}$ represents an integer from 0 to 3; and $L_{21}$ represents a leaving group. $R_{N21}$, $R_{13}$, $R_{14}$, $X_{21}$ and $ED_{21}$ may bond to each other to form a ring structure. In formula (3), $R_{32}$, $R_{33}$, $R_{31}$, $R_{N31}$, $R_a$ and $R_b$ each represent a hydrogen atom or a substituent; and $L_{31}$ represents a leaving group. Incidentally, $R_a$ and $R_b$ bond together to form an aromatic ring when $R_{N31}$ is not an aryl group.

After the compound is one-electron-oxidized, the leaving group of $L_1$, $L_{21}$ or $L_{31}$ is spontaneously eliminated in the bond cleavage reaction. Further two or more, preferably three or more electrons can be released with the bond cleavage reaction.

First, the compound represented by formula (A) will be described in detail below.

In formula (A), the reducible group of $RED_{11}$ can be one-electron-oxidized and can bond to after-mentioned $R_{111}$ to form the particular ring structure. Specifically, the reducible group may be a divalent group provided by removing one hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

Examples of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc. These substituents may be further substituted by these substituents.

$RED_{11}$ is preferably an alkylamino group, an arylamino group, a heterocyclic amino group, an aryl group, an aromatic heterocyclic group, or nonaromatic heterocyclic group. $RED_{11}$ is more preferably an arylamino group (particularly an anilino group), or an aryl group (particularly a phenyl group). When $RED_{11}$ has a substituent, preferred as a substituent include halogen atoms, alkyl groups, alkoxy groups, carbamoyl groups, sulfamoyl groups, acylamino groups, sulfoneamide groups. When $RED_{11}$. is an aryl group, it is preferred that the aryl group has at least one "electron-donating group". The "electron-donating group" is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group with a 5-membered monocyclic ring or a condensed-ring including at least one nitrogen atom in the ring such as an indolyl group, a pyrrolyl group, an imidazolyl group, a benzimidazolyl group, a thiazolyl group, a benzthiazolyl group and an indazolyl group; a nitrogen-containing, nonaromatic heterocyclic group that substitutes at the nitrogen atom, such as so-called cyclic amino group like pyrrolidinyl group, an indolinyl group, a piperidinyl group, a piperazinyl group and a morpholino group; etc.

The active methine group is a methine group having two "electron-attracting groups", and the "electron-attracting group" is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron-attracting groups may bond together to form a ring structure.

In formula (A), specific examples of $L_{11}$ include a carboxy group and salts thereof, silyl groups, a hydrogen atom, triarylboron anions, trialkylstannyl groups, trialkylgermyl groups and a —$CR_{C1}R_{C2}R_{C3}$ group. When $L_{11}$ represents a silyl group, the silyl group is specifically a trialkylsilyl group, an aryldialkylsilyl group, a triarylsilyl group, etc, and they may have a substituent.

When $L_{11}$ represents a salt of a carboxy group, specific examples of a counter ion to form the salt include alkaline metal ions, alkaline earth metal ions, heavy metal ions, ammonium ions, phosphonium ions, etc. Preferred as a counter ion are alkaline metal ions and ammonium ions, most preferred are alkaline metal ions such as $Li^+$, $Na^+$ and $K^+$.

When $L_{11}$ represents a —$CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent. Incidentally, when one of $R_{C1}$, $R_{C2}$ and $R_{C3}$ is a hydrogen atom or an alkyl group, there is no case where the other two of them are a hydrogen atom or an alkyl group. $R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc. Examples of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

It is also preferred that the —$CR_{C1}R_{C2}R_{C3}$ group is the same as a residue provided by removing $L_{11}$ from formula (A) as a result of selecting each of $R_{C1}$, $R_{C2}$ and $R_{C3}$ as above.

In formula (A), $L_{11}$ is preferably a carboxy group or a salt thereof, or a hydrogen atom, more preferably a carboxy group or a salt thereof.

When $L_{11}$ represents a hydrogen atom, the compound represented by formula (A) preferably has a base moiety. After the compound represented by formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate (—$COO^-$); sulfate (—$SO_3^-$); amineoxide (>$N^+(O^-)$—); and derivatives thereof. The base is preferably a conjugate base of an acid with a pKa value of approximately 1 to 8, more preferably carboxylate, sulfate or amineoxide, particularly preferably carboxylate. When these bases have an anion, the compound of formula (A) may have a counter cation. Examples of the counter cation include alkaline metal ions, alkaline earth metal ions, heavy metal ions, ammonium ions, phosphonium ions, etc. The base moiety may be at an optional position of the compound represented by formula (A). The base moiety may be connected to $RED_{11}$, $R_{111}$ or $R_{112}$ in formula (A), and to a substituent thereon.

In formula (A), $R_{112}$ represents a substituent capable of substituting a hydrogen atom or a carbon atom therewith, provided that $R_{112}$ and $L_{11}$ do not represent the same group.

$R_{112}$ preferably represents a hydrogen atom, an alkyl group, an aryl group (such as a phenyl group), an alkoxy group (such as a methoxy group, a ethoxy group, a benzyloxy group), a hydroxy group, an alkylthio group, (such as a methylthio group, a butylthio group), and amino group, an alkylamino group, an arylamino group, a heterocyclic amino group or the like; and more preferably represents a hydrogen atom, an alkyl group, an alkoxy group, a hydroxy group, a phenyl group and an alkylamino group.

Ring structures formed by $R_{111}$ in formula (A) are ring structures corresponding to a tetrahydro structure, a hexahydro structure, or an octahydro structure of a five-membered or six-membered aromatic ring (including an aromatic hetro ring), wherein a hydro structure means a ring structure in which partial hydrogenation is performed on a carbon-carbon double bond (or a carbon-nitrogen double bond) contained in an aromatic ring (an aromatic hetero ring) as a part thereof, wherein the tetrahydro structure is a structure in which 2 carbon-carbon double bonds (or carbon-nitrogen double bonds) are hydrogenated, the hexahydro structure is a structure in which 3 carbon-carbon double bonds (or carbon-nitrogen double bonds) are hydrogenated, and the octahydro structure is a structure in which 4 carbon-carbon double bonds (or carbon-nitrogen double bonds) are hydrogenated. Hydrogenation of an aromatic ring produces a partially hydrogenated non-aromatic ring structure.

Examples include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetralin ring, a tetrahydroquinoline ring, a tetrahydroisoquinoline ring, a tetrahydroquinazoline ring and a tetrahydroquinoxaline ring, a tetrahydrocarbazole ring, an octahydrophenanthridine ring and the like. The ring structures may have a substituent therein.

More preferable examples of a ring structure forming $R_{111}$ include a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring and a tetracarbazole ring. Particularly preferable examples include a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring; and most preferable examples include a pyrrolidine ring, a piperidine ring, a tetrahydropyridine ring, a tetrahydroquinoline ring and a tetrahydroisoquinoline ring.

In formula (B), $RED_{12}$ and $L_{12}$ represent groups having the respective same meanings as $RED_{11}$ and $L_{11}$ in formula (A), and have the respective same preferable ranges as $RED_{11}$ and $L_{11}$ n formula (A). $RED_{12}$ is a monovalent group except a case where $RED_{12}$ forms the following ring structure and to be concrete, there are exemplified groups each with a name of a monovalent group described as $RED_{11}$. $RED_{121}$ and $L_{122}$ represent groups having the same meaning as $R_{112}$ in formula (A), and have the same preferable range as $R_{112}$ in formula (A). $ED_{12}$ represents an electron-donating group. Each pair of $R_{121}$, and $RED_{12}$; $R_{121}$ and $R_{122}$; or $ED_{12}$ and $RED_{12}$ may form a ring structure by bonding with each other.

An electron-donating group represented by $RED_{12}$ in formula (B) is the same as an electron-donating group described as a substituent when $RED_{11}$ represents an aryl group. Preferable examples of $RED_{12}$ include a hydroxy group, an alkoxy group, a mercapto group, a sulfonamide group, an alkylamino group, an arylamino group, an active methine group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute, and a phenyl group substituted with an electron donating group described above, and more preferable examples thereof include a non-aromatic nitrogen containing heterocyclic group further substituted with a hydroxy group, a mercapto group, a sulfonamide group, an alkylamino group, an arylamino group, an active methine group, or a nitrogen atom; and a phenyl group substituted with an electron-donating group described above (for example, a p-hydroxyphenyl group, a p-dialkylaminophenyl group, an o- or p-dialkoxyphenyl group and the like).

In formula (B), $R_{121}$ and $RED_{12}$; $R_{122}$ and $R_{121}$; or $ED_{12}$ and $RED_{12}$ may bond to each other to form a ring structure. A ring structure formed here is a non-aromatic carbon ring or hetero ring in a 5- to 7-membered single ring or fused ring structure which is substituted or unsubstituted. Concrete examples of a ring structure formed from $R_{121}$ and $RED_{12}$ include, in addition to the examples of the ring structure formed by $R_{111}$ in formula (A), a pyrroline ring, an imidazoline ring, a thiazoline ring, a pyrazoline ring, an oxazoline ring, an indan ring, a morphorine ring, an indoline ring, a tetrahydro-1,4-oxazine ring, 2,3-dihydrobenzo-1,4-oxazine ring, a tetrahydro-1,4-thiazine ring, 2,3-dihydrobenzo-1,4-thiazine ring, 2,3-dihydrobenzofuran ring, 2,3-dihydrobenzothiophene ring and the like. In formation of a ring structure from $ED_{12}$ and $RED_{12}$, $ED_{12}$ is preferably an amino group, an alkylamino group or an arylamino group and concrete examples of the ring structure include a tetrahyropyrazine ring, a piperazine ring, a tetrahydroquinoxaline ring, a tetrahydroisoquinoline ring and the like. Concrete examples of a ring structure formed from $R_{122}$ and $R_{121}$ include a cyclohexane ring, a cyclopentane ring and the like.

Below, description will be given of formulae (1) to (3).

In formulae (1) to (3), $R_1$, $R_2$, $R_{11}$, $R_{12}$ and $R_{31}$ represent the same meaning as $R_{112}$ of formula (A) and have the same preferable range as $R_{112}$ of formula (A). $L_1$, $L_{21}$ and $L_{31}$ independently represents the same leaving groups as the groups shown as concrete examples in description of $L_{11}$ of formula (A) and also have the same preferable range as $L_{11}$ of formula (A). The substituents represented by $X_1$ and $X_{21}$ are the same as the examples of substituents of $RED_{11}$ of formula (A) and have the same preferable range as $RED_{11}$ of formula (A). $m_1$ and $m_2$ are preferably integers from 0 to 2 and more preferably integer of 0 or 1.

When $R_{N1}$, $R_{N21}$ and $R_{N31}$ each represent a substituent, preferred as a substituent include an alkyl group, an aryl group or a heterocyclic group, and may further have a substituent. Each of $R_{N1}$, $R_{N21}$ and $R_{N31}$ is preferably a hydrogen atom, an alkyl group or an aryl group, more preferably a hydrogen atom or an alkyl group.

When $R_{13}$, $R_{14}$, $R_{32}$, $R_{33}$, $R_a$ and $R_b$ independently represent a substituent, the substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

The 6-membered ring formed by $Z_1$ in formula (1) is a nonaromatic heterocycle condensed with the benzene ring in formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent.

In formula (2), $ED_{21}$ is the same as $ED_{12}$ in formula (B) with respect to the meanings and preferred embodiments.

In formula (2), any two of $R_{N21}$, $R_{13}$, $R_{14}$, $X_{21}$ and $ED_{21}$ may bond together to form a ring structure. The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in formula (3), $R_a$ and $R_b$ bond together to form an aromatic ring. The aromatic ring is an aryl group such as a phenyl group and a naphthyl group, or an aromatic heterocyclic group such as a pyridine ring group, a pyrrole ring group, a quinoline ring group and an indole ring group, preferably an aryl group. The aromatic ring group may have a substituent.

In formula (3), $R_a$ and $R_b$ preferably bond together to form an aromatic ring, particularly a phenyl group.

In formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-attracting group. The electron-attracting group is the same as described above, preferably an acyl group, an alkoxycarbonyl group, a carbamoyl group or a cyano group.

The compound of Group 2 will be described below.

According to the compound of Group 2, the "bond cleavage reaction" is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Group 2 has two or more, preferably 2 to 6, more preferably 2 to 4, adsorbent groups to the silver halide. The adsorptive group is further preferably a mercapto-substituted, nitrogen-containing, heterocyclic group. The adsorptive group will hereinafter be described.

The compound of Group 2 is preferably represented by the following formula (C).

Formula (C)

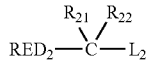

In the compound represented by formula (C), the reducible group of $RED_2$ is one-electron-oxidized, and thereafter the leaving group of $L_2$ is spontaneously eliminated, thus a C (carbon atom)-$L_2$ bond is cleaved, in the bond cleavage reaction. Further one electron can be released with the bond cleavage reaction.

In formula (C), $RED_2$ is the same as $RED_{12}$ in formula (B) with respect to the meanings and preferred embodiments. $L_2$ is the same as $L_{11}$ in formula (A) with respect to the meanings and preferred embodiments. Incidentally, when $L_2$ is a silyl group, the compound of formula (C) has two or more mercapto-substituted, nitrogen-containing, heterocyclic groups as the adsorbent groups. $R_{21}$ and $R_{22}$ each represent a hydrogen atom or a substituent, and are the same as $R_{112}$ in formula (A) with respect to the meanings and preferred embodiments. $RED_2$ and $R_{21}$ may bond together to form a ring structure.

The ring structure is a 5- to 7-membered, monocyclic or condensed, carbocyclic or heterocyclic, nonaromatic ring, and may have a substituent. Incidentally, there is no case where the ring structure corresponds to a tetrahydro-, hexahydro- or octahydro-derivative of an aromatic ring or an aromatic heterocycle. The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc. Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Group 3 will be described below.

According to the compound of Group 3, "bond formation" means that a bond of carbon-carbon, carbon-nitrogen, carbon-sulfur, carbon-oxygen, etc. is formed.

It is preferable that the one-electron oxidation product releases one or more electrons after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

To be more detailed, a one-electron oxidized product (a cation radical species or a neutral radical species generated by elimination of a proton therefrom) formed by one electron oxidizing a compound of Group 3 reacts with a reactive group described above coexisting in the same molecule to form a bond and form a radical species having a new ring structure therein. The radical species have a feature to release a second electron directly or in company with elimination of a proton therefrom. One of compounds of Group 3 has a chance to further release one or more electrons, in a ordinary case two or more electrons, after formation of a two-electron oxidized product, after receiving a hydrolysis reaction in one case or after causing a tautomerization reaction accompanying direct migration of a proton in another case. Alternatively, compounds of Group 3 also include a compound having an ability to further release one or more electron, in an ordinary case two or more electrons directly from a two-electron oxidized product, not by way of a tautomerization reaction.

The compound of Group 3 is preferably represented by the following formula (D).

$$RED_3—L_3—Y_3 \qquad \text{Formula (D)}$$

In formula (D), $RED_3$ represents a reducible group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group. $L_3$ represents a linking group that connects $RED_3$ and $Y_3$.

In formula (D), $RED_3$ has the same meanings as $RED_{12}$ in formula (B). In formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group. The term "electron-donating group" means the same as above-mentioned electron-donating group.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When $Y_3$ is an organic group containing carbon-carbon double bond (for example a vinyl group) having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group (that may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc); an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1=C_2(—OH)—$, which may be tautomerized into a moiety of $>C_1H—C_2(=O)—$. In this case, it is preferred that a substituent on the $C_1$ carbon is an electron-attracting group, and as a result, $Y_3$ has a moiety of an active methylene group or an active methine group. The electron-attracting group, which can provide such a moiety of an "active methylene group" or an "active methine group", may be the same as above-mentioned electron-attracting group on the methine group of the "active methine group".

When $Y_3$ is an organic group containing a carbon-carbon triple bond (for example a ethynyl group) having a substituent, preferred as the substituent is an alkyl group, a phenyl group, an alkoxycarbonyl group, a carbamoyl group, an electron-donating group, etc.

When $Y_3$ is an organic group containing an aromatic group, preferable as the aromatic group is an aryl group, particularly a phenyl group, having an electron-donating group as a substituent, and an indole ring group. The electron-donating group is preferably a hydroxy group, which may be protected by a silyl group; an alkoxy group; an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

The reactive group of $Y_3$ is more preferably an organic group containing a carbon-carbon double bond, an aromatic group, or a benzo-condensed, nonaromatic heterocyclic group. Furthermore preferred are an organic group containing a carbon-carbon double bond; a phenyl group having an electron-donating group as a substituent; an indole ring group; and a benzo-condensed, nonaromatic heterocyclic group having an aniline moiety. The carbon-carbon double bond more preferably has at least one electron-donating group as a substituent.

It is also preferred that the reactive group represented by $Y_3$ contains a moiety the same as the reducible group represented by $RED_3$ as a result of selecting the reactive group as above.

$L_3$ represents a linking group that connects $RED_3$ and $Y_3$, specifically a single bond, an alkylene group, an arylene group, a heterocyclic group, —O—, —S—, —$NR_N$—, —C(=O)—, —$SO_2$—, —SO—, —P(=O)—, or a combination thereof. RN represents a hydrogen atom, an alkyl group, an aryl group or a heterocyclic group. The linking group represented by $L_3$ may have a substituent. The linking group represented by $L_3$ may bond to each of $RED_3$ and $Y_3$ at an optional position such that the linking group substitutes optional one hydrogen atom of each $RED_3$ and $Y_3$. Preferred examples of $L_3$ include a single bond; alkylene groups, particularly a methylene group, an ethylene group or a propylene group; arylene groups, particularly a phenylene group; a —C(=O)— group; a —O— group; a —NH— group; —N(alkyl)- groups; and divalent linking groups of combinations thereof.

When a cation radical ($X^+$.) provided by oxidizing $RED_3$ or a radical (X.) provided by eliminating a proton therefrom reacts with the reactive group represented by $Y_3$ to form a bond, it is preferable that they form a 3 to 7-membered ring structure containing the linking group represented by $L_3$. Thus, the radical ($X^+$. or X.) and the reactive group of Y are preferably connected though 3 to 7 atoms.

Next, the compound of Group 4 will be described below.

The compound of Group 4 has a reducible group-substituted ring structure. After the reducible group is one-electron-oxidized, the compound can release further one or more electrons with a ring structure cleavage reaction. The ring cleavage reaction proceeds as follows.

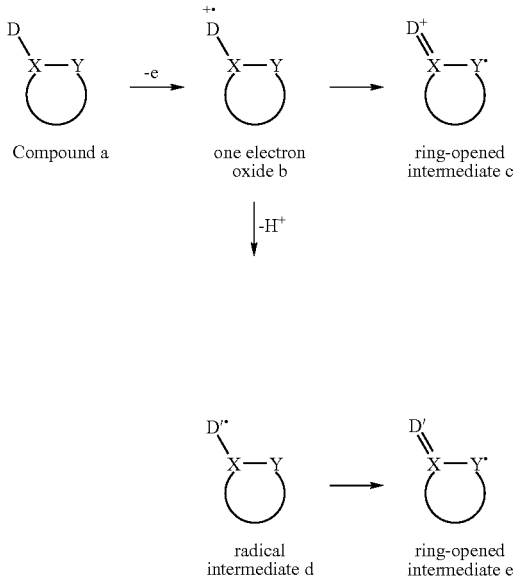

In the formula, compound a is the compound of Group 4. In compound a, D represents a reducible group, and X and Y each represent an atom forming a bond in the ring structure, which is cleaved after the one-electron oxidation. First, compound a is one-electron-oxidized to generate one-electron oxidation product b. Then, the X-Y bond is cleaved with conversion of the D-X single bond into a double bond, whereby ring-opened intermediate c is provided. Alternatively, there is a case where one-electron oxidation product b is converted into radical intermediate d with deprotonation, and ring-opened intermediate e is provided in the same manner. Subsequently, further one or more electrons are released form thus-provided ring-opened intermediate c or e.

The ring structure in the compound of Group 4 is a 3 to 7-membered, carbocyclic or heterocyclic, monocyclic or condensed, saturated or unsaturated, nonaromatic ring. The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring. More preferred are a cyclopropane ring, a cyclobutane ring, an oxirane ring, an oxetane ring and an azetidine ring, particularly preferred are a cyclopropane ring, a cyclobutane ring and an azetidine ring. The ring structure may have a substituent.

The compound of Group 4 is preferably represented by the following formulae (E) or (F).

Formula (E)

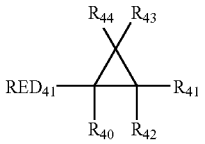

Formula (F)

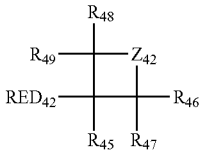

In formulae (E) and (F), $RED_{41}$ and $RED_{42}$ are the same as $RED_{12}$ in formula (B) with respect to the meanings and preferred embodiments, respectively. $R_{40}$ to $R_{44}$ and $R_{45}$ to $R_{49}$ each represent a hydrogen atom or a substituent. In formula (F), $Z_{42}$ represents —$CR_{420}R_{421}$—, —$NR_{423}$—, or —O—. $R_{420}$ and $R_{421}$ each represent a hydrogen atom or a substituent, and $R_{423}$ represents a hydrogen atom, an alkyl group, an aryl group or a heterocyclic group.

In formulae (E) and (F), each of $R_{40}$ and $R_{45}$ is preferably a hydrogen atom, an alkyl group or an aryl group, more preferably a hydrogen atom, an alkyl group or an aryl group. Each of $R_{41}$ to $R_{44}$ and $R_{46}$ to $R_{49}$ is preferably a hydrogen atom, an alkyl group, an alkenyl group, an aryl group, a heterocyclic group, an arylthio group, an alkylthio group, an acylamino group or a sulfoneamide group, more preferably a hydrogen atom, an alkyl group, an aryl group or a heterocyclic group, It is preferred that at least one of $R_{41}$ to $R_{44}$ is a donor group, and it is also preferred that both of $R_{41}$ and $R_{42}$, or both of $R_{43}$ and $R_{44}$ are an electron-attracting group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

A donor group referred to here is an "electron-donating group" or an aryl group substituted with at least one "electron-donating group." Preferable examples of donor groups include an alkylamino group, an arylamino group, a heterocyclicamino group, an electron-excessive aromatic heterocyclic group in a five-membered single ring or fused ring structure containing at least one nitrogen atom in a ring structure as part of the ring, a non-aromatic nitrogen containing hetrocyclic group having a nitrogen atom as a substitute and a phenyl group substituted with at least one electron-donating group. More preferable examples thereof include an alkylamino group, an aryamino group, an electron excessive aromatic heterocyclic group in a five-membered single ring or fused ring containing at least one nitrogen atom in a ring structure as a part (an indol ring, a pyrrole ring, a carbazole ring and the like), and a phenyl group substituted with an electron-donating group (a phenyl group substituted with three or more alkoxy groups, a phenyl group substituted with a hydroxy group, an alkylamino group, or an arylamino group and the like). Particularly preferable examples thereof include an aryamino group, an electron excessive aromatic heterocyclic group in a five-membered single ring or fused ring containing at least one nitrogen atom in a ring structure as a part (especially, a 3-indolyl group), and a phenyl group substituted with an electron-donating group (especially, a trialkoxyphenyl group and a phenyl group substituted with an alkylamino group or an arylamino group).

$Z_{42}$ is preferably —$CR_{420}R_{421}$— or —$NR_{423}$—, more preferably —$NR_{423}$—. Each of $R_{420}$ and $R_{421}$ is preferably a hydrogen atom, an alkyl group, an aryl group, a heterocyclic group, an acylamino group or a sulfoneamino group, more preferably a hydrogen atom, an alkyl group, an aryl group or a heterocyclic group. $R_{423}$ is preferably a hydrogen atom, an alkyl group, an aryl group or an aromatic heterocyclic group, more preferably a hydrogen atom, an alkyl group or an aryl group.

The substituent represented by each of $R_{40}$ to $R_{49}$, $R_{420}$, $R_{421}$ and $R_{423}$ preferably has 40 or less carbon atoms, more preferably has 30 or less carbon atoms, particularly preferably 15 or less carbon atoms. The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

In the compounds of Groups 1 to 4 used in the invention, the adsorptive group to the silver halide is such a group that is directly adsorbed on the silver halide or promotes adsorption of the compound onto the silver halide. Specifically, the adsorptive group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group. Incidentally, the adsorptive group in the compound of Group 2 is not a sulfide group.

The mercapto group or a salt thereof used as the adsorptive group may be a mercapto group or a salt thereof itself, and is more preferably a heterocyclic group, an aryl group or an alkyl group having a mercapto group or a salt thereof as a substituent. The heterocyclic group is a 5- to 7-membered, monocyclic or condensed, aromatic or nonaromatic, heterocyclic group. EXAMPLEs thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc. The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group. Examples of the aryl group include a phenyl group and a naphthyl group. Examples of the alkyl group include straight, branched or cyclic alkyl groups having 1 to 30 carbon atoms. When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorptive group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group. Examples of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. Examples of the former include a benzotriazole group, a triazole group, an indazole group, a pyrazole group, a tetrazole group, a benzimidazole group, an imidazole group, a purine group, etc. Examples of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorptive group may be any group with a —S— moiety, and preferably has a moiety of: alkyl or alkylene-S-alkyl or alkylene; aryl or arylene-S-alkyl or alkylene; or aryl or arylene-S-aryl or arylene. The sulfide group may form a ring structure, and may be a —S—S— group. Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc. Particularly preferable as the sulfide groups are groups having a moiety of alkyl or alkylene-S-alkyl or alkylene.

The cationic group used as the adsorptive group is a quaternary nitrogen-containing group, specifically a group with an ammonio group or a quaternary nitrogen-containing heterocyclic group. Incidentally, there is no case where the cationic group partly composes an atomic group forming a dye structure, such as a cyanine chromophoric group. The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc. Examples of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group. The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorptive group means a —C≡CH group, in which the hydrogen atom may be substituted.

The adsorptive group may have an optional substituent.

Specific examples of the adsorptive group further include groups described in pages 4 to 7 of a specification of JP-A No. 11-95355.

Preferred as the adsorptive group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group. Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

Among these compounds, it is particularly preferred that the compound has two or more mercapto groups as a moiety. The mercapto group (—SH) may be converted into a thione group in the case where it can be tautomerized. The compound may have two or more adsorbent groups containing above-mentioned mercapto or thione group as a moiety, such as a cyclic thioamide group, an alkylmercapto group, an arylmercapto group and a heterocyclic mercapto group. Further, the compound may have one or more adsorptive group containing two or more mercapto or thione groups as a moiety, such as a dimercapto-substituted, nitrogen-containing, heterocyclic group.

Examples of the adsorptive group containing two or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorptive group may be connected to any position of the compound represented by each of formulae (A) to (F) and (1) to (3). Preferred portions, which the adsorptive group bonds to, are $RED_{11}$, $RED_{12}$, $RED_2$ and $RED_3$ in formulae (A) to (D), $RED_{41}$, $R_{41}$, $RED_{42}$, and $R_{46}$ to $R_{48}$ in formulae (E) and (F), and optional portions other than $R_1$, $R_2$, $R_{11}$, $R_{12}$, $R_{31}$, $L_1$, $L_{21}$ and $L_{31}$ in formulae (1) to (3). Further, more preferred portions are $RED_{11}$ to $RED_{42}$ in formulae (A) to (F).

The spectral sensitizer moiety is a group containing a spectral sensitizer chromophore, a residual group provided by removing an optional hydrogen atom or substituent from a spectral sensitizer compound. The spectral sensitizer moiety may be connected to any position of the compound represented by each of formulae (A) to (F) and (1) to (3). Preferred portion, which the spectral sensitizer moiety bonds to, are $RED_{11}$, $RED_{12}$, $RED_2$ and $RED_3$ in formulae (A) to (D), $RED_{41}$, $R_{41}$, $RED_{42}$, and $R_{46}$ to $R_{48}$ in formulae (E) and (F), and optional portions other than $R_1$, $R_2$, $R_{11}$, $R_{12}$, $R_{31}$, $L_1$, $L_{21}$ and $L_{31}$ in formulae (1) to (3). Further, more preferred portions are $RED_{11}$ to $RED_{42}$ in formulae (A) to (F). The spectral sensitizer is preferably such that typically used in color sensitizing techniques. Examples thereof include cyanine dyes, composite cyanine dyes, merocyanine dyes, composite merocyanine dyes, homopolar cyanine dyes, styryl dyes, and hemicyanine dyes. Typical spectral sensitizers are disclosed in Research Disclosure, Item 36544, September 1994. The dyes can be synthesized by one skilled in the art according to procedures described in the above Research Disclosure and F. M. Hamer, *The Cyanine dyes and Related Compounds*, Interscience Publishers, New York, 1964. Further, dyes described in pages 4 to 7 of a specification of JP-A No. 11-95355 (U.S. Pat. No. 6,054,260) may be used in the invention.

The compounds of Groups 1 to 4 used in the invention has preferably 10 to 60 carbon atoms in total, more preferably 15 to 50 carbon atoms, furthermore preferably 18 to 40 carbon atoms, particularly preferably 18 to 30 carbon atoms.

When a silver halide photosensitive material using the compounds of Groups 1 to 4 is exposed, the compound is one-electron-oxidized. After the subsequent reaction, the compound is further oxidized while releasing one electron, or two or more electrons depending on Group. An oxidation potential in the first one-electron oxidation is preferably 1.4 V or less, more preferably 1.0 V or less. This oxidation potential is preferably 0 V or more, more preferably 0.3 V or more. Thus, the oxidation potential is preferably approximately 0 V to 1.4 V, more preferably approximately 0.3 V to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Groups 1 to 4 is one-electron-oxidized and release further one electron after the subsequent reaction, an oxidation potential in the subsequent oxidation is preferably −0.5 V to −2 V, more preferably −0.7 V to −2 V, furthermore preferably −0.9 V to −1.6 V.

In the case where the compound of Groups 1 to 4 is one-electron-oxidized and release further two or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Next, the compound of Group 5 will be described.

The compound of Group 5 is represented by X—Y, in which X represents a reducible group and Y represents a leaving group. The reducible group represented by X can be one-electron-oxidized to provide a one-electron oxidation product, which can be converted into an X radical by eliminating the leaving group of Y with a subsequent X—Y bond cleavage reaction. The X radical can release further one electron. The oxidation reaction of the compound of Group T5 may be represented by the following formula.

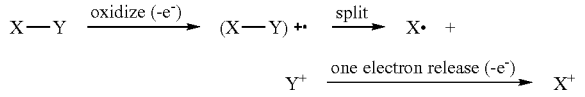

The compound of Group 5 exhibits an oxidation potential of preferably 0 V to 1.4 V, more preferably 0.3 V to 1.0 V. The radical X. generated in the formula exhibits an oxidation potential of preferably −0.7 V to −2.0 V, more preferably −0.9 V to −1.6 V.

The compound of Group 5 is preferably represented by the following formula (G).

Formula (G)

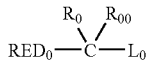

In formula (G), $RED_0$ represents a reducible group, $L_0$ represents a leaving group, and $R_0$ and $R_{00}$ each represent a hydrogen atom or a substituent. $RED_0$ and $R_0$, and $R_0$ and $R_{00}$ may be bond together to form a ring structure, respectively. $RED_0$ is the same as $RED_2$ in formula (C) with respect to the meanings and preferred embodiments. $R_0$ and $R_{00}$ are the same as $R_{21}$ and $R_{22}$ in formula (C) with respect to the meanings and preferred embodiments, respectively. Incidentally, $R_0$ and $R_{00}$ are not the same as the leaving group of $L_0$ respectively, except for a hydrogen atom. $RED_0$ and $R_0$ may bond together to form a ring structure with examples and preferred embodiments the same as those of the ring structure formed by bonding $RED_2$ and $R_{21}$ in formula (C). Examples of the ring structure formed by bonding $R_0$ and $R_{00}$ each other include a cyclopentane ring, a tetrahydrofuran ring, etc. In formula (G), $L_0$ is the same as $L_2$ in formula (C) with respect to the meanings and preferred embodiments.

The compound represented by formula (G) preferably has an adsorptive group to the silver halide or a spectrally sensitizing dye moiety. However, the compound does not have two or more adsorptive groups when $L_0$ is a group other than a silyl group. Incidentally, the compound may have two or more sulfide groups as the adsorbent groups, not depending on $L_0$.

The adsorptive group to the silver halide in the compound represented by formula (G) may be the same as those in the compounds of Groups 1 to 4, and further may be the same as all of the compounds and preferred embodiments described as "an adsorptive group to the silver halide" in pages 4 to 7 of a specification of JP-A No. 11-95355.

The spectral sensitizer moiety in the compound represented by formula (G) is the same as in the compounds of Groups 1 to 4, and may be the same as all of the compounds and preferred embodiments described as "photoabsorptive group" in pages 7 to 14 of a specification of JP-A No. 11-95355.

Specific examples of the compounds of Groups 1 to 5 used in the invention are illustrated below without intention of restricting the scope of the invention.

1
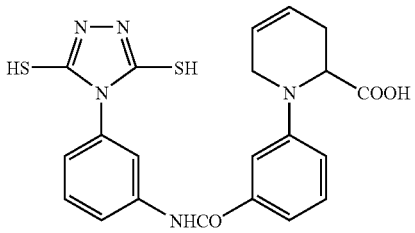
2
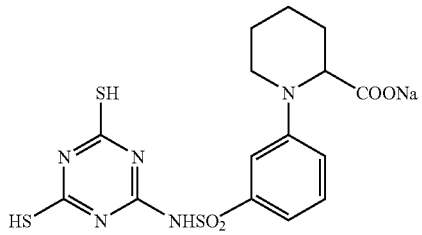
3
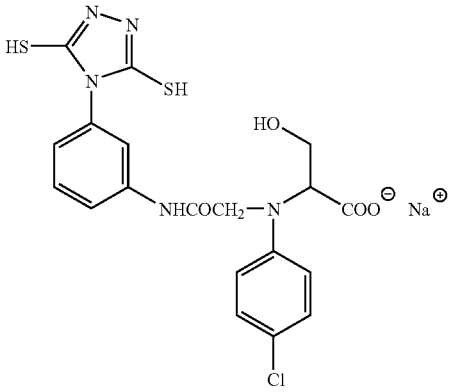
4
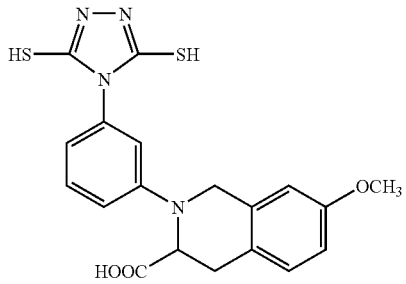
5
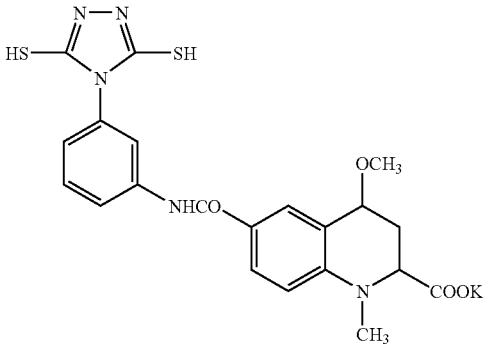
6
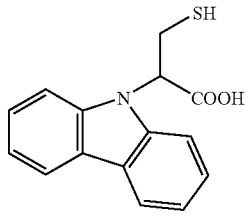
7
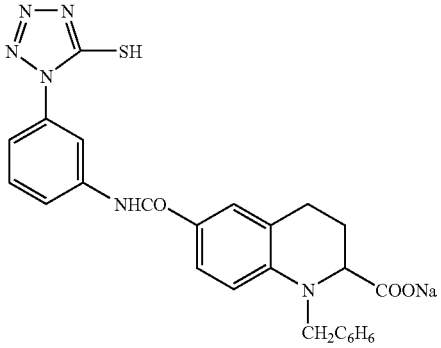
8
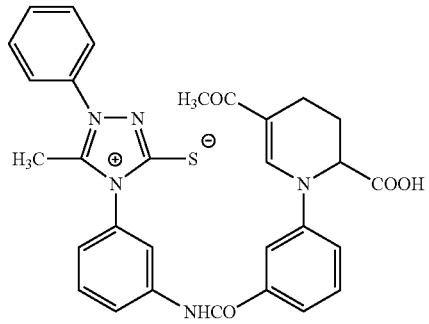
9
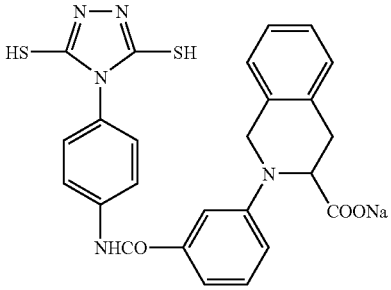
10
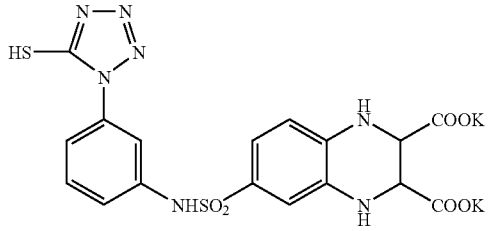

-continued
11
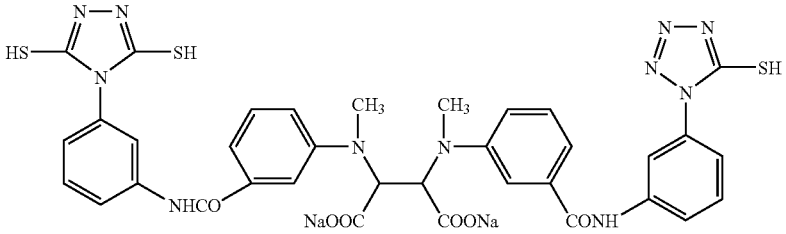
12
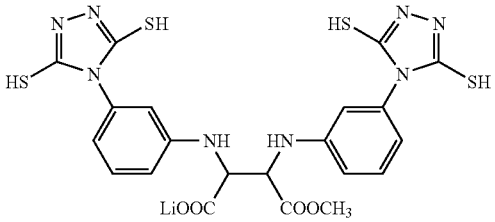
13
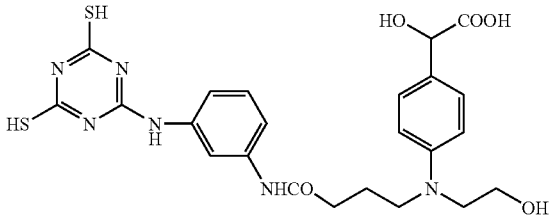
14
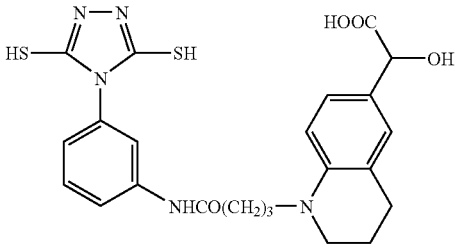
15
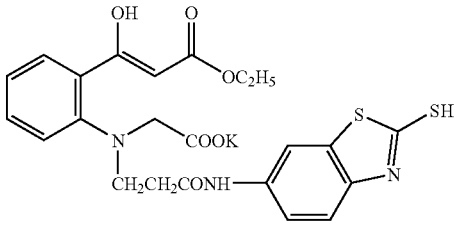
16
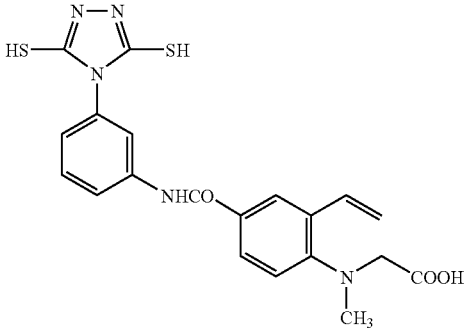
17
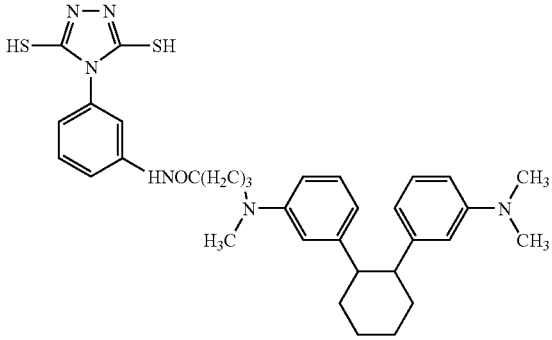
18
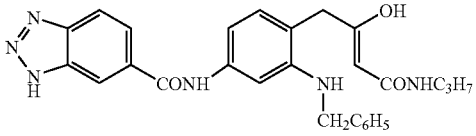
19
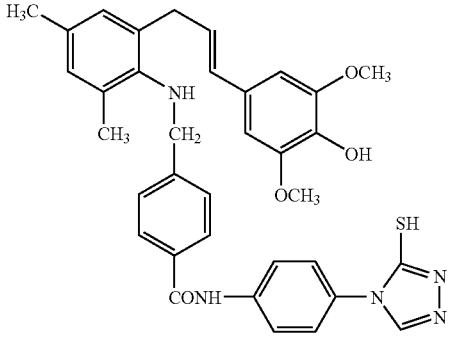

-continued
20
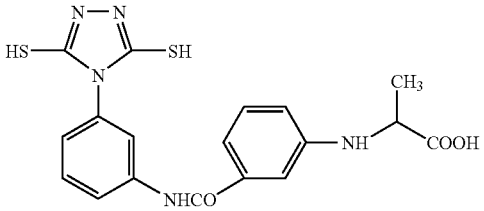
21
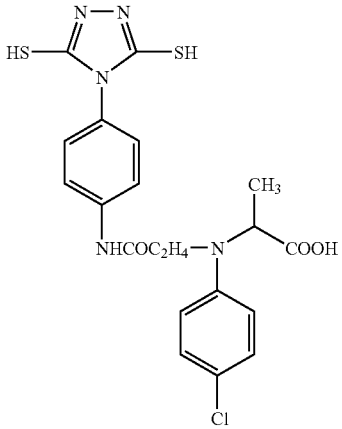
22
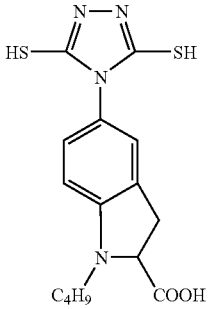
23
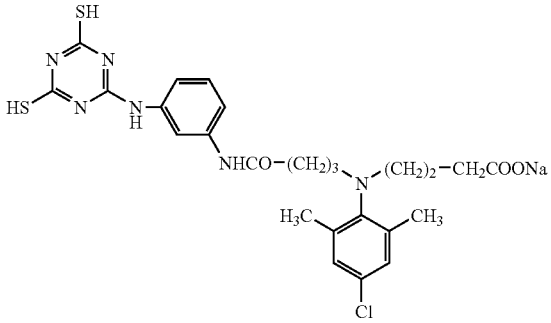
24
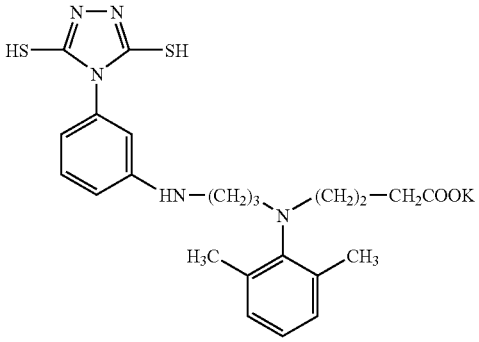
25
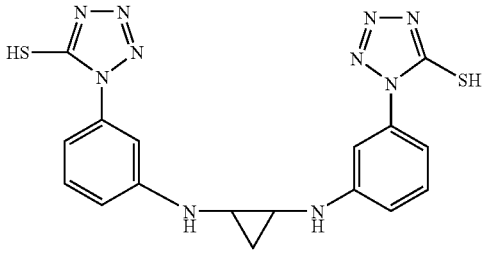
26
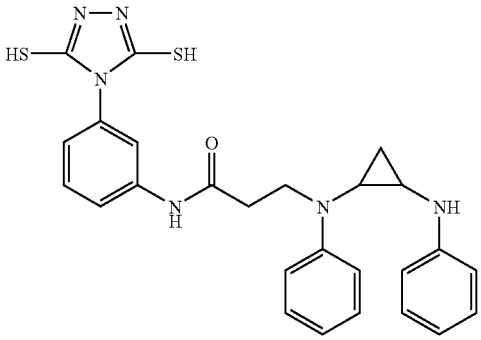
27
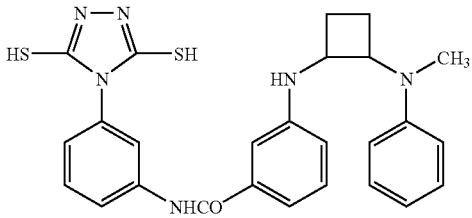

-continued
28
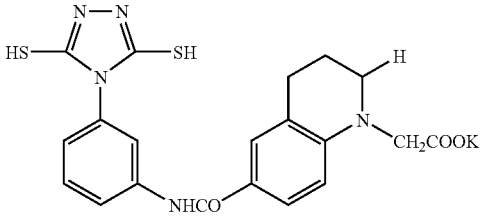
29
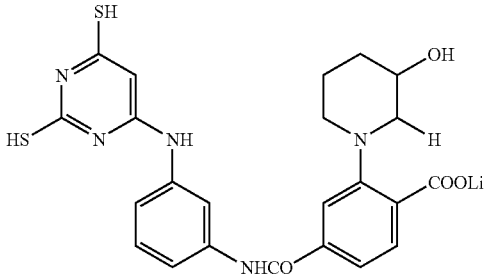
30
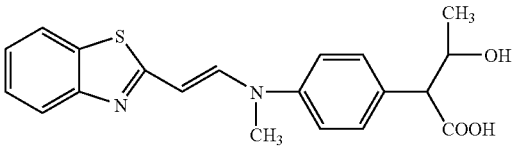
31
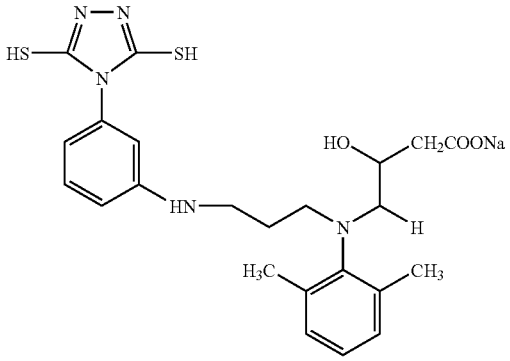
32
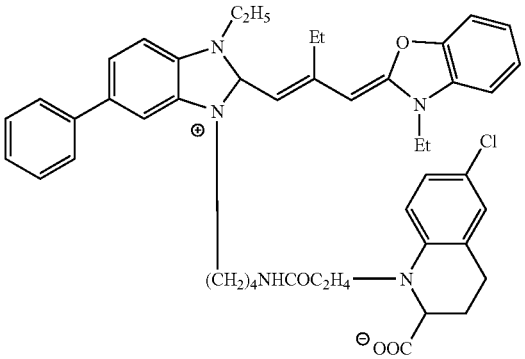
33
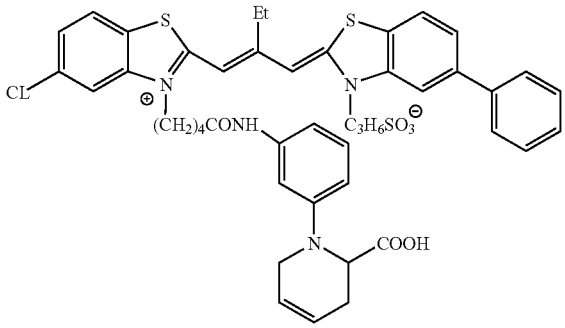
34
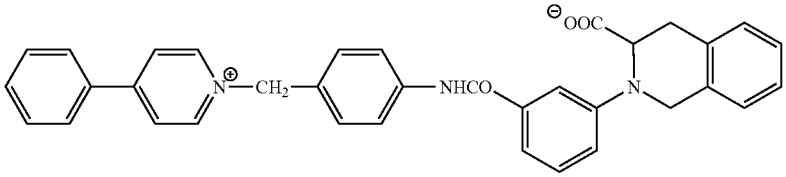
35
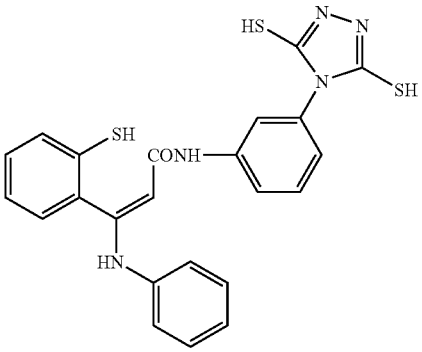
G-1
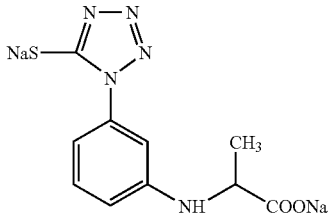

-continued

G-2

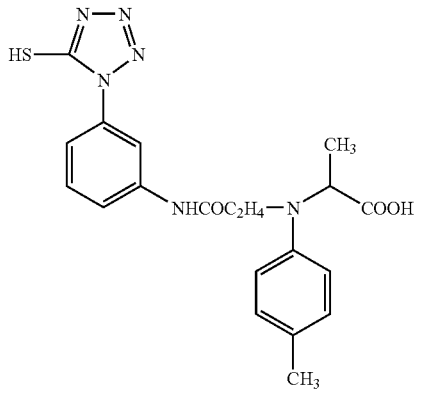

G-3

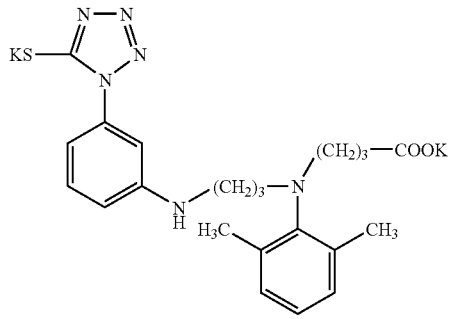

G-4

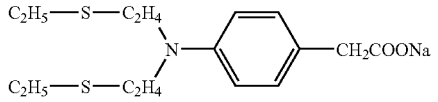

G-5

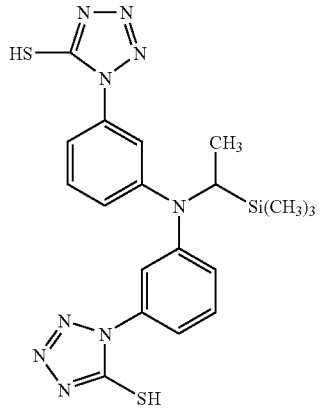

The compounds of Groups 1 to 4 used in the invention are the same as compounds described in detail in JP-A Nos. 2003-114487, 2003-114486, 2003-140287, 2003-75950 and 2003-114488, respectively. The specific examples of the compounds of Groups 1 to 4 used in the invention further include compound examples disclosed in the specifications. Synthesis examples of the compounds of Groups 1 to 4 used in the invention may be the same as described in the specifications.

Specific examples of the compound of Group 5 further include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc.

The compounds of Groups 1 to 5 may be used at any time during preparation of the photosensitive silver halide emulsion and production of the photothermographic material. For example, the compound may be used, in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 to 5 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 to 5 used in the invention is preferably added to the image forming layer comprising the photosensitive silver halide and the non-photosensitive organic silver salt. The compound may be added to the surface protective layer, or the intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer, preferably in an amount of $1\times10^{-9}$ mol to $5\times10^{-1}$ mol, and more preferably $1\times10^{-8}$ mol to $5\times10^{-2}$ mol, per one mol of the silver halide.

10) Combined Use of a Plurality of Silver Halides

The photosensitive silver halide emulsion in the photothermographic material used in the invention may be used alone, or two or more kinds of them (for example, those of different average grain sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

11) Coating Amount

The addition amount of the photosensitive silver halide, when expressed by the coating amount of silver per one $m^2$ of the photothermographic material, is preferably from 0.03 $g/m^2$ to 0.6 $g/m^2$, more preferably, 0.05 $g/m^2$ to 0.4 $g/m^2$ and, further preferably, 0.07 $g/m^2$ to 0.3 $g/m^2$. The photosensitive silver halide is used by 0.01 mol to 0.5 mol, preferably, 0.02 mol to 0.3 mol, and further preferably 0.03 mol to 0.2 mol per one mol of the organic silver salt.

12) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

13) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by Kouji Takahashi (Nikkankougyou shinbunsya, 1989).

(Binder)

Any type of polymer may be used as the binder for the layer containing organic silver salt in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly (vinyl alcohol), hydroxyethyl cellulose, cellulose acetate, cellulose acetate butyrate, poly (vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly (vinyl acetal)(e.g., poly(vinyl formal) and poly(vinyl butyral)), poly(ester), poly(urethane), phenoxy resin, poly (vinylidene chloride), poly(epoxide), poly(carbonate), poly (vinyl acetate), poly(olefin), cellulose esters, and poly(amide). A binder may be used with water, an organic solvent or emulsion to form a coating solution.

In the invention, the glass transition temperature (Tg) of the binder of the layer including organic silver salts is preferably from 0° C. to 80° C., more preferably, from 10° C. to 70° C., and further preferably, from 15° C. to 60° C.

In the specification, Tg is similar to that described in the description of back surface protective layer.

The polymer used for the binder maybe of two or more kinds of polymers, if necessary. And, the polymer having Tg 20° C. or more and the polymer having Tg less than 20° C. can be used in combination. In a case where two types or more of polymers differing in Tg may be blended for use, it is preferred that the weight-average Tg is in the range mentioned above.

In the invention, it is preferred that the layer containing organic silver salt is formed by first applying a coating solution containing 30% by weight or more of water in the solvent and by then drying.

In the case the layer containing organic silver salt is formed by first applying a coating solution containing 30% by weight or more of water in the solvent and by then drying, and furthermore, in the case the binder of the layer containing organic silver salt is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparation method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60%

$$RH=[(W1-W0)/W0]\times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, and such in which polymer molecules are dispersed in molecular states or by forming micelles, but preferred are latex-dispersed particles. The average particle size of the dispersed particles is in the range from 1 nm to 50,000 nm, preferably 5 nm to 1,000 nm, more preferably 10 nm to 500 nm, and further preferably 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

<Examples of Latex>

Specific examples of preferred polymer latex are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

PP-1; Latex of -MMA(70) -EA(27) -MAA(3) - (molecular weight 37000, Tg 61° C.)

PP-2; Latex of -MMA(70) -2EHA(20) -St(5) -AA(5) - (molecular weight 40000, Tg 59 ° C.)

PP-3; Latex of -St(50) -Bu(47) -MAA(3) - (crosslinking, Tg −17° C.)

PP-4; Latex of -St(68) -Bu(29) -AA(3) - (crosslinking, Tg 17° C.)

PP-5; Latex of -St(71) -Bu(26) -AA(3) - (crosslinking, Tg 24° C.)

PP-6; Latex of -St(70) -Bu(27) -IA(3) - (crosslinking)

PP-7; Latex of -St(75) -Bu(24) -AA(1) - (crosslinking, Tg 29° C.)

PP-8; Latex of -St(60) -Bu(35) -DVB(3) -MAA(2) - (crosslinking)

PP-9; Latex of -St(70) -Bu(25) -DVB(2) -AA(3) - (crosslinking)

PP-10; Latex of -VC(50) -MMA(20) -EA(20) -AN(5) - AA(5) - (molecular weight 80000)

PP-11; Latex of -VDC(85) -MMA(5) -EA(5) -MAA(5) - (molecular weight 67000)

PP-12; Latex of -Et(90) -MAA(10) - (molecular weight 12000)

PP-13; Latex of -St(70) -2EHA(27 -AA(3) - (molecular weight 130000, Tg 43° C.)

PP-14; Latex of -MMA(63) -EA(35) -AA(2) - (molecular weight 33000, Tg 47° C.)

PP-15; Latex of -St(70.5) -Bu(26.5) -AA(3) - (crosslinking, Tg 23° C.)

PP-16; Latex of -St(69.5) -Bu(27.5) -AA(3) - (crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two types or more depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in the range from 40:60 to 95:5. Further, the monomer unit of styrene and that of butadiene preferably account for 60% by weight to 99% by weight with respect to the copolymer. Moreover, the polymer latex of the invention contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is similar to that described above.

As the latex of styrene-butadiene copolymer preferably used in the invention, there can be mentioned PP-3 to PP-8 and PP-15, or commercially available LACSTAR-3307B, 7132C, Nipol Lx416, and the like.

In the layer containing organic silver salt of the photothermographic material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the layer containing organic silver salt.

According to the invention, the layer containing organic silver salt (image forming layer) is preferably formed by using polymer latex for the binder. According to the amount of the binder for the layer containing organic silver salt, the weight ratio for total binder to organic silver salt (total binder/organic silver salt) is preferably in the range of 1/10 to 10/1, more preferably 1/3 to 5/1, and further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in the range from 400 to 5, more preferably, from 200 to 10.

The total amount of binder in the image forming layer of the invention is preferably in the range from 0.2 g/m$^2$ to 30 g/m$^2$, more preferably from 1 g/m$^2$ to 15 g/m$^2$, and further preferably from 2 g/m$^2$ to 10 g/m$^2$. As for the image forming layer of the invention, there may be added a crosslinking agent for crosslinking, or a surfactant and the like to improve coating properties.

<Preferable Solvent for Coating Solution>

In the invention, a solvent of a coating solution for a layer containing organic silver salt (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Organic polyhalogen compounds preferably used in the invention are specifically described below. In the invention, preferred polyhalogen compounds are the compounds expressed by formula (H) below:

$$Q\text{-}(Y)_N\text{—}C(Z_1)(Z_2)X \qquad \text{Formula (H)}$$

In formula (H), Q represents an alkyl group, an aryl group, or a heterocyclic group; Y represents a divalent connecting group; N represents 0 or 1; $Z_1$ and $Z_2$ represent a halogen atom; and X represents hydrogen atom or an electron-attracting group.

In formula (H), Q is preferably an aryl group, or a heterocyclic group.

In formula (H), in the case where Q is a heterocyclic group, Q is preferably a nitrogen containing heterocyclic group having 1 or 2 nitrogen atoms and particularly preferably 2-pyridyl group and 2-quinolyl group.

In formula (H), in the case where Q is an aryl group, Q preferably is a phenyl group substituted by an electron-attracting group whose Hammett substitution coefficient up yields a positive value. For the details of Hammett substitution coefficient, reference can be made to Journal of Medicinal Chemistry, vol. 16, No. 11 (1973), pp. 1207 to 1216, and the like. As such electron-attracting groups, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl or heterocyclic sulfonyl group (for example, methanesulfonyl (σp value: 0.72)), an aliphatic aryl or heterocyclic acyl group (for example, acetyl (σp value: 0.50) and benzoyl (σp value: 0.43)), an alkinyl (e.g., C≡CH (σp value: 0.23)), an aliphatic aryl or heterocyclic oxycarbonyl group (e.g., methoxycarbonyl (σp value: 0.45) and phenoxycarbonyl (σp value: 0.44)), a carbamoyl group (σp value: 0.36), sulfamoyl group (σp value: 0.57), sulfoxido group, heterocyclic group, and phosphoryl group. Preferred range of the σp value is from 0.2 to 2.0, and more preferably, from 0.4 to 1.0. Preferred as the electron-attracting groups are carbamoyl group, an alkoxycarbonyl group, an alkylsulfonyl group, and an alkylphosphoryl group, and particularly preferred among them is carbamoyl group.

X preferably is an electron-attracting group, more preferably, a halogen atom, an aliphatic aryl or heterocyclic sulfonyl group, an aliphatic aryl or heterocyclic acyl group, an aliphatic aryl or heterocyclic oxycarbonyl group, carbamoyl group, or sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. N represents 0 or 1, and preferred is 1.

Specific examples of the compound expressed by formula (H) of the invention are shown below.

(H-1)

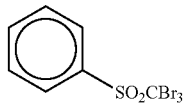

(H-2)

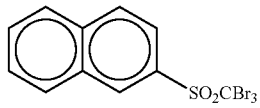

-continued (H-3)

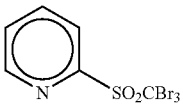

(H-4)

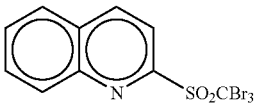

(H-5)

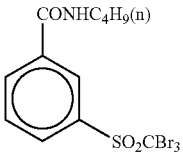

(H-6)

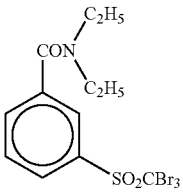

(H-7)

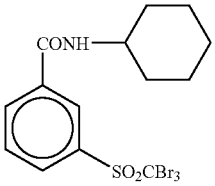

(H-8)

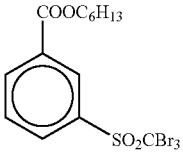

(H-9)

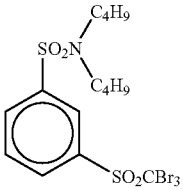

(H-10)

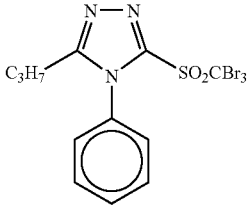

(H-11)

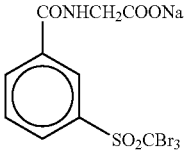

-continued (H-12)

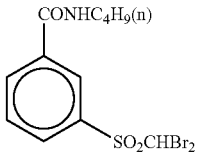

(H-13)

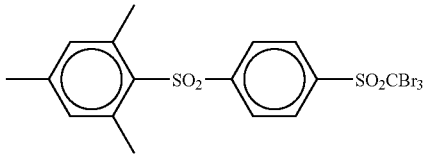

(H-14)

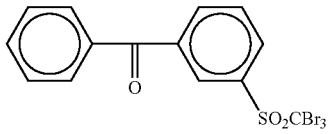

(H-15)

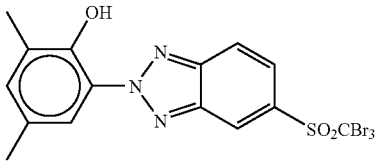

As preferred organic polyhalogen compounds of the invention other than those above, there can be mentioned compounds disclosed in JP-A Nos. 2001-31644, 2001-56526, and 2001-209145.

The compounds expressed by formula (H) of the invention are preferably used in an amount from $10^{-4}$ mol to 1 mol, more preferably, $10^{-3}$ mol to 0.5 mol, and further preferably, $1\times10^{-2}$ mol to 0.2 mol, per one mol of non-photosensitive silver salt incorporated in the image forming layer.

In the invention, usable methods for incorporating the antifoggant into the photothermographic material are those described above in the method for incorporating the reducing agent, and similarly, for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photothermographic material, but as the addition layer, preferred is to select a layer on the side having thereon the image forming layer, and more preferred is to select a layer containing organic silver salt. The azolium salt may be added at any time of the process of preparing the coating solution; in the case where the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like. In the invention, the azolium salt may be added at any amount, but preferably, it is added in a range from $1\times10^{-6}$ mol to 2 mol, and more preferably, from $1\times10^{-3}$ mol to 0.5 mol per one mol of silver.

(Other Additives)

1) Mercapto Compounds, Disulfides and Thiones

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP No. 0803764A1. Among them, mercapto-substituted heterocyclic aromatic compound, which is described in JP-A Nos. 9-297367, 9-304875, 2001-100358, 2002-303954, 2002-303951 and the like, is particularly preferred.

2) Toner

In the photothermographic material of the present invention, the addition of a toner is preferred. The description of the toner can be found in JP-A No.10-62899 (paragraph Nos. 0054 to 0055), EP-A No.0803764A1 (page21, lines 23 to 48), JP-A Nos. 2000-356317. Preferred are phthalazinones (phthalazinone, phthalazinone derivatives and metal salts thereof, e.g.,4-(1-naphthyl)phthalazinone, 6-chlorophthalazinone, 5,7-dimethoxyphthalazinone and 2,3-dihydro-1,4-phthalazinedione); combinations of phthalazinones and phthalic acids(e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving image tone, preventing the generation of interference fringes and preventing irradiation on laser exposure, various types of dyes and pigments (for instance, C.I. Pigment Blue 60, C.I. Pigment Blue 64, and C.I. Pigment Blue 15:6) may be used in the image forming layer of the invention. Detailed description can be found in WO No. 98/36322, JP-A Nos. 10-268465 and 11-338098, and the like.

5) Ultra-High Contrast Promoting Agent

In order to form ultra-high contrast image suitable for use in graphic arts, it is preferred to add an ultra-high contrast promoting agent into the image forming layer. Details on the ultra-high contrast promoting agents, method of their addition and addition amount can be found in paragraph No. 0118, paragraph Nos. 0136 to 0193 of JP-A No. 11-223898, as compounds expressed by formulae (H), (1) to (3), (A), and (B) in JP-A No. 2000-284399; as an ultra-high contrast accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, preferably, 1 mmol or less per one mol of silver.

In the case of using an ultra-high contrast promoting agent in the photothermographic material of the invention, it is preferred to use an acid resulting from hydration of diphosphorus pentaoxide, or its salt in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The amount of usage of the acid obtained by hydration of diphoshorus pentaoxide or the salt thereof (i.e., the coating amount per 1 $m^2$ of the photothermographic material) may be set as desired depending on sensitivity and fogging, but preferred is an amount of 0.1 $mg/m^2$ to 500 $mg/m^2$, and more preferably, of 0.5 $mg/m^2$ to 100 $mg/m^2$.

The reducing agent, the hydrogen bonding compound, the development accelerator, and the organic polyhalogen compounds according to the invention are preferably used as solid dispersions, and the method of preparing the solid dispersion is described in JP-A No. 2002-55405.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

1-5. Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2001-348546.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The coating amount of polyvinyl alcohol (per 1 $m^2$ of support) in the protective layer (per one layer) is preferably in the range from 0.3 $g/m^2$ to 4.0 $g/m^2$, and more preferably, from 0.3 $g/m^2$ to 2.0 $g/m^2$.

The coating amount of total binder (including water-soluble polymer and latex polymer) (per 1 $m^2$ of support) in the surface protective layer (per one layer) is preferably in the range from 0.3 $g/m^2$ to 5.0 $g/m^2$, and more preferably, from 0.3 $g/m^2$ to 2.0 $g/m^2$.

1-6. Constitution of other Layers and Components

The photothermographic material according to the invention may have an intermediate layer provided among plural image forming layers, an undercoat layer provided between the image forming layer and the support, or the like in addition to the layer described above. These layers can comprise additives, such as a matting agent, a latex, a surfactant, and the like.

(Matting Agent)

A matting agent may be preferably added to the photothermographic material of the invention in order to improve transportability. Description on the matting agent can be found in paragraphs Nos. 0126 to 0127 of JP-A No.11-65021. The addition amount of the matting agent is preferably in the range from 1 $mg/m^2$ to 400 $mg/m^2$, more preferably, from 5 $mg/m^2$ to 300 $mg/m^2$, with respect to the coating amount per one $m^2$ of the photothermographic material.

There is no particular restriction on the shape of the matting agent usable in the invention and it may fixed form or non-fixed form. Preferred is to use those having fixed form and globular shape. Average particle size is preferably in the range from 0.5 μm to 10 μm, more preferably, from 1.0 μm to 8.0 μm, and most preferably, from 2.0 μm to 6.0 μm. Furthermore, the particle distribution of the matting agent is preferably set as such that the variation coefficient may become 50% or lower, more preferably, 40% or lower, and most preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean diameters is more than 3.

The matness on the image forming layer surface is not restricted as far as star-dust trouble occurs, but the matness of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in the range of 1200 seconds or less and 10 seconds or more; more preferably, 800 seconds or less and 20 seconds or more; and further preferably, 500 seconds or less and 40 seconds or more, as expressed by Beck smoothness.

In the invention, the matting agent is incorporated preferably in the outermost surface layer of the photothermographic material, a layer functioning as the outermost surface layer, or a layer near to the outer surface. And, the matting agent is preferably incorporated in a layer that functions as the so-called protective layer.

(Surface pH-Adjusting Agent)

The surface pH of the photothermographic material according to the invention preferably yields a pH of 7.0 or lower, more preferably, 6.6 or lower, before thermal developing process. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

(Surfactant)

As the surfactant for use in the invention, the solvent, the support, antistatic agent or the electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably. For the photothermographic material in the invention, the fluorocarbon surfactants described in JP-A Nos. 2002-82411 and 2003-57780 are preferably used. Especially, the usage of the fluorocarbon surfactants described in JP-A No. 2003-57780 in an aqueous coating solution is preferred viewed from the standpoint of capacity in static control, stability of the coating side state and sliding facility.

According to the invention, the fluorocarbon surfactant can be used on either side of the image forming layer side or the back layer side, but is preferred to use on both sides. Further, it is particularly preferred to use in combination with electrically conductive layer including aforementioned metal oxides. In this case the amount of the fluorocarbon surfactant on the side of the electrically conductive layer can be reduced or removed.

The amount of the fluorocarbon surfactant used is preferably in the range from 0.1 $mg/m^2$ to 100 $mg/m^2$, more preferably 0.3 $mg/m^2$ to 30 $mg/m^2$ and, further preferably 1 $mg/m^2$ to 10 $mg/m^2$, on each side of the image forming layer and the back layer.

Particularly in the present invention, it is preferred that the photothermographic material contains a fluorocarbon compound having a fluoroalkyl group which has two or more carbon atoms and 13 or less fluorine atoms.

The fluorocarbon compound in the present invention can have any structure, as far as it has a fluoroalkyl group described above (after now, fluorine substituted alkyl group is called as 'Rf'). And the fluorocarbon compound may have at least one or more Rf, and can have two or more Rf.

As specific examples of Rf, the following compounds can be described, but Rf is not limited thereto.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2H_4$—$C_3F_7$ group, —$C_2H_4$—$C_5F_{11}$ group, —$C_4H_8$—CF $(CF_3)_2$ group, —$CH_2CF_3$ group, —$C_4H_8$—$CH(C_2F_5)$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group, —$CH_2$—$C_6F_{13}$ group, —$C_2H_4$—$C_6F_{13}$ group, —$C_4H_8$—$C_6F_{13}$ group, —$C_6H_{12}$—$C_6F_{13}$ group, and —$C_8H_{16}$—$C_6F_{13}$ group.

Rf has 13 or less fluorine atoms, preferably 12 or less fluorine atoms, more preferably 3 to 11 fluorine atoms, and further preferably 5 to 9 fluorine atoms. And Rf has two or more carbon atoms, preferably 4 to 16 carbon atoms, and more preferably 5 to 12 carbon atoms.

The structure of Rf is not particularly limited as for as Rf has two or more carbon atoms and 13 or less fluorine atoms, however, the group represented by the following formula (A) is preferred.

-Rc-Re—W Formula (A)

The florocarbon compound of the invention has more preferably two or more fluoroalkly groups represented by formula (A).

In formula (A), Rc represents an alkylene group having 1 to 4 carbon atoms, preferably 1 to 3 carbon atoms, more preferably 1 to 2 carbon atoms. An alkylene group represented by Rc may be a linear or a branched chain.

Re represents a perfluoroalkylene group having 2 to 6 carbon atoms, and preferably a perfluoroalkylene group having 2 to 4 carbon atoms. Herein, the perfluoroalkylene group means an alkylene group where all hydrogen atoms of an alkylene group are replaced by fluorine atoms. The perfluoroalkylene group described above may be a linear or a branched chain, or a cyclic structure.

W represents a hydrogen atom, a fluorine atom and an alkyl group, preferably a hydrogen atom and a fluorine atom, and most preferably a fluorine atom.

The fluorocarbon compound in the present invention can have a cationic hydrophilic group.

The cationic hydrophilic group means the group which becomes an anion when it is dissolved in water. As specific examples, tertiary ammonium, alkyl pyridium, alkyl imidazolium, primary to thirdly aliphatic amines and the like are described.

As a cation, an organic cationic substituent is preferably and an organic cationic group containing a nitrogen atom or a phosphorous atom is more preferred. And a pyridinium cation or an ammonium cation is further more preferred.

A salt forming anion may be any of an inorganic anion or an organic anion. As an inorganic anion, iodide ion, bromide ion, chloride ion and the like are described. As an organic anion, p-toluenesulfonic acid ion, p-toluenesulfonate ion, benzenesulfonate ion, methanesulfonate ion, trifluoromethanesulfoate ion and the like are described.

In the present invention, the preferred cationic fluorocarbon compound is represented by the following formula (1).

Formula (1)

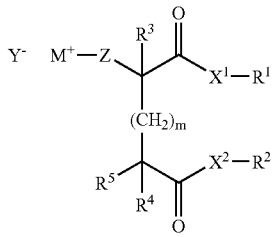

In formula (1), $R^1$ and $R^2$ each represent a substituted or a non-substituted alkyl group, however, at least one of $R^1$ and $R^2$ is a fluoroalkyl group (Rf) described above. It is preferred that both of $R^1$ and $R^2$ are Rf. $R^3$ $R^4$ and $R^5$ each independently represent a hydrogen atom or a substituent. $X^1$, $X^2$ and Z each independently represent a divalent linking group or a single bond, and $M^+$ represents a cationic substituent. $Y^-$ represents a counter anion, however, when the charge results in 0 in a molecule, $Y^-$ is not necessary. m represents 0 or 1.

In formula (1) described above, when $R^1$ and $R^2$ each represents a substituted or a non-substituted alkyl group except Rf, above alkyl group has one or more carbon atoms and may be any of a linear, a branched or a cyclic structure. Above substituent can include, a halogen atom except fluorine, an alkenyl group, an aryl group, an alkoxyl group, a carboxylate group, a carbonamide group, a carbamoyl group, an oxycarbonyl group, a phosphate group and the like.

In the case where $R^1$ and $R^2$ each represents an alkyl group except Rf, namely an alkyl group not substituted by fluorine atom, the alkyl group is a substituted or a non-substituted alkyl group having 1 to 24 carbon atoms, more preferably a substituted or a non-substituted alkyl group having 6 to 24 carbon atoms. As preferable examples of a non-substituted alkyl group having 6 to 24 carbon atoms, a n-hexyl group, a n-heptyl group, a n-octyl group, a tert-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, a octadecyl group, a eicosyl group, a 2-octyldodecyl group, a docosyl group, a tetracosyl group, a 2-decyltetradecyl group, a tricosyl group, a cyclohexyl group, a cycloheptyl group and the like are described. And as preferable examples of substituted alkyl group having 6 to 24 total carbon atoms, a 2-hexenyl group, a oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group, a 2-(diphenyl phosphate)ethyl group and the like are described.

As the alkyl group, except Rf, represented by $R^1$ and $R^2$, a substituted or a non-substituted alkyl group having 6 to 18 carbon atoms is more preferred. As preferable examples of non-substituted alkyl group having 6 to 18 carbon atoms, a n-hexyl group, cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, hexadecyl group, a 2-hexyldecyl group, an octadecyl group, a 4-tert-butylcyclohexyl group and the like are described. And as preferable examples of subsutituted alkyl group having 6 to 18 total carbon atoms, a phenethyl group, a 6-phenoxyhexyl group, a 12-phenyldodecyl group, an oleyl group, a linoleyl group, a linolenyl group and the like are described.

As the alkyl group, except Rf, represented by $R^1$ and $R^2$, a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an oleyl group, a linoleyl group and a linolenyl group is especially preferred. The non-substituted linear, cyclic or branched alkyl group having 8 to 16 carbon atoms is most preferred.

In formula (1) described above, $R^3$, $R^4$ and $R^5$ each independently represents a hydrogen atom and a substituent. As the examples of said substituent, an alkyl group (preferably an alkyl group having 1 to 20 carbon atoms, more preferably an alkyl group having 1 to 12 carbon atoms, especially preferably an alkyl group having 1 to 8 carbon atoms, e.g., a methyl group, an ethyl group, an isopropyl group, a tert-butyl group, a n-octyl group, a n-decyl group, a n-hexadecyl group, a cyclopropyl group, a cyclopentyl group, a cyclohexyl group and the like are described.), an alkenyl group (preferably an alkenyl group having 2 to 20 carbon atoms, more preferably an alkenyl group having 2 to 12 carbon atoms, especially preferably an alkenyl group having 2 to 8 carbon atoms, e.g., a vinyl group, an allyl group, a 2-butenyl group, a 3-pentenyl group and the like are described.), an alkyl group (preferably an alkyl group having 2 to 20 carbon atoms, more preferably an alkyl group having 2 to 12 carbon atoms, especially preferably an alkyl group having 2 to 8 carbon atoms, e.g., an propagyl group, 3-pentynyl group and the like are described.), an aryl group (preferably an aryl group having 6 to 30 carbon atoms, more preferably an aryl group having 6 to 20 carbon atoms, especially preferably an aryl group having 6 to 12 carbon atoms, e.g., a phenyl group, a p-methylphenyl group, a naphthyl group and the like are described.), a substituted or a non-substituted amino group (preferably an amino group having 0 to 20 carbon atoms, more preferably an amino group having 0 to 10 carbon atoms, especially preferably an amino group having 0 to 6 carbon atoms, e.g., a non-substituted amino group, a methyl amino group, a dimethylamino group, a diethylamino group, a dibenzylamino group and the like are described.), an alkoxy group (preferably an alkoxy group having 1 to 20 carbon atoms, more preferably an alkoxy group having 1 to 12 carbon atoms, especially preferably an alkoxy group having 1 to 8 carbon atoms, e.g., a methoxy group, an ethoxy group, a butoxy group and the like are described.), an aryloxy group (preferably an aryloxy group having 6 to 20 carbon atoms, more preferably an aryloxy group having 6 to 16 carbon atoms, especially preferably an aryloxy group having 6 to 12 carbon atoms, e.g., a phenoxy group, a 2-naphthyloxy group and the like are described.), an acyl group (preferably an acyl group having 1 to 20 carbon atoms, more preferably an acyl group having 1 to 16 carbon atoms, especially preferably an acyl group having 1 to 12 carbon atoms, e.g., an acetyl group, a benzoyl group, a formyl group, a pivaloyl group and the like are described.), an alkoxycarbonyl group (preferably an alkoxycarbonyl group having 2 to 20 carbon atoms, more preferably an alkoxycarbonyl group having 2 to 16 carbon atoms, especially preferably an alkoxycarbonyl group having 2 to 12 carbon atoms, e.g., a methoxycarbonyl group, an ethoxycarbonyl group and the like are described.), an aryloxycarbonyl group (preferably an aryloxycarbonyl group having 7 to 20 carbon atoms, more preferably an aryloxycarbonyl group having 7 to 16 carbon atoms, especially preferably an aryloxycarbonyl group having 7 to 10 carbon atoms, e.g., a phenyloxycarbonyl group and the like are described.), an acyloxy group (preferably an acyloxy group having 2 to 20 carbon atoms, more preferably an acyloxy group having 2 to 16 carbon atoms, especially preferably an acyloxy group having 2 to 10 carbon atoms, e.g., an acetoxy group, a benzoyloxy group and the like are described.), an acylamino group (preferably an acylamino group having 2 to 20 carbon atoms, more preferably an acylamino group having 2 to 16 carbon atoms, especially preferably an acylamino group having 2 to 10 carbon atoms, e.g., an acetylamino group, a benzoylamino group and the like are described.), an alkoxycarbonylamino group (preferably an alkoxycarbonylamino group having 2 to 20 carbon atoms, more preferably an alkoxycarbonylamino group having 2 to 16 carbon atoms, especially preferably an alkoxycarbonylamino group having 2 to 12 carbon atoms, e.g., a methoxycarbonylamino group and the like are described.), an aryloxycarbonylamino group (preferably an aryloxycarbonylamino group having 7 to 20 carbon atoms, more preferably an aryloxycarbonylamino group having 7 to 16 carbon atoms, especially preferably an aryloxycarbonylamino group having 7 to 12 carbon atoms, e.g., a phenyloxycarbonylamino group and the like are described.), a sulfonylamino group (preferably a sulfonylamino group having 1 to 20 carbon atoms, more preferably a sulfonylamino group having 1 to 16 carbon atoms, especially preferably a sulfonylamino group having 1 to 12 carbon atoms, e.g., a methanesulfonylamino group, a benzenesulfonylamino group, and the like are described.), a sulfamoyl group (preferably a sulfamoyl group having 0 to 20 carbon atoms, more preferably a sulfamoyl group having 0 to 16 carbon atoms, especially preferably a sulfamoyl group having 0 to 12 carbon atoms, e.g., a sulfamoyl group, a methylsulfamoyl group, a dimethylsulfamoyl group, a phenylsulfamoyl group and the like are described.), a carbamoyl group (preferably a carbamoyl group having 1 to 20 carbon atoms, more preferably a carbamoyl group having 1 to 16 carbon atoms, especially preferably a carbamoyl group having 1 to 12 carbon atoms, e.g., a non-substituted carbamoyl group, a methylcarbamoyl group, a diethylcarbamoyl group, a phenylcarbamoyl group and the like are described.), an alkylthio group (preferably an alkylthio group having 1 to 20 carbon atoms, more preferably an alkylthio group having 1 to 16 carbon atoms, especially preferably an alkylthio group having 1 to 12 carbon atoms, e.g., a methylthio group, an ethylthio group and the like are described.), an arylthio group (preferably an arylthio group having 6 to 20 carbon atoms, more preferably an arylthio group having 6 to 16 carbon atoms, especially preferably an arylthio group having 6 to 12 carbon atoms, e.g., a phenylthio group and the like are described.), a sulfonyl group (preferably a sulfonyl group having 1 to 20 carbon atoms, more preferably a sulfonyl group having 1 to 16 carbon atoms, especially preferably a sulfonyl group having 1 to 12 carbon atoms, e.g., a mesyl group, a tosyl group and the like are described.), a sulfinyl group (preferably a sulfinyl group having 1 to 20 carbon atoms, more preferably a sulfinyl group having 1 to 16 carbon atoms, especially preferably a sulfinyl group having 1 to 12 carbon atoms, e.g., a methanesulfinyl group, a benzenesulfinyl group and the like are described.), an ureido group (preferably an ureido group having 1 to 20 carbon atoms, more preferably an ureido group having 1 to 16 carbon atoms, especially preferably an ureido group having 1 to 12 carbon atoms, e.g., a non-substituted ureido group, a methylureido group, a phenylureido group and the like are described.), a phosphonamido group (preferably a phosphonamido group having 1 to 20 carbon atoms, more preferably a phosphonamido group having 1 to 16 carbon atoms, especially preferably a phosphonamido group having 1 to 12 carbon atoms, e.g., a diethylphosphonamido group, a phenylphosphonamido and the like are described.), a hydroxy group, a mercapto group, a halogen atom (e.g., fluorine atom, chlorine atom, bromine atom and iodine atom), a cyano group, a sulfo group, a carboxyl group, a nitro group, a hydroxamic acid group, a sulfino group, a hydrazino group, an imino group, a heterocyclic group (preferably a heterocyclic group having 1 to 30 carbon atoms, more preferably a heterocyclic group having 1 to 12 carbon atoms, e.g., a heterocyclic group having a hetero atom such as nitrogen atom, oxygen atom, sulfur atom and the like, e.g., an imidazolyl group, a pyridyl group, a quinolyl group, a furyl group, a piperidyl group, a morpholino group, a benzoxazolyl group, a benzimidazolyl group, a benzthiazolyl group and the like are described.), a silyl group (preferably a silyl group having 3 to 40 carbon atoms, more preferably a silyl group having 3 to 30 carbon atoms, especially preferably a silyl group having 3 to 24 carbon atoms, e.g., a trimethlysilyl group, a triphenylsilyl group and the like are described.) and the like are described. These substituents may be further substitiuted. And in the case where two or more subsutituents are there, each may be the same or different. And if possible, these may combine each other to form a ring.

As $R^3$, $R^4$ and $R^5$, an alkyl group and a hydrogen atom are preferred and a hydrogen atom is more preferred.

In formula (1) described above, $X^1$ and $X^2$ each represents a divalent linking group or a single bond. There is no limitation regarding the divalent linking group described above, but an allylene group, —O—, —S— or —$NR^{31}$— ($R^{31}$ represents a hydrogen atom or a substituent and this substituent is the same as the examples which $R^3$, $R^4$ and $R^5$ each represents, and as $R^{31}$, an alkyl group, Rf described above or a hydrogen atom is preferred and a hydrogen atom is more preferred) or the group obtained by those combinations is preferred and —O—, —S— or —$NR^{31}$— is more preferred. As $X^1$ and $X^2$, —O— or —$NR^{31}$— is more preferred and —O— is especially preferred.

In formula (1) described above, Z represents a divalent linking group or a single bond. There is no limitation regarding the divalent linking group described above, but an alkylene, an allylene group, —C(=O)—, —O—, —S—, —S(=O)—, —$S(=O)_2$— or —$NR^{32}$— ($R^{32}$ represents a hydrogen atom or a substituent and this substituent is the same as the examples which $R^3$, $R^4$ and $R^5$ each represents, and as $R^{32}$, an alkyl group, or a hydrogen atom is preferred and a hydrogen atom is more preferred) or the group obtained by those combinations is preferred. An alkylene having 1 to 12 carbon atoms, an allylene group having 6 to 12 carbon atoms, —C(=O)—, —O—, —S—, —S(=O)—, —$S(=O)_2$— or —$NR^{32}$—, or the group obtained by those combinations is more preferred. And as Z, an alkylene group having 1 to 8 carbon atoms, —C(=O)—, —O—, —S—, —S(=O)—, —$S(=O)_2$— or —$NR^{32}$— or the group obtained by those combinations is still more preferred. Examples are described below.

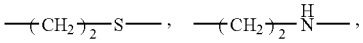

-continued

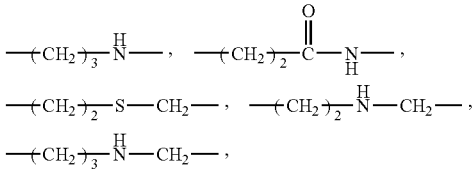

In formula (1) described above, $M^+$ represents a cationic subsutituent. As $M^+$, an organic cationic substituent is preferred and an organic cationic substituent having a nitrogen atom or a phosphor atom is more preferred. Further more, a pyridinium cation or an ammonium cation is preferred and a trialkyl ammonium cation represented by the following formula (2) is more preferred.

Formula (2)

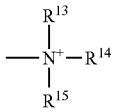

In formula (2), $R^{13}$, $R^{14}$ and $R^{15}$ each independently represent a substituted or a non-substituted alkyl group. As the said substituent, the subsutituents as a substituent of $R^4$ and $R^5$ described above can be applied. And when it is possible, $R^{13}$, $R^{14}$ and $R^{15}$ can form a ring by binding each other. As $R^{13}$, $R^{14}$ and $R^{15}$, an alkyl group having 1 to 12 carbon atoms is preferred and an alkyl group having 1 to 6 carbon atoms is more preferred and methyl group, ethyl group and methylcarboxyl group are still more preferred and methyl group is especially preferred.

In formula (2), $Y^-$ represents a counter anion and may be an inorganic anion or an organic anion. And when the charge results in 0 in a molecule, $Y^-$ is not necessary. As preferable inorganic anion, iodine ion, bromine ion, chloride ion and the like are described and as preferable organic anion, p-toluenesulfonate ion, benzenesulfonate ion, methanesulfonate ion, trifluoromethanesulfoate ion and the like are described. As $Y^-$, iodine ion, p-toluenesulfonate ion and benzenesulfonate ion are preferred and p-toluenesulfonic acid is more preferred.

In formula (2) described above, m represents 0 or 1 and 0 is preferred.

Among the compounds represented by formula (1), the compound represented by formula (1-a) is preferred.

Formula (1-a)

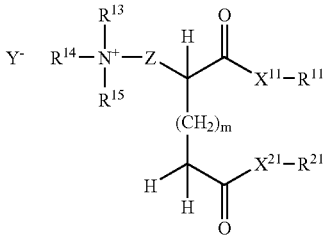

In the formula, $R^{11}$ and $R^{21}$ each independently represent a substituted or a non-substituted alkyl group, but at least one of $R^1$ and $R^2$ represents Rf described above and $R^{11}$ and $R^{21}$ have 19 or less carbon atoms in total. $R^{13}$, $R^{14}$ and $R^{15}$ each independently represent a substituted or a non-substituted alkyl group and can form a ring by binding each other. $X^{11}$ and $X^{21}$ each independently represent —O—, —S— or —$NR^{31}$—, $R^{31}$ represents a hydrogen atom or a substituent, and z represents a divalent linking group or a single bond. $Y^-$ represents a counter anion, however, when the charge results in 0 in a molecule, $Y^-$ is not necessary.

m represents 0 or 1. In the formula, Z and $Y^-$ are the same as those in formula (1) and the preferred ranges are also similar to those in formula (1). $R^{13}$, $R^{14}$, $R^{15}$ and m are the same as those in formula (1) and the preferred range are also similar to those in formula (1).

In the formula, $X^{11}$ and $X^{12}$ each represent —O—, —S— or —$NR^{31}$— ($R^{31}$ represents a hydrogen atom or a substituent and as the said substituent, the substituent described as that of $R^3$, $R^4$ and $R^5$ can be applied and as $R^{31}$, an alkyl group, Rf described above or a hydrogen atom is preferred and a hydrogen atom is more preferred). As $X^{11}$ and $X^{21}$, —O— and —NH— are more preferable and —O— is further preferable.

In the formula described above, $R^{11}$ and $R^{21}$ are the same as $R^1$ and $R^2$ in formula (1) and the preferred range is also similar to that in formula (1). However, $R^{11}$ and $R^{21}$ have 19 or less carbon atoms in total, and m is 0 or 1.

Specific example of the compound represented by the above formula (1) can be described, but the present invention is not limited by following specific examples. In the following structure donations of compounds, unless otherwise indicated, an alkyl group and a perfluoroalkyl group mean a linear structure. Also, in the structure donations, 2EH means 2-ethylhexyl.

FS-1

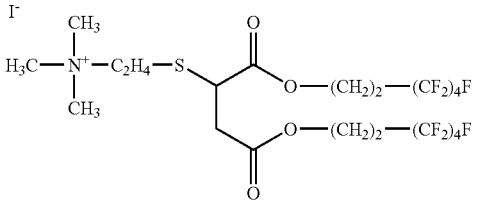

FS-2

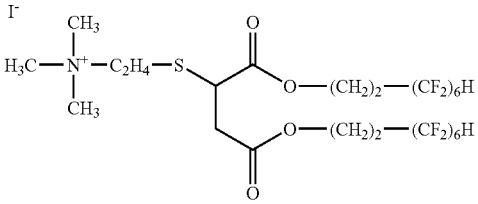

FS-3

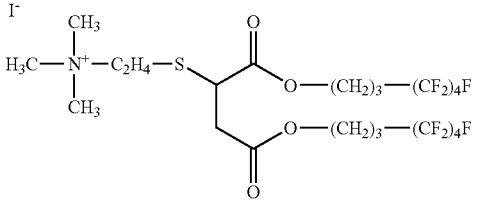

FS-4

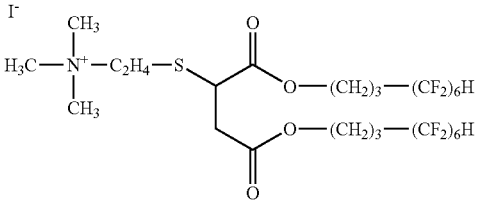

FS-5

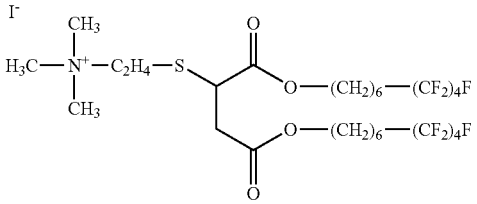

FS-6

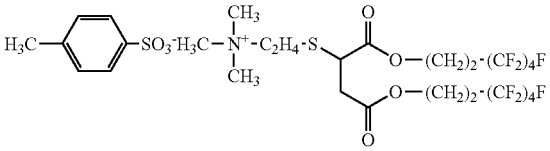

FS-7

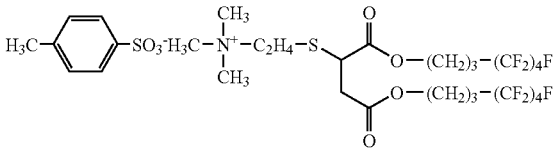

FS-8

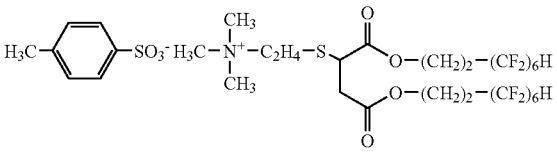

FS-9

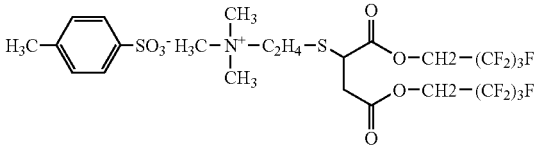

FS-10

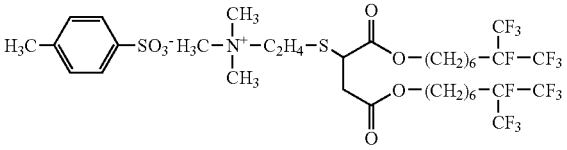

-continued
FS-11
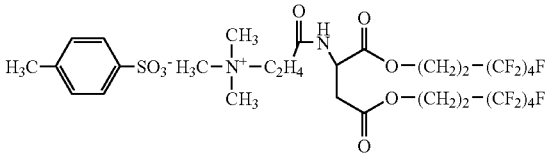
FS-12
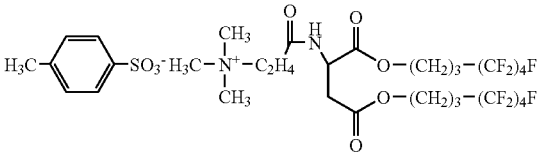
FS-13
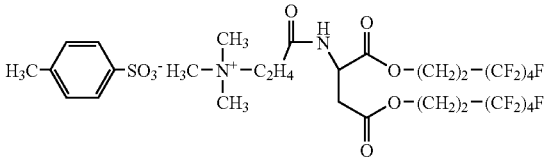
FS-14
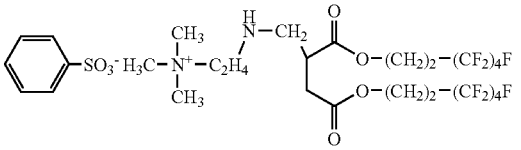
FS-15
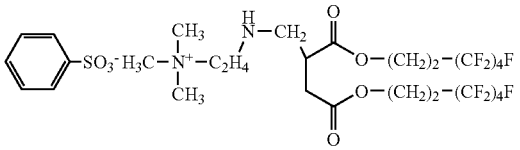
FS-16
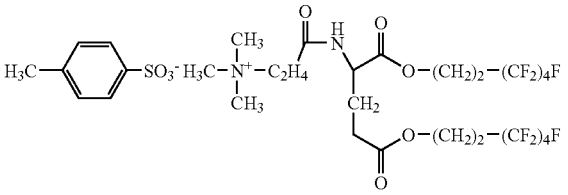
FS-17
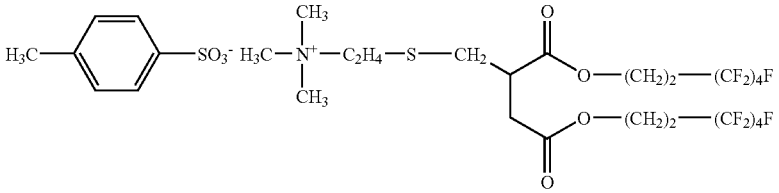
FS-18
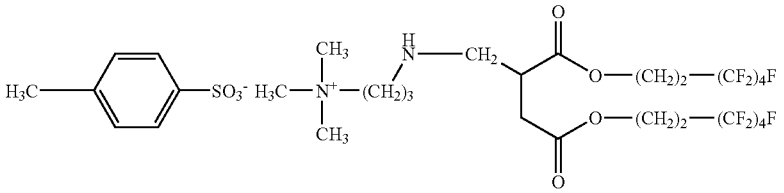
FS-19
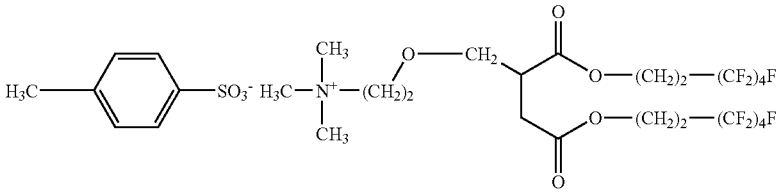
FS-20
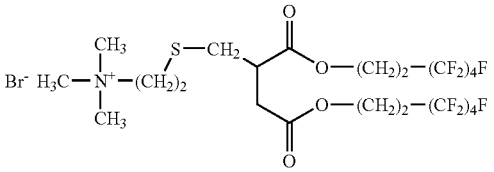
FS-21
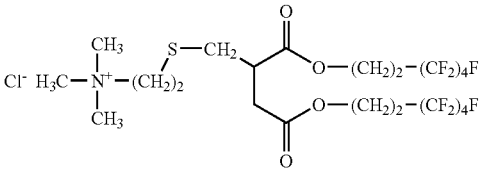
FS-22
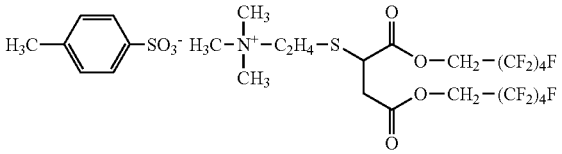
FS-23
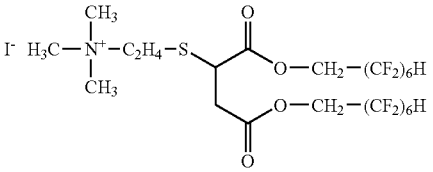

-continued
FS-24
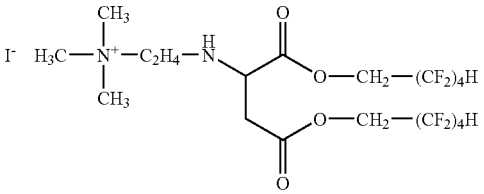
FS-25
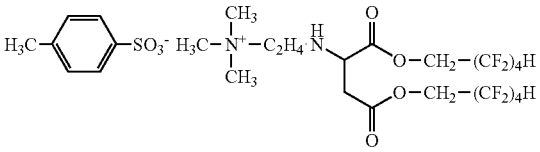
FS-26
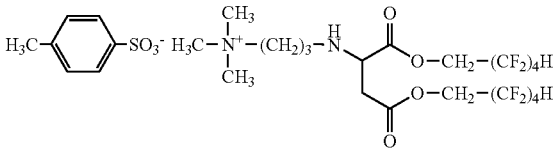
FS-27
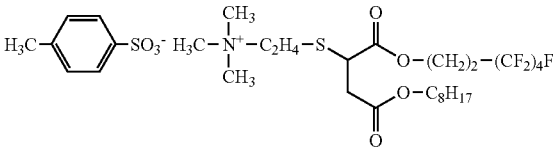
FS-28
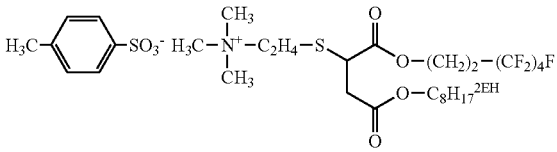
FS-29
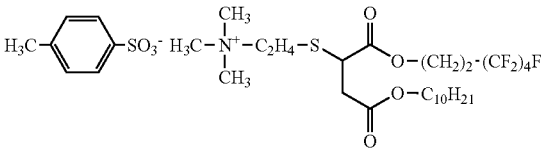
FS-30
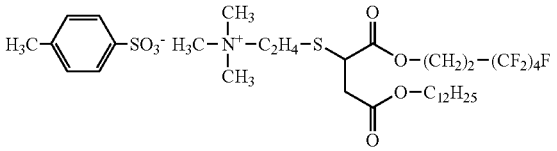
FS-31
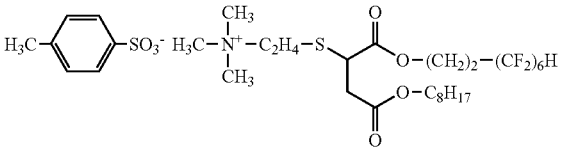
FS-32
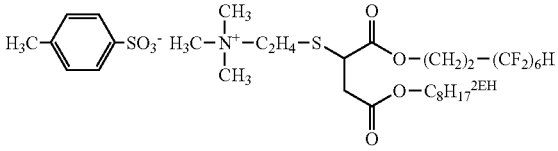
FS-33
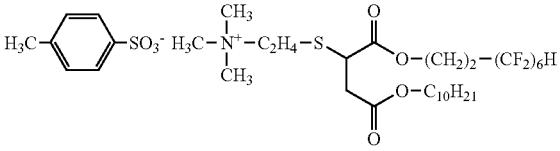
FS-34
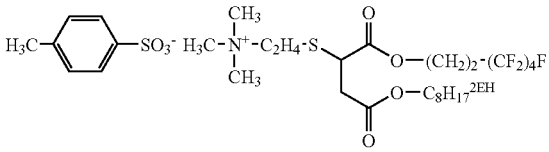
FS-35
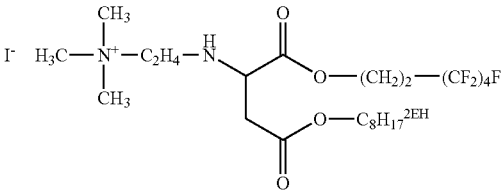
FS-36
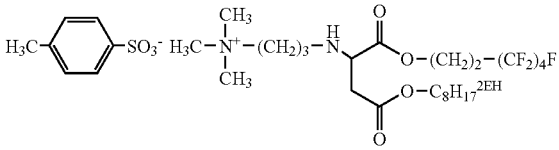
FS-37
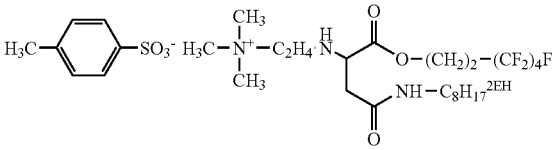
FS-38
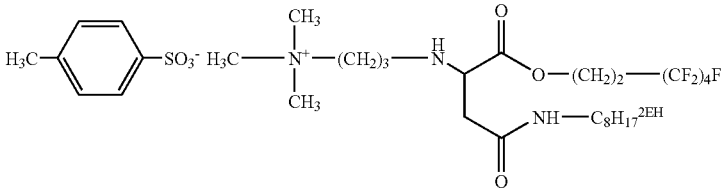

-continued
FS-40
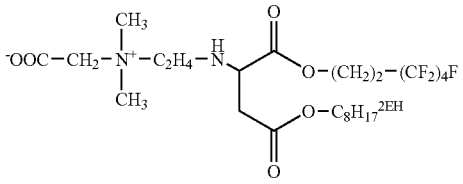
FS-41
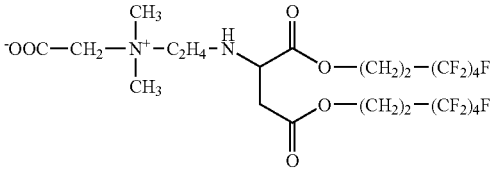
FS-42
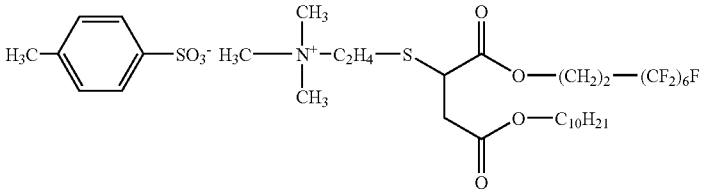
FS-43
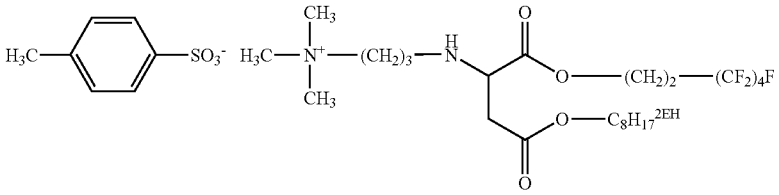
FS-44
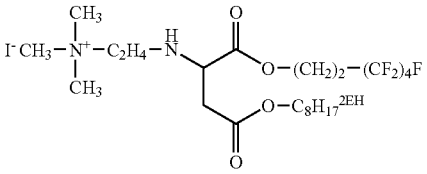
FS-45
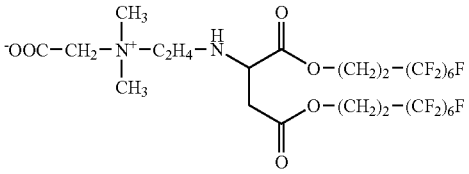
FS-46
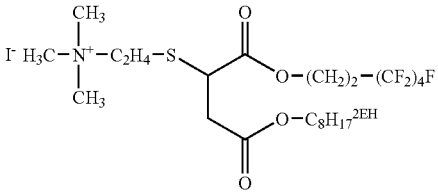
FS-47
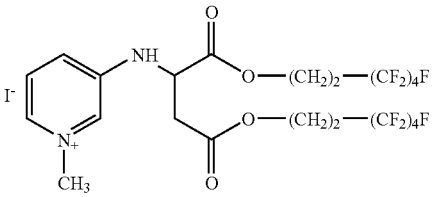
FS-47
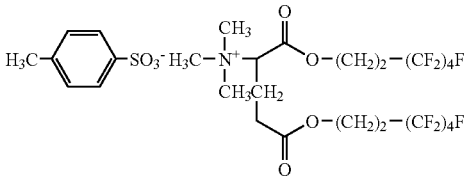
FS-48
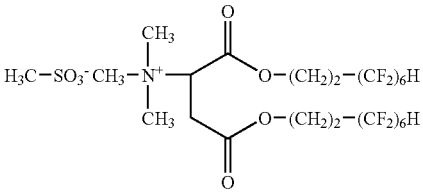
FS-49
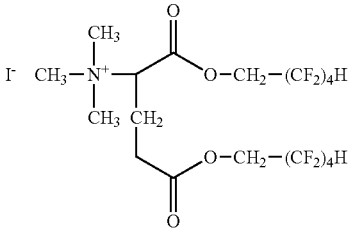
FS-50
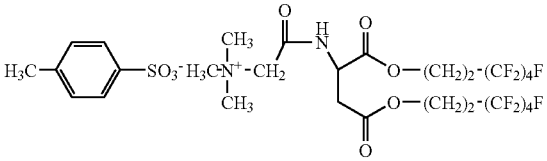

-continued
FS-51
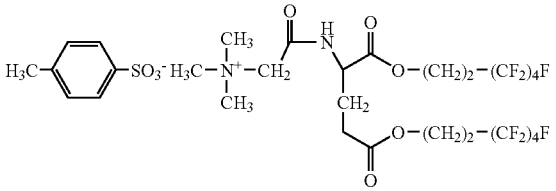
FS-52
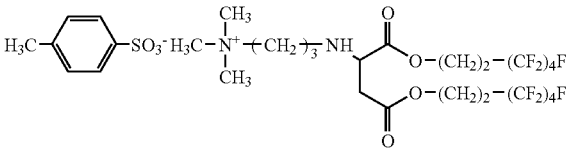
FS-53
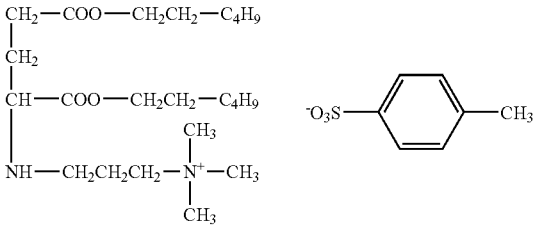
FS-54
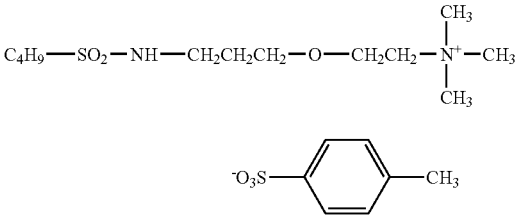
FS-55
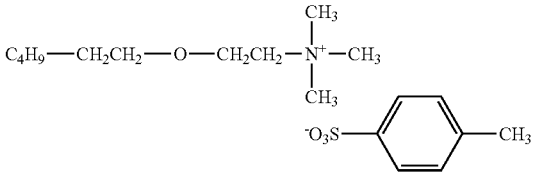
FS-56
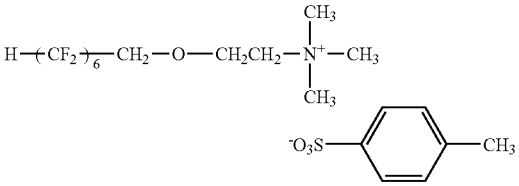
FS-57
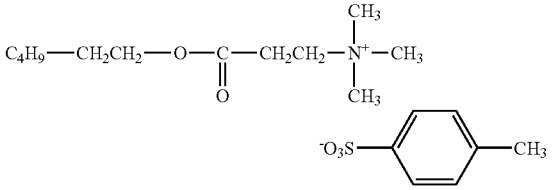
FS-58
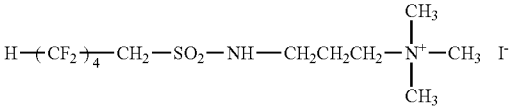
FS-59
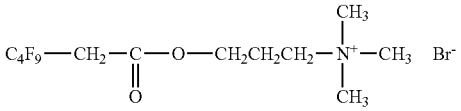
FS-60
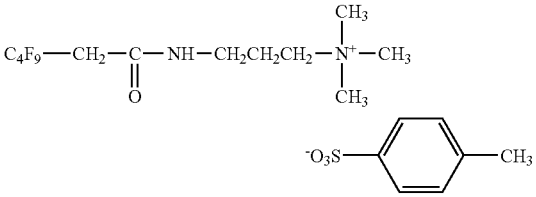
FS-61
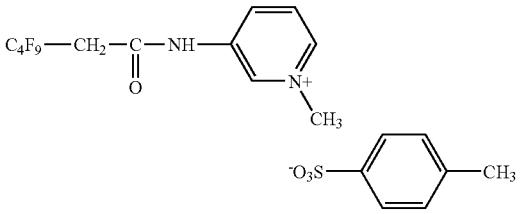
FS-62
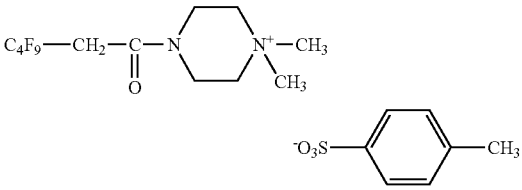
FS-63
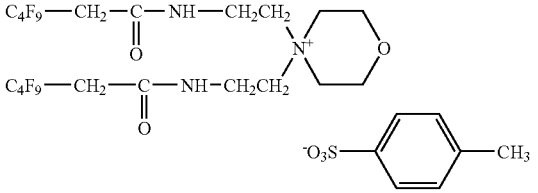
FS-64
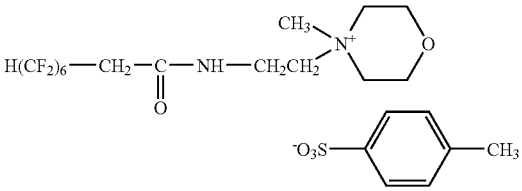

-continued

FS-65

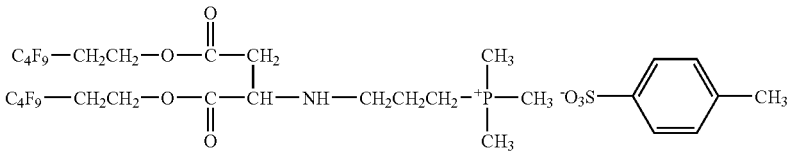

FS-66

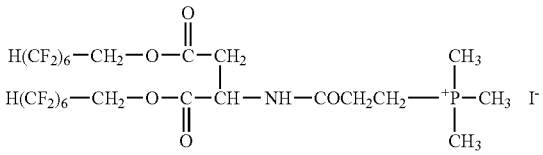

FS-67

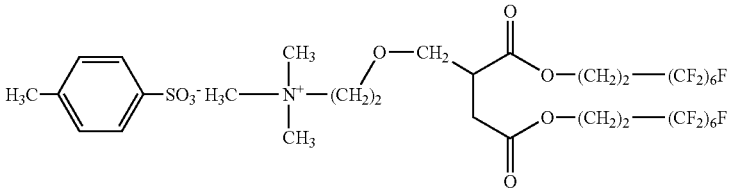

FS-68

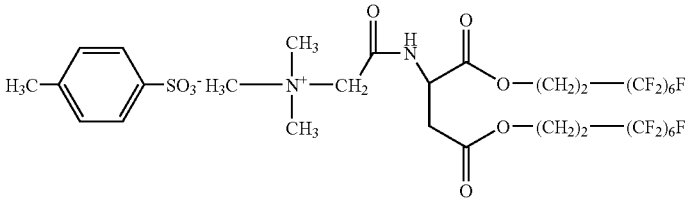

FS-69

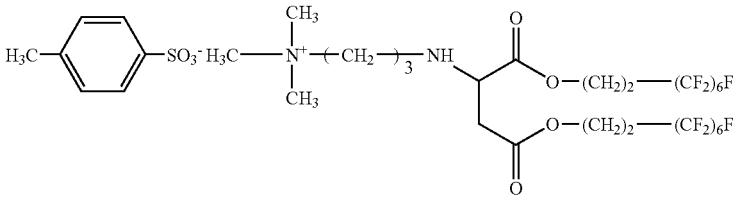

Next, an example of general synthesis of compounds represented by above formulae (1) and (1-a) in the present invention is shown, but the present invention is not limited in these.

The compounds of the present invention can be synthesized by using fumaric acid derivatives, maleic acid derivatives, itaconic acid derivatives, glutamic acid derivatives, aspartic acid derivatives and the like as the starting materials. For example, in the case where fumaric acid derivatives, maleic acid derivatives and itaconic acid derivatives are used as the starting material, the compounds in the present invention can be synthesized by the cationization with an alkylating agent after the Michael addition reaction to these double bonds with the nucleophilic agents.

The fluorocarbon compound in the present invention can have an anionic hydrophilic group.

The anionic hydrophilic group means an acidic group having pKa of 7 or less and an alkali metal salt or an ammonium salt thereof. Specifically, a sulfo group, a carboxyl group, phosphonic acid group, carbamoylsulfamoyl group, sulfamoylsulfamoyl group, acylsulfamoyl group or these salts can be described. Among these, a sulfo group, a carboxyl group, phosphonic acid group and these salts are preferred and a sulfo group and a salt thereof is more preferred. As the cations to form a salt, lithium, sodium, potassium, cesium, ammonium, tetramethylammonium, tetrabutylammonium, methylpyridinium and the like can be described. Lithium, sodium, potassium and ammonium are preferred.

The preferable fluorocarbon compound having an anionic hydrophilic group in the invention can be represented by the following formula (3).

Formula (3)

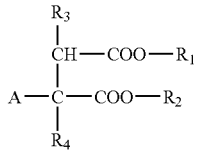

In the formula, $R^1$ and $R^2$ each independently represent an alkyl group, but at least one of them represents Rf. In the case where $R^1$ and $R^2$ represent an alkyl group except a fluoroalkyl group, an alkyl group having 2 to 18 carbon atoms is preferred and an alkyl group having 4 to 12 carbon atoms is more preferred. $R^3$ and $R^4$ each independently represent a hydrogen atom or a substituted or a non-substituted alkyl group.

Special examples of a fluoroalkyl group represented by $R^1$ and $R^2$ are the fluoroalkyl groups described above and the preferred structures are those represented by formula (1) described above. And preferred structures among them are similar to the description of fluoroalkyl group described above. Each alkyl group represented by $R^1$ and $R^2$ is preferably a fluoroalkyl group described above.

A substituted or a non-substituted alkyl group represented by $R^3$ and $R^4$ may be a linear, a branched or a heterocyclic structure. There is no limitation concerning the substituent described above, but is preferably an alkenyl group, an aryl group, an alkoxy group, a halogen atom (preferably chlorine), a carboxylate group, a carbonamido group, a carbamoyl group, an oxycarbonyl group, a phosphate group, or the like.

A represents $-L_b-SO_3M$, and M represents a cation. Herein, as preferred examples of the cation represented as M, an alkali metal ion (lithium ion, sodium ion, potassium ion and the like), an alkali earth metal ion (barium ion, calcium ion and the like), ammonium ion and the like are described. Among these, lithium ion, sodium ion, potassium ion and ammonium ion are preferred and lithium ion, sodium ion and potassium ion are more preferred and these can be suitably selected in terms of the total number of carbon atoms, a substituent of the compound in formula (3) and the branch degree of alkyl group and the like. In the case where $R^1$, $R^2$ $R^3$ and $R^4$ have 16 or more carbon atoms in total, lithium ion for M is excellent in terms of being consistent with solubility (particularly in water) and antistatic activity or a coating uniformity.

$L_b$ represents a single bond and a substituted or a non-substituted alkylene group and the subsutituent is preferably that described in the case of $R^3$. In the case where $L_b$ is an alkylene group, $L_b$ has preferably 2 or less carbon atoms. $L_b$ is preferably a single bond or a $—CH_2—$ group and most preferably a $—CH_2—$ group.

The compound described by above formula (3) is more preferably combined with the above preferable embodiment each other.

Specific examples of the fluorocarbon compound for use in the present invention are set forth below, but the present invention is not limited by the following specific examples.

Unless otherwise indicated, an alkyl group and a perfluoroalkyl group in the structure donation of following examples mean a linear structure.

(F-1)

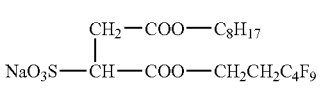

(F-2)

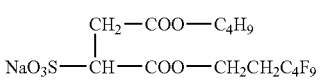

(F-3)

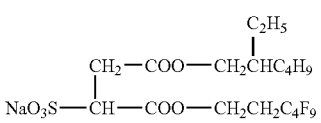

(F-4)

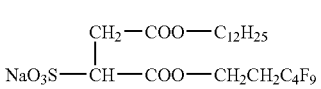

(F-5)

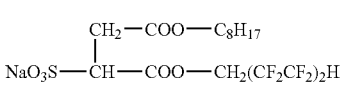

-continued (F-6)

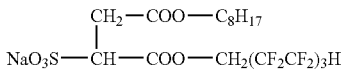

(F-7)

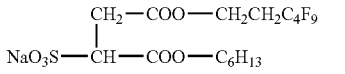

(F-8)

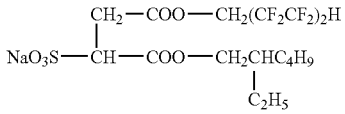

(F-9)

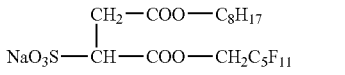

(F-10)

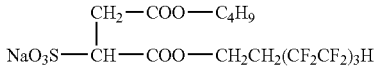

(F-11)

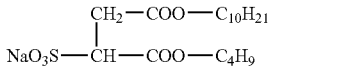

(F-12)

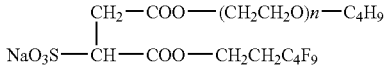

n = 5~15

(F-13)

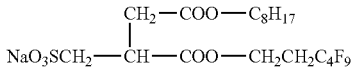

(F-14)

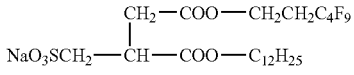

(F-15)

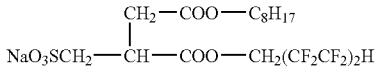

(F-16)

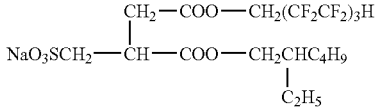

(F-17)

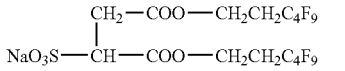

(F-18)

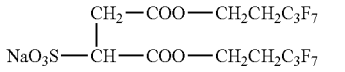

(F-19)

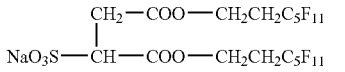

(F-20)

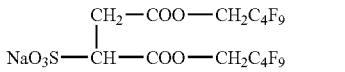

(F-21)

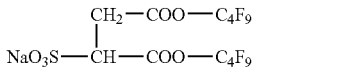

(F-22)

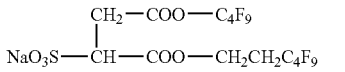

(F-23)

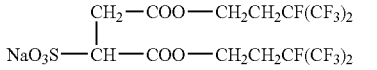

-continued (F-24)

$$NaO_3S-CH(CH_2-COO-CH_2CH_2C_2F_5)-COO-CH_2CH_2C_4F_9$$

(F-25)

$$NaO_3S-CH(CH_2-COO-CH_2(CF_2CF_2)_2H)-COO-CH_2(CF_2CF_2)_2H$$

(F-26)

$$NaO_3S-CH(CH_2-COO-CH_2(CF_2CF_2)_3H)-COO-CH_2(CF_2CF_2)_3H$$

(F-27)

$$NaO_3S-CH(CH_2-COO-CH_2CF_2CF_2H)-COO-CH_2(CF_2CF_2)_3H$$

(F-28)

$$NaO_3S-CH(CH_2-COO-(CH_2CH_2O)nC_4F_9)-COO-(CH_2CH_2O)nC_4F_9$$

n = 5~15

(F-29)

$$NaO_3SCH_2-CH(CH_2-COO-CH_2CH_2C_4F_9)-COO-CH_2CH_2C_4F_9$$

(F-30)

$$NaO_3SCH_2-CH(CH_2-COO-CH_2CH_2C_3F_7)-COO-CH_2CH_2C_3F_7$$

(F-31)

$$NaO_3SCH_2-CH(CH_2-COO-CH_2CH_2C_5F_{11})-COO-CH_2CH_2C_5F_{11}$$

(F-32)

$$NaO_3SCH_2-CH(CH_2-COO-CH_2CH_2C_6F_{12}H)-COO-CH_2CH_2C_6F_{12}H$$

(F-33)

$$NaO_3SCH_2-CH(CH_2-COO-CH_2(CF_2CF_2)_2H)-COO-CH_2(CF_2CF_2)_2H$$

(F-34)

$$NaO_3SCH_2-CH(CH_2-COO-CH_2(CF_2CF_2)_3H)-COO-CH_2(CF_2CF_2)_3H$$

(F-35)

$$NaO_3SCH_2-CH(CH_2-COO-CH_2CF_2CF_2H)-COO-CH_2(CF_2CF_2)_3H$$

(F-36)

$$NaO_3SCH_2-CH(CH_2-COO-CH_2CH_2CF(CF_3)_2)-COO-CH_2CH_2CF(CF_3)_2$$

(F-37)

$$NaO_3SCH_2-CH(CH_2-COO-CH_2CH(C_2F_5)_2)-COO-CH_2CH(C_2F_5)_2$$

(F-38)

$$NaO_3S-CH(CH_3)-CH(CH_2-COO-CH_2CH_2C_4F_9)-COO-CH_2CH_2C_4F_9$$

(F-39)

$$NaO_3S-CH(CH-COO-CH_2CH_2C_4F_9)-CH(CH-COO-CH_2CH_2C_4F_9)-COO-CH_2CH_2C_4F_9$$

(F-40)

$$NaO_3S-CH(CH-COO-CH_2(CF_2CF_2)_2H)-CH(CH-COO-CH_2(CF_2CF_2)_2H)-COO-CH_2(CF_2CF_2)_2H$$

-continued (F-41)

$$NaO_3SCH_2CH_2-CH(CH_2-COO-CH_2CH_2C_4F_9)-COO-CH_2CH_2C_4F_9$$

(F-42)

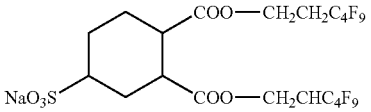

(F-43)

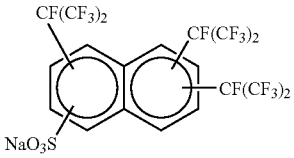

(F-44)

$$NaO_3SCH_2-CH(CH_2-COO-C_8H_17)-P(=O)(O-CH_2CH_2C_4F_9)-O-CH_2CH_2C_4F_9$$

(F-45)

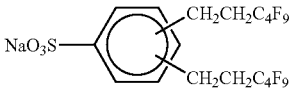

(F-46)

$$NaO_3SCH_2-C(CH_2-COO-CH_2(CF_2CF_2)_2H)_3-COO-CH_2(CF_2CF_2)_2H$$

(F-47)

$$KO_3S-CH(CH_2-COO-C_8H_17)-COO-CH_2CH_2C_4F_9$$

(F-48)

$$LiO_3S-CH(CH_2-COO-C_8H_17)-COO-CH_2(CF_2CF_2)_3H$$

(F-49)

$$LiO_3S-CH(CH_2-COO-C_8H_17)-COO-CH_2CH_2C_4F_9$$

(F-50)

$$LiO_3S-CH(CH_2-COO-CH_2CH_2C_4F_9)-COO-CH_2CH_2C_4F_9$$

(F-51)

$$KO_3S-CH(CH_2-COO-CH_2CH_2C_4F_9)-COO-CH_2CH_2C_4F_9$$

(F-52)

$$LiO_3S-CH(CH_2-COO-CH_2(CF_2CF_2)_3H)-COO-CH_2(CF_2CF_2)_3H$$

(F-53)

$$LiO_3SCH_2-CH(CH_2-COO-CH_2CH_2C_4F_9)-COO-CH_2CH_2C_4F_9$$

(F-54)

$$KO_3SCH_2-CH(CH_2-COO-CH_2(CF_2CF_2)_2H)-COO-CH_2(CF_2CF_2)_2H$$

(F-55)

$$KO_3SCH_2-CH(CH_2-COO-CH_2CH_2C_4F_9)-COO-CH_2CH_2C_4F_9$$

(F-56)

$$LiO_3SCH_2-CH(CH_2-COO-CH_2(CF_2CF_2)_2H)-COO-CH_2(CF_2CF_2)_2H$$

-continued (F-57)

$$NaO_3S-CH(CH_2-COO-C_6F_{13})-COO-CH_2CH_2C_6F_{13}$$

(F-58)

$$NaO_3S-CH(CH_2-COO-CH_2CH_2C_4F_9)-COO-CH_2CH_2C_4F_9$$

(F-59)

$$NaO_3S-CH(CH_2-COO-CH_2C_4F_9)-COO-CH_2C_4F_9$$

(F-60)

$$NaO_3S-CH(CH_2-COO-C_4F_9)-COO-C_4F_9$$

(F-61)

$$NaO_3SCH_2-CH(CH_2-COO-CH_2CH_2C_4F_9)-COO-CH_2CH_2C_4F_9$$

The fluorocarbon compound in the present invention can have a nonionic hydrophilic group.

The nonionic hydrophilic group means the water-soluble group without dissociation as ion. Specific examples include poly(oxyethylene)alkylether, multivalent alcohol and the like can be described, but is not limited in these.

The preferred nonionic fluorocarbon compound in the present invention can be represented by the following formula (4).

$$Rf-X-((CH_2)_n-O)_m-R \qquad \text{Formula (4)}$$

In formula (4), Rf is a fluoroalkyl group described above and as specific examples, the substituents described above can be described and as the preferred structure, the above structure described in formula (1) can be also be described. And the preferred structure in it is also similar to the description of Rf described above.

X in formula (4) represents a divalent linking group and is not especially limited. For examples, $$-O- \quad -S- \quad -C(=O)- \quad -C(=O)-O-$$

$$-C(=O)-NR- \quad -SO_2NR- \quad -O-C(=O)-O-$$

$$-O-C(=O)-NH- \quad -NH-C(=O)-NH-$$

$$-SO_2- \quad -SO- \quad -O-C(=O)-$$

$$-NR-SO_2- \quad -NR-CO-$$

and the like are described.

In formula (4), n represents an integral number 2 or 3, and m represents an integral number of 1 to 30. R represents a hydrogen atom, an alkyl group, an aryl group, a heterocyclic group, Rf, or the group having one or more Rf.

Specific examples of the nonionic fluorocarbon compound for use in the present invention are shown below, but the present invention is not limited by the following specific examples.

| | | |
|---|---|---|
| FN-1 | $C_4F_9CH_2CH_2O-(CH_2CH_2O)_n-H$ | n = 5~15 |
| FN-2 | $H(CF_2)_6CH_2O-(CH_2CH_2O)_n-H$ | n = 5~15 |
| FN-3 | $C_4F_9CH_2COO-(CH_2CH_2O)_n-H$ | n = 5~15 |
| FN-4 | $C_4F_9CH_2CONH-(CH_2CH_2O)_n-H$ | n = 5~15 |
| FN-5 | $C_4F_9CH_2SO_2NH-(CH_2CH_2O)_n-H$ | n = 5~15 |
| FN-6 | $C_4F_9CH_2CH_2NHCOO-(CH_2CH_2O)_n-H$ | n = 5~15 |
| FN-7 | 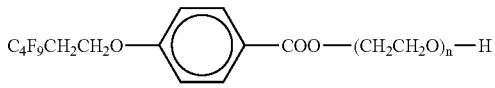 | n = 5~15 |
| FN-8 | $H(CF_2)_4CH_2O-(CH_2CH_2CH_2O)_n-H$ | n = 5~15 |
| FN-9 | 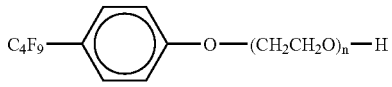 | n = 5~15 |
| FN-10 | $C_4F_9CH_2CH_2O-(CH_2CH_2O)_{n1}-(CH_2CH_2CH_2O)_{n2}-(CH_2CH_2O)_{n3}-H$ | n1 = 5~10<br>n2 = 5~10<br>n3 = 5~10 |
| FN-11 | $C_4F_9CH_2CH_2O-(CH_2CH_2O)_n-CH_3$ | n = 10~20<br>0 |
| FN-12 | $C_4F_9CH_2CH_2O-(CH_2CH_2O)_n-C_4H_9$ | n = 10~20<br>0 |
| FN-13 | $C_4F_9CH_2CH_2O-(CH_2CH_2O)_n-CH_2CH_2C_4H_9$ | n = 10~20 |
| FN-14 | $CH_2COO-(CH_2CH_2O)_n-CH_2CH_2C_4H_9$<br>\|<br>$CH_2COO-(CH_2CH_2O)_n-CH_2CH_2C_4H_9$ | n = 5~10 |

-continued

| | | |
|---|---|---|
| FN-15 | $CH_2COO—(CH_2CH_2O)_n—CH_2CH_2C_4H_9$<br>\|<br>$CHCOO—(CH_2CH_2O)_n—CH_2CH_2C_4H_9$<br>\|<br>$CH_2COO—(CH_2CH_2O)_n—CH_2CH_2C_4H_9$ | n = 5~10 |
| FN-16 | $CH_2O—(CH_2CH_2O)_n—CH_2CH_2C_4H_9$<br>\|<br>$CHO—(CH_2CH_2O)_n—CH_2CH_2C_4H_9$<br>\|<br>$CH_2O—(CH_2CH_2O)_n—CH_2CH_2C_4H_9$ | n = 5~10 |
| FN-17 | $H—C_6F_{12}CH_2O—(CH_2CH_2O)_n—CH_2C_6F_{12}—H$ | n = 5~10<br>0 |
| FN-18 | $CH_2O—(CH_2CH_2O)_n—CH_2(CF_2)_4H$<br>\|<br>$C_2H_5—C—CH_2O—(CH_2CH_2O)_n—CH_2(CF_2)_4H$<br>\|<br>$CH_2O—(CH_2CH_2O)_n—CH_2(CF_2)_4H$ | n = 5~10 |
| FN-19 | $C_6F_{13}CH_2CH_2O—(CH_2CH_2O)_n—H$ | n = 5~15 |
| FN-20 | $C_6F_{13}$— 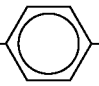 —$O—(CH_2CH_2O)_n—H$ | n = 5~15 |
| FN-21 | $C_6F_{13}CH_2CH_2O—(CH_2CH_2O)_n—CH_2CH_2C_6F_{13}$ | n = 10~20 |

The compound having a fluoroalkyl group favorably used in the photothermographic material according to the invention can be preferably utilized as the surfactant of the coating composition for forming the layers (in particular, the protective layer, the undercoat layer, the back layer, and the like) constituting the silver halide photothermographic material. In the case where the compound is used for forming the outermost layer of the photothermographic material, it is particularly preferred from the viewpoint of achieving effective antistatic activity and of obtaining uniform coating. By realizing the structure above, it has been found further that it is effective for improving storage stability as well as dependency on the using environment, which are the objects of the invention. In order to obtain the effect, the fluorocarbon compound used in the invention is preferably contained in the outermost layer of the image forming layer surface or the outermost layer of the back surface. Similar effects can be achieved by employing it in the support undercoat layer.

The addition amount of the fluorocarbon compound in the present invention is not especially limited and is arbitrarily determined corresponding to the structure and the using place of the fluorocarbon compound and the series and an amount of other additive contained in a component. For example, in the case where the fluorocarbon compound is used in the coating solution for the outermost layer of photothermographic material, the coating amount of the fluorocarbon compound in a coating solution is preferably 0.1 $mg/m^2$ to 100 $mg/m^2$, and more preferably 0.5 $mg/m^2$ to 20 $mg/m^2$.

In the present invention, one kind of the aforementioned fluorocarbon compound may be used or the mixture of two or more kinds of the fluorocarbon compound may be used. Additionally, the surfactant besides the aforementioned fluorocarbon compound can be used in combination with the fluorocarbon compound of the present invention.

(Hardener)

A hardener can be used in each of the image forming layer, the protective layer, the back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

(Antistatic Agent)

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The addition amount of different types of atoms is preferably in the range from 0.01 mol % to 30 mol %, and particularly preferably, in the range from 0.1 mol % to 10 mol %. The shape of the metal oxides can include, for example, spherical, needle-like, or tabular shape. The needle-like particles, with the rate of (the major axis)/(the minor axis) is 2.0 or more, and more preferably, 3.0 to 50, is preferred viewed from the standpoint of the electric conductivity effect. The metal oxides is used preferably in the range from 1 $mg/m^2$ to 1000 $Mg/m^2$, more preferably from 10 $Mg/m^2$ to 500 $mg/m^2$, and further preferably from 20 $mg/m^2$ to 200 $mg/m^2$. The antistatic layer can be laid on either side of the image forming layer side or the back layer side, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

(Support)

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal developing process. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and the like. The moisture content of the support is preferably 0.5% by weight or less when coating for image forming layer and back layer is conducted on the support.

(Other Additives)

Furthermore, antioxidant, stabilizing agent, plasticizer, UV absorbent, or a film forming promoting agent may be added to the photothermographic material. Each of the additives is added to either of the image forming layer (photosensitive layer) or the non-photosensitive layer. Reference can be made to WO No. 98/36322, EP-A No. 803764A1, JP-A Nos. 10-186567 and 10-18568, and the like.

1-7. Wrapping Material

In order to suppress fluctuation from occurring on the photographic property during a preservation of the photothermographic material of the invention before thermal development, or in order to improve curling or winding tendencies, it is preferred that a wrapping material having low oxygen transmittance and/or vapor transmittance is used. Preferably, oxygen transmittance is 50 $mL \cdot atm^{-1} m^{-2} day^{-1}$ or lower at 25° C., more preferably, 10 $mL \cdot atm^{-1} m^{-2} day^{-1}$ or lower, and most preferably, 1.0 $mL \cdot atm^{-1} m^{-2} day^{-1}$ or lower. Preferably, vapor transmittance is 10 $g \cdot atm^{-1} m^{-2} day^{-1}$ or lower, more preferably, 5 $g \cdot atm^{-1} m^{-2} day^{-1}$ or lower, and most preferably, 1 $g \cdot atm^{-1} m^{-2} day^{-1}$ or lower.

As specific examples of a wrapping material having low oxygen transmittance and/or vapor transmittance, reference can be made to, for instance, the wrapping material described in JP-A Nos.8-254793 and 2000-206653.

1-8. Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864 and 2001-348546.

In instances of multi-color photothermographic materials, each image forming layer is in general, held distinctively each other by using a functional or nonfunctional barrier layer between each image forming layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

1-9. Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and most preferably used is slide coating. Example of the shape of the slide coater for use in slide coating is shown in FIG. 11*b*. 1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the layer containing organic silver salt in the invention at a shear velocity of $0.1S^{-1}$ is preferably in the range from 400 mPa·s to 100,000 mPa.s, and more preferably, from 500 mPa·s to 20,000 mPa·s. At a shear velocity of $1000S^{-1}$, the viscosity is preferably in the range from 1 mPa.s to 200 mpa·s, and more preferably, from 5 mpa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and time period for heating is preferably in the range from 1 second to 60 seconds. More preferably, the temperature of the heat treatment is in the range 70° C. to 90° C. at the film surface and time period for heating is 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to produce the photothermographic material of the invention stably and continuously.

The photothermographic material is preferably of monosheet type (i.e., a type which can form image on the photothermographic material without using other sheets such as an image-receiving material).

2. Image Forming Method

1) Exposure

As laser beam according to the invention, He—Ne laser of red through infrared emission, red laser diode, or $Ar^+$, He—Ne, He—Cd laser of blue through green emission, blue laser diode are used. Preferred laser is red to infrared laser diode and the peak wavelength of the laser beam is 600 nm to 900 nm, and more preferably 620 nm to 850 nm. In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future. The peak wavelength of blue laser beam is preferably 300 nm to 500 nm, and particularly preferably 400 nm to 500 nm.

Laser beam which oscillates in a longitudinal multiple modulation by a method such as high frequency superposition is also preferably employed.

2) Thermal Development

Although the development of the photothermographic material of the invention is usually performed by elevating the temperature of the photothermographic material exposed imagewise, any method may be used for this thermal development process. The temperature for the development is preferably 80° C. to 250° C., more preferably 100° C. to 140° C., and further preferably 110° C. to 130° C. Time period for the development is preferably 1 second to 60 seconds, more preferably 3 seconds to 30 seconds, further preferably 5 seconds to 25 seconds, and particularly preferably 7 seconds to 15 seconds.

In the process for the thermal development, either drum type heaters or plate type heaters may be used. However, plate type heater processes are more preferred. Preferable process for the thermal development by a plate type heater may be a process described in JP-A NO. 11-133572, which discloses a thermal developing apparatus in which a visible image is obtained by bringing a photothermographic material with a formed latent image into contact with a heating means at a thermal developing portion, wherein the heating means comprises a plate heater, and plurality of retainer rollers are oppositely provided along one surface of the plate heater, the thermal developing apparatus is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferable that the heater is more stably controlled, and it is desirable that the top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. When such imagers are used, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, to use the photothermographic materials of the invention in combination, which are highly sensitive and less susceptible to the environmental temperature, is preferred. Preferable thermal developing apparatus according to the invention is shown in FIG. 1.

The thermal developing apparatus 10 comprises trays 36, 38, and 40 for stocking photothermographic materials, a laser exposure portion 54, a thermal developing portion 60, a cooling portion 68, and a discharging portion 70.

Description will be given of other symbols used in FIG. 1 below.

16 cover sheets
36, 37, 41 windows for bar code reader
43, 45, 47 bar code readers
48, 50, 52 sheet feeding devices
64*a*, 64*b*, 64*c* plate heaters
62 a plurality of rollers
66 a drum
F photothermographic materials
L a laser beam In the present invention, the image formation of the photothermographic material can be carried out by using a thermal developing apparatus which comprises a thermal developing portion having a driving roller and a plate heater, and by thermally developing the photothermographic material by contacting a surface of the photothermographic materal at a side at which the image forming layer is disposed with the driving roller and by contacting a surface of the photothermographic materal at a side at which the back layer is disposed with the plate heater. Because of the superior transportability of the photothermographic material according to the present invention, the thermal development where the surface of the photothermographic material contacts with the driving roller or the plate heater can be performed.

3)System

Examples of a medical laser imager equipped with an exposing portion and a thermal developing portion include Fuji Medical Dry Laser Imager FM-DP L and DRYPIX 7000. In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

3. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film having such a thickness that the thickness should become 175 μm after tentered and thermal fixation.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

<Preparations of Coating Solution for Undercoat Layer>

| Formula (1) (for undercoat layer on the image forming layer side) | |
|---|---|
| Pesresin A-520 manufactured by Takamatsu Oil & Fat Co., Ltd. (30% by weight solution) | 59 g |
| polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| distilled water | 935 mL |
| **Formula (2) (for first layer on the back surface)** | |
| Styrene-butadiene copolymer latex (solid content of 40% by weight, styrene/butadiene weight ratio = 68/32) | 158 g |
| 8% by weight aqueous solution of 2,4-dichloro-6-hydroxy-S-triazine sodium salt | 20 g |
| 1% by weight aqueous solution of sodium laurylbenzenesulfonate | 10 mL |
| distilled water | 854 mL |
| **Formula (3) (for second layer on the back surface)** | |
| $SnO_2$/SbO (9/1 weight ratio, mean particle diameter of 0.038 μm, 17% by weight dispersion) | 84 g |
| gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| distilled water | 805 mL |

<Undercoating>

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

(Back Layer)

1) Preparations of Coating Solution for Back Layer

<Preparation of Dispersion of Solid Fine Particles (a) of Base Precursor>

A base precursor-1 in an amount of 2.5 kg, and 300 g of a surfactant (trade name: DEMOL N, manufactured by Kao Corporation), 800 g of diphenyl sulfone, 1.0 g of benzoisothiazolinone sodium salt and distilled water were added to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having the mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor became 25% by weight, and filtrated (with a polypropylene filter having the mean fine pore diameter of 3 μm) for eliminating dust to put into practical use.

<Preparation of Dispersion of Solid Fine Particle of Dye>

A cyanine dye-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent. (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion ($D_{650}/D_{750}$) became 5.0 or more upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

<Preparation of Coating Solution for Antihalation Layer>

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

2) Preparation of Coating Solution for Back Surface Protective Layer

<Preparation of Coating Solution for Back Surface Protective Layer-1>

Comparative Example

A vessel was kept at 40° C., and thereto were added 40 g of gelatin, 35 mg of benzoisothiazolinone and 840 mL of water to allow gelatin to be dissolved. Additionally, 5.8 mL of a 1 mol/L aqueous sodium hydroxide solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon compound-A, 2.4 mL of a 2% by weight solution of fluorocarbon compound-B, and 45 g of a 20% by weight solution of methyl methacrylate/styrene/butyl acrylate/hydroxyethyl methacrylate/acrylic acid copolymer (weight ratio of the copolymerization of 58/8/27/5/2, Tg: 42° C., I/O value: 0.555) latex (latex 1 for comparision) were admixed. Just prior to the coating, 25 mL of a 4% by weight aqueous solution of N,N-ethylenebis (vinylsulfone acetamide) was admixed to give a coating solution for the back surface protective layer.

<Preparation of Coating Solution for Back Surface Protective Layer-2>

Comparative Example

Preparation of coating solution for back surface protective layer-2 was conducted in a similar manner to the preparation of coating solution for back surface protective layer-1, except that changing the latex to methyl methacrylate/butyl acrylate/acrylic acid copolymer (weight ratio of the copolymerization of 18/80/2, Tg: −34° C., I/O value: 0.490) latex (latex 2 for comparision).

<Preparation of Coating Solution for Back Surface Protective Layer-3 to -15>

Present Invention

Preparation of coating solution for back surface protective layer-3 to -15 were conducted in a similar manner to the preparation of coating solution for back surface protective layer-1, except that changing gelatin and the latex to those shown in Table 2.

3) Coating of Back Layer

The back surface side of the undercoated support as described above was subjected to simultaneous double coating so that the coating solution for the antihalation layer gives the coating amount of gelatin of 0.52 g/m$^2$, and so that the coating solution for the back surface protective layer-1 to -15 gives the coating amount of water-soluble polymer of 1.7 g/m$^2$, followed by drying to produce a back layer-1 to -15. The back layer-3 to -15 according to the invention had an excellent coating surface state compared with the comparative back layer-1 and -2.

(Image Forming Layer, Intermediate Layer, and Surface Protective Layer)

1. Preparations of Materials for Coating

1) Silver Halide Emulsion

<<Preparation of Silver Halide Emulsion-1>>

To 1421 mL of distilled water was added 3.1 mL of a 1% by weight potassium bromide solution. Further, a liquid added with 3.5 mL of sulfuric acid having the concentration of 0.5 mol/L and 31.7 g of phthalated gelatin was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Hexachloroiridium (III) potassium salt was added to give $1\times10^{-4}$ mol per one mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per one mol of silver. The mixture was adjusted to the pH of 3.8 with sulfuric acid at the concentration of 0.5 mol/L. After stopping stirring, the mixture was subjected to precipitation/desalting/water washing steps. The mixture was adjusted to the pH of 5.9 with sodium hydroxide at the concentration of 1 mol/L to produce a silver halide dispersion having the pAg of 8.0.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per one mol of silver. At additional 5 minutes later, a tellurium sensitizer C in a methanol solution was added at $2.9\times10^{-4}$ mol per one mol of silver and subjected to aging for 91 minutes. Thereafter, a methanol solution of a spectral sensitizer A and a spectral sensitizer B with a molar ratio of 3:1 was added thereto at $1.2\times10^{-3}$ mol in total of the spectral sensitizer A and B per one mol of silver. At one minute later, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per one mol of silver, 1-phenyl-2-heptyl-5-mercapto-1,3,4-triazole in a methanol solution at $5.4\times10^{-3}$ mol per one mol of silver, and 1-(3-methylureidophenyl)-5-mercaptotetrazole in an aqueous solution at $8.5\times10^{-3}$ mol per one mol of silver were added to produce a silver halide emulsion-1.

Grains in thus prepared silver halide emulsion were silver iodobromide grains having a mean sphere equivalent diameter of 0.042 μm, a variation coefficient of 20%, which uniformly include iodine at 3.5 mol %. Grain size and the like were determined from the average of 1000 grains using an electron microscope. The [100] face ratio of this grain was found to be 80% using a Kubelka-Munk method.

<<Preparation of Silver Halide Emulsion-2>>

Preparation of silver halide emulsion-2 was conducted in a similar manner to the process in the preparation of the silver halide emulsion-1 except that: the temperature of the liquid upon the grain formation step was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30minutes; and potassium iron (II) hexacyanide was deleted. The precipitation/desalting/water washing/dispersion were carried out similarly to the silver halide emulsion-1. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-1 except that: the amount of the tellurium sensitizer C to be added was changed to $1.1\times10^{-4}$ mol per one mol of silver; the amount of the methanol solution of the spectral sensitizer A and a spectral sensitizer B with a molar ratio of 3:1 to be added was changed to $7.0\times10^{-4}$ mol in total of the spectral sensitizer A and the spectral sensitizer B per one mol of silver; the addition of 1-phenyl-2-heptyl-5-mercapto-1,3,4-triazole was changed to give $3.3\times10^{-3}$ mol per one mol of silver; and the addition of 1-(3-methylureidophenyl)-5-mercaptotetrazole was changed to give $4.7\times10^{-3}$ mol per one mol of silver to produce a silver halide emulsion-2. The emulsion grains in the silver halide emulsion-2 were pure cubic silver bromide grains having a mean sphere equivalent diameter of 0.080 μm and a variation coefficient of 20%.

<<Preparation of Silver Halide Emulsion-3>>

Preparation of a silver halide emulsion-3 was conducted in a similar manner to the process in the preparation of the silver halide emulsion-1 except that the temperature of the liquid upon the grain formation step was altered from 30° C. to 27° C. In addition, the precipitation/desalting/water washing/dispersion were carried out similarly to the silver halide emulsion-1. Silver halide emulsion-3 was obtained similarly to the emulsion-1 except that: the addition of the methanol solution of the spectral sensitizer A and the spectral sensitizer B was changed to the solid dispersion (aqueous gelatin solution) at a molar ratio of 1:1 with the amount to be added being $6.0\times10^{-3}$ mol in total of the spectral sensitizer A and spectral sensitizer B per one mol of silver; the amount of the tellurium sensitizer C to be added was changed to $5.2\times10^{-4}$ mol per one mol of silver; and bromoauric acid at $5\times10^{-4}$ mol per one mol of silver and potassium thiocyanate at $2\times10^{-3}$ mol per one mol of silver were added at 3 minutes following the addition of the tellurium sensitizer. The grains in the silver halide emulsion-3 were silver iodobromide grains having a mean sphere equivalent diameter of 0.034 μm and a variation coefficient of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight and the silver halide emulsion-3 at 15% by weight were dissolved, and thereto was added benzothiazolium iodide at $7\times10^{-3}$ mol per one mol of silver with a 1% by weight aqueous solution. Further, water was added thereto to give the content of silver of 38.2 g per one kg of the mixed emulsion for a coating solution, and 1-(3-methylureidophenyl)-5-mercaptotetrazole was added to give 0.34 g per 1 kg of the mixed emulsion for a coating solution.

Further, as "a compound that can be one-electron-oxidized to provide a one-electron oxidation product, which releases one or more electrons", the compounds Nos. 1, 20 and 26 were added respectively in an amount of $2\times10^{-3}$ mol per one mol of silver halide.

2) Preparations of Dispersion of Silver Salt of Fatty Acid

<<Preparation of Dispersion of Silver Salt of Fatty Acid A>>

87.6 kg of behenic acid (Henkel Co., trade name: Edenor C22-85R), 423 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution of a sodium behenate A. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium behenate A and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of a sodium behenate A was thereafter started, and during 14 minutes and 15 seconds following the completion of adding the aqueous silver nitrate solution, the added material was restricted to the solution of a sodium behenate A alone. The temperature inside of the reaction vessel was then set to be 30° C., and the temperature outside was controlled so that the liquid temperature could be kept constant. In addition, the temperature of a pipeline for the addition system of the solution of a sodium behenate A was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium behenate A was added and the position, at which the aqueous silver nitrate solution was added, was arranged symmetrically with a shaft for stirring located at a center. Moreover, both of the positions were adjusted to avoid contact with the reaction liquid.

After completing the addition of the solution of a sodium behenate A, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a flake crystal was revealed having a=0.14 μm, b=0.4 μm and c=0.6 μm on the average value, with a mean aspect ratio of 5.2, a mean sphere equivalent diameter of 0.52 μm and a variation coefficient of 15% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver behenate (a dispersion of silver salt of fatty acid). For the cooling manipulation, coiled heat exchangers were equipped before and after of the interaction chamber respectively, and accordingly, the temperature for the dispersion was set to be 18° C. by regulating the temperature of the cooling medium.

<<Preparation of Dispersion of Silver Salt of Fatty Acid B>>

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. Thus resulting crystal was subjected to centrifugal filtration, and washing was performed with 100 kg of isopropyl alcoholy. Thereafter, the crystal was dried. Thus resulting crystal was esterified, and subjected to GC-FID analysis to give the results of the content of behenic acid being 96 mol %. In addition, arachidic acid was included at 2 mol %, lignoceric acid was included at 2 mol %, and erucic acid was included at 0.001 mol %.

<Preparation of Dispersion of Silver Salt of Fatty Acid B>

88 kg of recrystallized behenic acid, 422 L of distilled water, 49.2 L of an aqueous sodium hydroxide solution at the concentration of 5 mol/L, 120 L of t-butyl alcohol were admixed, and subjected to a reaction with stirring at 75° C. for one hour to give a solution of a sodium behenate B. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium behenate B and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of a sodium behenate B was thereafter started, and during 14 minutes and 15 seconds following the completion of adding the aqueous silver nitrate solution, the added material was restricted to the solution of a sodium behenate B alone. The temperature inside of the reaction vessel was then set to be 30° C., and the temperature outside was controlled so that the liquid temperature could be kept constant. In addition, the temperature of a pipeline for the addition system of the solution of a sodium behenate B was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium behenate B was added and the position at which the aqueous silver nitrate solution was added were arranged symmetrically with a shaft for stirring located at a center. Moreover, both of the positions were adjusted to avoid contact with the reaction liquid.

After completing the addition of the solution of a sodium behenate B, the mixture was left to stand at the temperature as it is for 20 minutes. The temperature of the mixture was then elevated to 35° C. over 30 minutes followed by aging for 210 minutes. Immediately after completing the aging, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1 and a variation coefficient of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped fore and aft of the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of a reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain a reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of a reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain a reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound-1 Dispersion

To 10 kg of a hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain a hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 3 hours and 30 minutes. Thereafter, 0.2 g of a benzoisothiazolinone sodium salt and water were added thereto, thereby adjusting the concentration of the development accelerating agent to be 20% by weight. Accordingly, a development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparations of Dispersions of Development Accelerator-2 and Color-Tone-Adjusting Agent-1

Also concerning solid dispersions of a development accelerator-2 and a color-tone-adjusting agent-1, dispersion was executed in a similar manner to the development accelerator-1, and thus dispersions of 20% by weight and 15% by weight were respectively obtained.

7) Preparations of Organic Polyhalogen Compound Dispersion

<<Preparation of Organic Polyhalogen Compound-1 Dispersion>>

An organic polyhalogen compound-1 (tribromomethane sulfonylbenzene) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give a slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by weight. Accordingly, an organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by weight aqueous solution of modified polyvinyl alcohol (manufactured by Kuraray Co., Ltd., Poval MP203), and 0.4 kg of a 20% by weight aqueous solution of sodium triisopropylnaphthalenesulfonate were added, and thoroughly admixed to give a slurry. This slurry was fed with a diaphragm pump, and was subjected to dispersion with a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain an organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified polyvinyl alcohol MP203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight phthalazine compound-1 solution.

9) Preparations of Mercapto Compound Solution

<<Preparation of Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (¼G sand grinder mill: manufactured by IMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

11) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had the mean particle diameter of 90 nm, Tg of 17° C., solid matter concentration of 44% by weight, the equilibrium moisture content at 25° C., 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

A SBR latex having a different Tg can be prepared in a similar manner by changing the ratio of stylene and butadiene properly.

2. Preparations of Coating Solutions

1) Preparation of Coating Solution for Image Forming Layer-1

The dispersion A of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution and 27 mL of the mercapto compound-2 aqueous solution were serially added. The coating solution for the image forming layer prepared by adding 118 g of the mixed emulsion A for coating solution thereto followed by thorough mixing just prior to the coating was fed directly to a coating die.

Viscosity of the coating solution for the image forming layer was measured with a B type viscometer from Tokyo Keiki, and was revealed to be 25 [mPa·s] at 40° C. (No. 1 rotor, 60 rpm).

Viscosity of the coating solution at 38° C. when it was measured using RheoStress RS150 manufactured by Haake was 32, 35, 33, 26, and 17 [mPa·s], respectively, at the shearing rate of 0.1, 1, 10, 100, 1000 [1/second].

The amount of zirconium in the coating solution was 0.32 mg per one g of silver.

2) Preparation of Coating Solution for Image Forming Layer-2

The dispersion B of the silver salt of fatty acid obtained as described above in an amount of 1000 g, 135 mL of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) solution, 153 g of the reducing agent-2 dispersion, 55 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die.

Viscosity of the coating solution for the image forming layer was measured with a B type viscometer from Tokyo Keiki, and was revealed to be 40 [mPa·s] at 40° C. (No. 1 rotor, 60 rpm).

Viscosity of the coating solution at 38° C. when it was measured using RheoStress RS150 manufactured by Haake was 30, 43, 41, 28, and 20 [mPa·s], respectively, at the shearing rate of 0.1, 1, 10, 100, 1000 [1/second].

The amount of zirconium in the coating solution was 0.30 mg per one g of silver.

3) Coating Solution for Intermediate Layer

To 1000 g of polyvinyl alcohol PVA-205 (manufactured by Kuraray Co., Ltd.), 163 g of the pigment-1 dispersion, 33g of an aqueous solution of a blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

4) Coating Solution for First Layer of Surface Protective Layers

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl)sodium sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

5) Coating Solution for Second Layer of Surface Protective Layers

In 800 mL of water were dissolved 100 g of inert gelatin and 10 mg of benzoisothiazolinone, and thereto were added liquid paraffin emulsion at 8.0 g equivalent to liquid paraffin, 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon compound-A, 5.5 mL of a 1% by weight aqueous solution of fluorocarbon compound-B, 28 mL of a 5% by weight aqueous solution of di(2-ethylhexyl)sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that 8.3 mL/m$^2$ could be provided.

Viscosity of the coating solution was 19 [mPa.s] which was measured with a B type viscometer at 40° C. (No. 1 rotor, 60 rpm).

3. Preparations of Photothermographic Material

1) Preparation of Photothermographic Material-101

Reverse surface of the back surface on which the back layer-1 was coated was subjected to simultaneous overlaying coating by a slide bead coating method in order of the image forming layer-1, intermediate layer, first layer of the surface protective layers and second layer of the surface protective layers starting from the undercoated face, and thus sample of photothermographic material was produced.

In this method, the temperature of the coating solution was adjusted to 31° C. for the image forming layer and intermediate layer, to 36° C. for the first layer of the surface protective layers, and to 37° C. for the second layer of the surface protective layers.

The coating amount of each compound (g/m$^2$) for the image forming layer is as follows.

| | |
|---|---|
| Silver salt of fatty acid | 5.42 |
| Pigment (C. I. Pigment Blue 60) | 0.036 |
| Organic polyhalogen compound-1 | 0.12 |
| Organic polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver halide (on the basis of Ag content) | 0.10 |

Conditions for coating and drying are as follows.

Coating was performed at the speed of 160 m/min. The clearance between the leading end of the coating die and the support was 0.10 mm to 0.30 mm. The pressure in the vacuum chamber set to be lower than atmospheric pressure by 196 Pa to 882 Pa. The support was decharged by ionic wind.

In the subsequent cooling zone, the coating solution was cooled by wind having the dry-bulb temperature of 10° C. to 20° C. Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C., and after heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer side surface gave the result of 6.0.

2) Preparations of Photothermographic Material-102 to -115

Preparations of photothermographic material-102 to -115 were conducted in a similar manner to the preparation of photothermographic material-101, except that using the back layer-2 to -15 instead of using the back layer-1.

3) Preparation of Photothermographic Material-201

Preparation of photothermographic material-201 was conducted in a similar manner to the preparation of photothermographic material-101, except that using the coating solution for image forming layer-2 instead of using the coating solution for image forming layer-1.

The coating amount of each compound (g/m$^2$) for this image forming layer is as follows.

| | |
|---|---|
| Silver salt of fatty acid | 5.27 |
| Pigment (C. I. Pigment Blue 60) | 0.036 |
| Organic polyhalogen compound-1 | 0.14 |
| Organic polyhalogen compound-2 | 0.28 |
| Phthalazine compound-1 | 0.18 |
| SBR latex | 9.43 |
| Reducing agent-2 | 0.77 |
| Hydrogen bonding compound-1 | 0.28 |
| Development accelerator-1 | 0.019 |
| Development accelerator-2 | 0.016 |
| Color-tone-adjusting agent-1 | 0.006 |
| Mercapto compound-2 | 0.003 |
| Silver halide (on the basis of Ag content) | 0.13 |

4) Preparations of Photothermographic Material-202 to -215

Preparations of photothermographic material-202 to -215 were conducted in a similar manner to the preparation of photothermographic material-201, except that using the back layer-2 to -15 instead of using the back layer-1.

Chemical structures of the compounds used in Examples of the invention are shown below.

Spectral sensitizer A

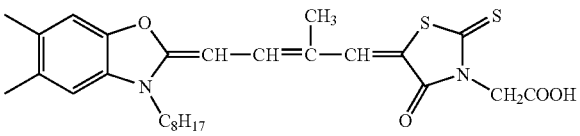

-continued

Spectral sensitizer B

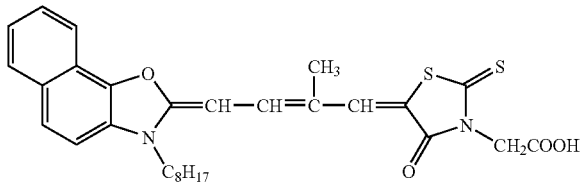

Tellulium sensitizer C

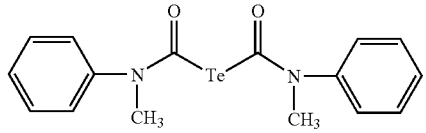

Base precursor-1

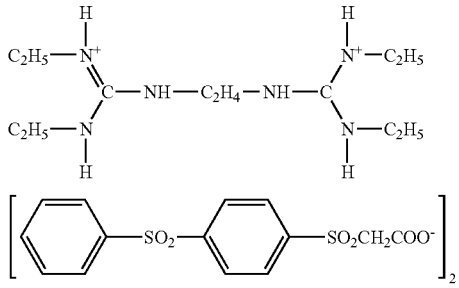

Cyanine dye-1

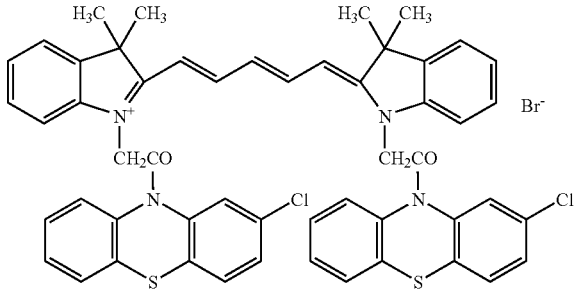

Blue dye-1

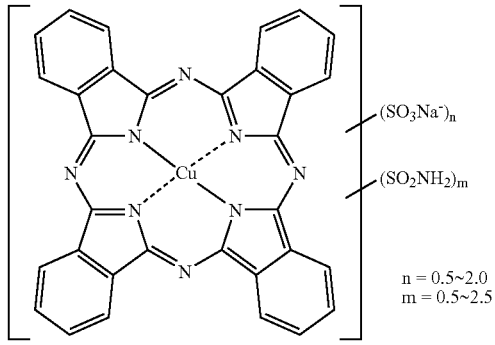

Reducing agent-1

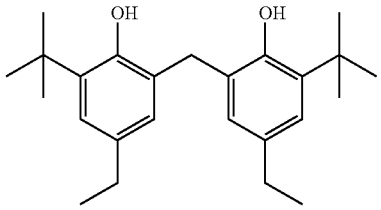

-continued

Reducing agent-2

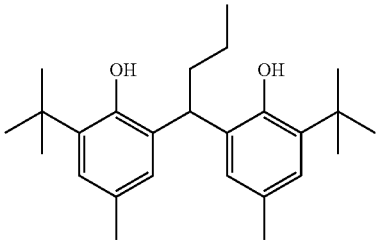

Hydrogen bonding compound-1

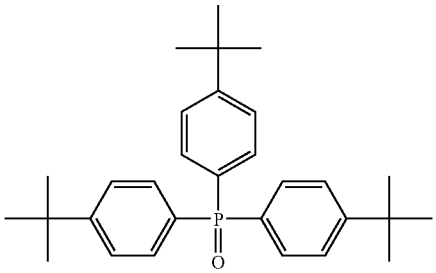

Organic polyhalogen compound-1

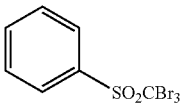

Organic polyhalogen compound-2

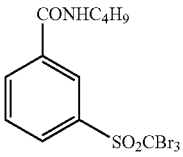

Mercapto compound-1

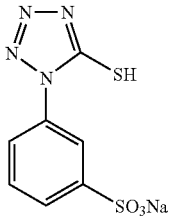

Mercapto compound-2

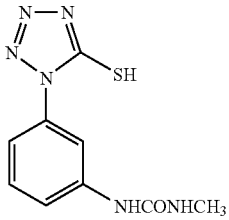

Phthalazine compound-1

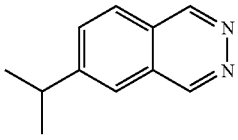

-continued

Development accelerator-1

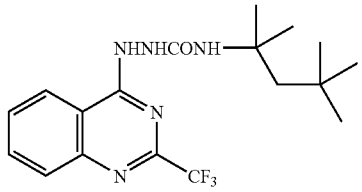

Development accelerator-2

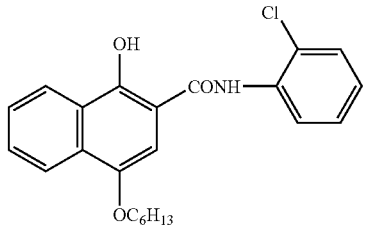

Color-tone-adjusting agent-1

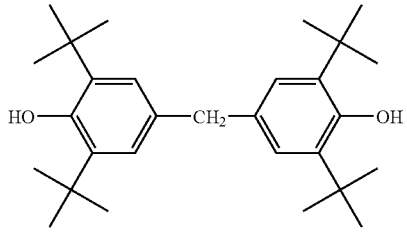

Fluorocarbon compund-A

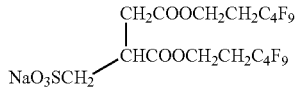

Fluorocarbon compound-B

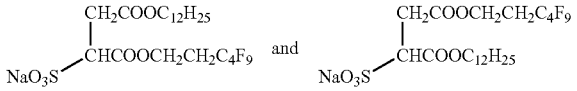

4. Evaluation of Photographic Properties

1) Preparation

The resulting sample was cut into a half-cut size (43 cm in length×35 cm in width), and was wrapped with the following packaging material under an environment of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-2} day^{-1}$.

2) Exposure and Thermal Development

To the photothermographic material-101 to -115, exposure and thermal development (24 seconds in total with 4 panel heaters set to 112° C.-119° C.-121° C.-121° C.) with Fuji Medical Dry Laser Imager FM-DP L (equipped with 660 nm laser diode having an maximum output of 60 mW (IIIB)) were performed. Evaluation on an image obtained was performed with a densitometer.

To the photothermographic material-201 to -215, exposure and thermal development (14 seconds in total with 3 panel heaters set to 107° C.-121° C.-121° C.) with Fuji Medical Dry Laser Imager DRYPIX 7000 (equipped with 660 nm laser diode having an maximum output of 50 mW measured using GLOSSMETER VG-2000 produced by Nippon Denshoku Industries, Ltd.

Degree of Deterioration in Surface Gloss (%)=Surface Gloss measured after the storage−Surface Gloss measured immediately after thermal processing 4) Result of Evaluation The results obtained are shown in Table 2.

TABLE 2

| Photothermographic material No. | Binder of back surface protective layer: Latex polymer No. | Latex polymer (Tg: ° C.) | Latex polymer I/O value | Water-soluble polymer kind | Latex polymer content (%) | Transport deficiency (%) | Degree of deterioration in surface gloss (%) |
|---|---|---|---|---|---|---|---|
| 101 | comparative latex1 | 42 | 0.555 | gelatin | 18 | 0.034 | −2 |
| 102 | comparative latex2 | −34 | 0.490 | gelatin | 18 | 0.002 | −18 |
| 103 | P-9 | 3 | 0.398 | gelatin | 18 | 0.004 | −2 |
| 104 | P-11 | −2 | 0.545 | gelatin | 18 | 0.002 | −1 |
| 105 | P-12 | −22 | 0.519 | gelatin | 18 | 0.002 | −2 |
| 106 | P-19 | −12 | 0.498 | gelatin | 18 | 0.002 | −3 |
| 107 | P-21 | −21 | 0.664 | gelatin | 18 | 0.002 | −1 |
| 108 | P-22 | −4 | 0.739 | gelatin | 18 | 0.002 | −2 |
| 109 | P-24 | −13 | 0.733 | gelatin | 18 | 0.002 | 0 |
| 110 | P-25 | −26 | 0.990 | gelatin | 18 | 0.0 | −4 |
| 111 | P-27 | 1 | 0.109 | gelatin | 18 | 0.002 | −6 |
| 112 | P-28 | 17 | 0.114 | gelatin | 18 | 0.002 | −5 |
| 113 | P-21 | −21 | 0.664 | gelatin | 13 | 0.006 | −4 |
| 114 | P-21 | −21 | 0.664 | gelatin | 23 | 0.0 | 0 |
| 115 | P-21 | −21 | 0.664 | gelatin | 31 | 0.002 | −7 |
| 201 | comparative latex1 | 42 | 0.555 | gelatin | 18 | 0.03 | −2 |
| 202 | comparative latex2 | −34 | 0.490 | gelatin | 18 | 0.002 | −15 |
| 203 | P-9 | 3 | 0.398 | gelatin | 18 | 0.004 | −1 |
| 204 | P-11 | −2 | 0.545 | gelatin | 18 | 0.002 | −1 |
| 205 | P-12 | −22 | 0.519 | gelatin | 18 | 0.002 | 0 |
| 206 | P-19 | −12 | 0.498 | gelatin | 18 | 0.002 | −2 |
| 207 | P-21 | −21 | 0.664 | gelatin | 18 | 0.0 | 0 |
| 208 | P-22 | −4 | 0.739 | gelatin | 18 | 0.002 | −2 |
| 209 | P-24 | −13 | 0.733 | gelatin | 18 | 0.002 | 0 |
| 210 | P-25 | −26 | 0.990 | gelatin | 18 | 0.0 | −3 |
| 211 | P-27 | 1 | 0.109 | gelatin | 18 | 0.002 | −5 |
| 212 | P-28 | 17 | 0.114 | gelatin | 18 | 0.002 | −5 |
| 213 | P-21 | −21 | 0.664 | gelatin | 13 | 0.006 | −4 |
| 214 | P-21 | −21 | 0.664 | gelatin | 23 | 0.0 | 0 |
| 215 | P-21 | −21 | 0.664 | gelatin | 31 | 0.0 | −8 |

(IIIB)) were performed. Evaluation on an image obtained was performed with a densitometer.

3) Evaluation of Photographic Properties (1) Evaluation of Transportability

The photothermographic material-101 to -115, and -201 to -215 were subjected to uniform exposure of giving a density of 1.5. And then 50,000 sheets of each exposed material were thermally developed in the operating thermal developing apparatus at an environment of 35° C. and 85% RH. The number of the sheet jammed by transport deficiency was counted.

(2) Evaluation of Surface Gloss of Processed Sheets Stored in the Forced Storage Condition after Processing After thermal developing process, the samples were stored at 50° C. and 80% RH over a period of 7 days and thereafter the surface gloss of the back surface of each sample was measured. The resultant surface gloss was evaluated as a difference from the data measured at immediately after thermal processing. The surface gloss was It is apparent from Table 2 that, by using the water-soluble polymer and the latex polymer having a glass transition temperature of −30° C. to 40° C. as the binder of the back surface protective layer, excellent properties could be obtained in the photothermograhic materials, including an extremely few jammed sheet caused by transport deficiency and no deterioration in surface glass after stored in the forced storage condition. In particular, the use of polymer latex having an I/O value of 0.3 to 1.0 exhibits excellent result in the degree of deterioration in surface gloss. Moreover, the use of polymer latex having an I/O value of 0.5 to 0.9 gave more preferable result.

Thermal development of the samples was performed by the thermal developing apparatus, Fuji Medical Dry Laser Imager "FM-DP L" and "DRYPIX 7000" produced by Fuji Photo Film Co., Ltd., wherein a surface of the photothermographic material at a side at which the image forming layer is disposed contacts with the driving roller and a surface of the photothermographic material at a side at which the back layer is disposed contacts with the plate heater. The image formation by using this method can afford excellent improvement in transportability and the obtained image was also excellent.

Example 2

1) Preparation of Photothermographic Material

Photothermographic material-301 to -311 were prepared in a similar manner to the process of photothermographic material-101 and -107 prepared in Example 1 except that gelatin and fluorocarbon compound-B in the back surface protective layer were changed to polyvinyl alcohol and fluorocarbon compound as shown in the Table 3, wherein gelatin was replaced by polyvinyl alcohol to give the same weight and fluorocarbon compound-B was replaced by fluorocarbon compound shown in Table 3 to give equimolecular amount.

TABLE 3

| Photothermographic material No. | Binder of back surface protective layer: Latex polymer No. | Latex polymer (Tg: ° C.) | Latex polymer I/O value | Water-soluble polymer kind | Fluorocarbon compound | Transport deficiency (%) | Degree of deterioration in surface gloss (%) |
|---|---|---|---|---|---|---|---|
| 101 | comparative latex1 | 42 | 0.555 | gelatin | B | 0.034 | −2 |
| 107 | P-21 | −21 | 0.664 | gelatin | B | 0.002 | −1 |
| 301 | comparative latex1 | 42 | 0.555 | gelatin | F-18 | 0.032 | −2 |
| 302 | P-21 | −21 | 0.664 | gelatin | F-18 | 0.001 | −1 |
| 303 | P-21 | −21 | 0.664 | gelatin | F-10 | 0.000 | −1 |
| 304 | P-21 | −21 | 0.664 | gelatin | F-20 | 0.001 | −2 |
| 305 | P-21 | −21 | 0.664 | gelatin | F-24 | 0.001 | −1 |
| 306 | comparative latex1 | 42 | 0.555 | *PVA-205 | F-2 | 0.042 | −5 |
| 307 | P-21 | −21 | 0.664 | *PVA-205 | F-2 | 0.004 | −3 |
| 308 | P-21 | −21 | 0.664 | *PVA-205 | F-18 | 0.001 | −1 |
| 309 | P-21 | −21 | 0.664 | *PVA-205 | F-10 | 0.002 | 0 |
| 310 | P-21 | −21 | 0.664 | *PVA-205 | F-20 | 0.002 | −1 |
| 311 | P-21 | −21 | 0.664 | *PVA-205 | F-24 | 0.001 | −1 |

*PVA-205: polyvinyl alcohol PVA-205 (manufactured by Kuraray Co., Ltd.)

1) Evaluation of Photographic Property

As shown in the results of photothermographic aterial-302 to -305, the materials including the preferred fluorocarbon compounds described in the present invention result in superior improvement of the transportability and the degree of deterioration in surface gloss.

Furthermore as shown in the results of photothermographic material-307 to -311, in the case where gelatin was replaced by polyvinyl alcohol as binder of the back surface protective layer, the results similar to the results obtained by using gelatin binder were obtained.

All the photothermographic materials according to the present invention exhibit excellent coating surface state.

What is claimed is:

1. A photothermographic material comprising an image forming layer containing at least a photosensitive silver halide, a non-photosensitive organic silver salt, a reducing agent and a binder, on one surface of a support, and comprising at least one back layer and a back surface protective layer, on the other surface of the support, wherein a binder of the back surface protective layer contains a water-soluble polymer and a latex polymer having a glass transition temperature of −30° C. to 24° C. and the back surface protective layer comprises a fluorocarbon compound containing a fluoroalkyl group having two or more carbon atoms and 12 or less fluorine atoms.

2. The photothermographic material according to claim 1 comprising the latex polymer in an amount of 5% by weight to 50% by weight with respect to a total amount of the binder in the back surface protective layer.

3. The photothermographic material according to claim 2 comprising the latex polymer in an amount of 15% by weight to 40% by weight with respect to the total amount of the binder in the back surface protective layer.

4. The photothermographic material according to claim 1, wherein the latex polymer has a glass transition temperature of −30° C. to 20° C.

5. The photothermographic material according to claim 1, wherein the latex polymer is at least one polymer selected from acrylic polymers, styrene polymers, acrylic/styrene copolymers, styrene/butadiene copo lymers, vinyl chloride polymers, vinylidene chloride polymers and urethane polymers.

6. The photothermographic material according to claim 5, wherein the latex polymer is an acrylic latex polymer.

7. The photothermographic material according to claim 1, wherein the latex polymer has an I/O value of 0.1 to 1.0.

8. The photothermographic material according to claim 7, wherein the latex polymer has an I/O value of 0.5 to 0.9.

9. The photothermographic material according to claim 1, wherein the latex polymer comprises an anionic surfactant.

10. The photothermographic material according to claim 9, wherein the anionic surfactant is at least one selected from salts of alkylbenzene sulfonic acid and diesters of sulfosuccinic acid.

11. The photothermographic material according to claim 1, wherein the water-soluble polymer is gelatin.

12. The photothermographic material according to claim 1, wherein the water-soluble polymer is at least one selected from polyvinyl alcohols and acrylic acid/ polyvinyl alcohol copolymers.

13. The photothermographic material according to claim 1, wherein the fluorocarbon compound contains a fluoroalkyl group having 5 to 9 fluorine atoms.

14. An image forming method for a photothermographic material using a thermal developing apparatus, wherein the thermal developing apparatus comprises an imagewise exposure portion and a thermal development portion having a driving roller and a plate heater, and the photothermographic material according to claim 1 is imagewise exposed in the imagewise exposure portion and thermally developed in the thermal development portion by contacting a surface of the photothermographic material at a side at which the image forming layer is disposed with the driving roller, and by contacting a surface of the photothermographic material at a side at which the back layer is disposed with the plate heater.

* * * * *